US009516949B2

(12) United States Patent
Harkrider

(10) Patent No.: US 9,516,949 B2
(45) Date of Patent: Dec. 13, 2016

(54) INFLATABLE CRAFTS WITH AN INTEGRAL UNDERWATER VIEWING WINDOW

(71) Applicant: Kenneth Troy Harkrider, Bacliff, TX (US)

(72) Inventor: Kenneth Troy Harkrider, Bacliff, TX (US)

( * ) Notice: Subject to any disclaimer, the term of this patent is extended or adjusted under 35 U.S.C. 154(b) by 0 days.

(21) Appl. No.: 14/121,672

(22) Filed: Oct. 6, 2014

(65) Prior Publication Data

US 2016/0096598 A1 Apr. 7, 2016

(51) Int. Cl.

| | |
|---|---|
| ***B63C 11/49*** | (2006.01) |
| ***A47C 4/54*** | (2006.01) |
| ***A47C 15/00*** | (2006.01) |
| ***B63B 7/08*** | (2006.01) |

(52) U.S. Cl.

CPC ..... *A47C 4/54* (2013.01); *A47C 15/006* (2013.01); *B63B 7/08* (2013.01); *B63C 11/49* (2013.01)

(58) Field of Classification Search

CPC ..... B63B 35/73; B63B 35/74; B63C 11/26; A47C 4/54; A47C 15/006

USPC ..... 441/130, 135

See application file for complete search history.

(56) References Cited

U.S. PATENT DOCUMENTS 1,397,456 A * 11/1921 Robinson ..... E06B 9/50 248/270
1,451,096 A * 4/1923 Hagen ..... G02B 23/22 114/66
1,675,964 A * 7/1928 Weinreich ..... B63C 11/49 114/66
2,165,186 A * 7/1939 Walker ..... B24D 3/34 51/295
2,712,139 A * 7/1955 Kelly ..... B63C 11/48 114/66
2,717,399 A * 9/1955 Backhouse ..... A47C 15/006 359/895
2,730,921 A * 1/1956 Little ..... G02B 23/22 359/895
2,911,878 A * 11/1959 Vernier ..... G02B 23/22 359/895
3,042,945 A * 7/1962 Saeman ..... B63B 35/74 441/135
4,145,783 A * 3/1979 Rhodes ..... B63C 11/49 114/66
4,553,819 A * 11/1985 Correll ..... G02B 27/022 359/895

(Continued)

*Primary Examiner* — Anthony Wiest
(74) *Attorney, Agent, or Firm* — Tom Hamill

(57) ABSTRACT

An inflatable water craft for underwater observation, the craft incorporating an integral underwater viewing window which includes a top and bottom transparent lens sonic welded to the craft intermediate a cavity which passes through the top and bottom of the craft forming a viewing port. Inflatable stand-offs protect the bottom lens. The top and bottom lenses includes a closeable vent. An inflatable pillow is sonic welded proximal the top transparent lens. Inflatable boarding guides center the user on the craft and air chambers support the user's body weight thereby preventing sagging or bending of the craft. The craft may further comprise a hand-held device for wading and swimming activities. Use of sonic welding and specific materials prevents undesired leakage into viewing port and prevents discoloration of the top and bottom lenses.

6 Claims, 42 Drawing Sheets

(56) References Cited

U.S. PATENT DOCUMENTS

| | | | | | |
|---|---|---|---|---|---|
| 4,691,658 | A * | 9/1987 | New | B63C 11/49 | 114/66 |
| 4,844,595 | A * | 7/1989 | Nealy | G02B 27/022 | 114/66 |
| 5,093,940 | A * | 3/1992 | Nishiyama | A61F 9/02 | 2/440 |
| 5,447,459 | A * | 9/1995 | Hammond | B63B 35/79 | 114/66 |
| 5,476,055 | A * | 12/1995 | Hackett | B63C 11/49 | 114/66 |
| 5,599,220 | A * | 2/1997 | Smith | B63C 11/48 | 441/135 |
| 5,672,082 | A * | 9/1997 | Binder | B63C 11/49 | 441/135 |
| 5,954,558 | A * | 9/1999 | Osak | B63C 11/49 | 114/66 |
| 6,241,569 | B1 * | 6/2001 | Harkrider | B63C 11/49 | 114/66 |
| 6,572,424 | B2 * | 6/2003 | Harkrider | B63C 11/49 | 114/66 |
| 7,322,309 | B2 * | 1/2008 | Larochelle | B63B 7/08 | 114/345 |
| 7,547,238 | B1 * | 6/2009 | Melancon | B63C 11/49 | 441/135 |
| 7,722,419 | B1 * | 5/2010 | Wood | B63C 11/02 | 441/40 |
| 8,756,736 | B1 * | 6/2014 | Minson | A47C 27/081 | 5/706 |
| 2002/0115366 | A1 * | 8/2002 | Harkrider | B63C 11/49 | 441/135 |
| 2006/0035545 | A1 * | 2/2006 | Boley | B63C 11/49 | 441/135 |
| 2009/0200699 | A1 * | 8/2009 | Burke | B63B 35/7906 | 264/241 |

* cited by examiner

INFLATABLE CRAFTS WITH AN INTEGRAL UNDERWATER VIEWING WINDOW

BACKGROUND

Field of Invention

This invention relates to inflatable PVC craft designs, for ages infant to ninety, which are ergonomically designed with embodiments that seriously address comfort, ease of use and function, incorporating an underwater viewing system wherein the lenses are of a material that allow the lenses to be sonic welded in place, to collectively form an underwater viewing window that is integrally one with the craft, including a unique and innovative pillow design that supports a users head and face, when lying prone, like never before, in an non-confined manner, well above the top lens of the viewing window placing the user's eyes centered over the top lens of the integral viewing window Description of Prior Art It is well known that many people cannot use conventional dive masks and snorkels, especially babies and toddlers. This is apparent by the number of devices, crafts, and apparatuses that have emerged to allow adults to view below the water.

The commercial possibilities of such devices were obviously realized and prior art began to appear. Problems early on were apparent and obvious for one skilled in the art. These inventions are as follows.

U.S. Pat. No. 5,599,220 issued Feb. 4, 1997 to Nico Smith describes an underwater viewing device with a transparent convex or concave element located in a buoyant cavity that is filled with water.

This device is a costly injected molded piece. The device is turned over then submerged in the water then turned over while under the water. The buoyancy ring around the transparent convex/concave element then floats the device to the surface, creating a vacuum that holds the water within the transparent dome. This device is small because it would take an excessive amount of buoyancy to float the vacuum of a larger device. Wading with the unit, the user can easily look straight down into the unit since the viewing is directly through a dome. It would not work for one swimming with this device in that one swimming could not rise up from the water enough to look straight down into the device.

U.S. Pat. No. 1,675,964 issued Jul. 3, 1928 to C. G. Weinreich describes an underwater viewing device for locating submerged bodies.

This device is large and would be used alongside a boat or barge and would not, be used in shallow water. The upper eye sockets along with a clear pane sealed at the lower end of the tube is required to prevent light from entering the viewing tube and causing a light refracting, view blocking glare. One could not swim with this device.

U.S. Pat. No. 2,911,878 issued Nov. 10, 1959 to G. E. Vernier describes an underwater viewing device of an elongated tube structure having an eyepiece and a viewport at respectively opposite ends constricted to minimum viewing dimensions to reduce buoyancy or otherwise weight. This device very large and requires eye sockets atop the unit, plug by the users face to eliminate extraneous light. There are two clear panes at the lower end of this device that are slightly spaced apart and sealed water tight within the unit. This double pane is to prevent the lower pane from forming condensation. Being one skilled in the art, the chamber between the two clear panes is not a vacuum or filled with a gas or fluid. That inter chamber would form condensation with climate changes.

U.S. Patent 2006/0035545 A1 issued Feb. 16, 2006 to James D. Boley describes an underwater viewing apparatus which includes a hollow housing having a first end engage with a water surface, an opposed second end and a sloping conical portion connecting the first end and the second end, elevating the second end to a predetermined distance from the water surface. A transparent pane member is mounted in a watertight manner with the first end of the housing and engages the water surface enabling viewing of the underwater environment. A face guard is attached to the second end for preventing light from entering the interior portion of the housing and causing a glare on the pane member.

The face of the user is used to plug the hole of the second end in a goggle or dive mask flange configuration to stop glare. This negates its use by those suffering from claustrophobia. This device is quite large and one cannot swim or travel with it. It is mentioned that this invention is operated in a free standing fashion and by a single person operating a moveable, motorize watercraft. To one skilled in the art, having ones face plugged into the upper end of this device while operating a motor watercraft seems a bit dangerous.

U.S. Pat. No. 2,730,921 issued Jan. 17, 1956 to H. W. Little describes an underwater viewing device which may be collapsed for storage or travel. This is done by means of a telescoping tube, a spring loaded tube formed of rubber, plastic, or other flexible waterproof material. In one embodiment, the piece is curved to accept the users face. Another embodiment employs a glass lens, sealed water tight, at the upper and lower ends of the tube, with the same curved upper end to house the users face. In use, the handles are grasped, both to keep it from falling over, and keep the lower end of the device submerged below the surface of the water. The user then positions his face into the upper curved end of the device, so that outside light is shut out from the interior of the viewing area allowing then, and only then, the user to see objects below the surface of the water.

U.S. Pat. No. 5,954,558 issued Sep. 21, 1999 to Raymond W. Osak describes another tubular underwater viewing device. This device is used during ice fishing, permitting a user to see underwater through a hole in the ice. This invention employs a single clear pane at the lower end of the tube with an upper viewing area. The lower clear pane is housed within a flange which is made water tight by use of an elastomeric O ring and the upper end is a lid extending over the top portion of the tube coupled with an eye guard as described in the patent. The eye guard design, as noted in the patent, is for the user to place their face within to block external light from entering the tube that would cause a view blocking glare. It is a further embodiment that a cover, attached by a hook and loop fastener to the eye guard, go over the users head to block external light. This device is again large and designed for stationary use.

U.S. Pat. No. 4,145,783 issued Mar. 27, 1979 to Ronald J. Rhodes describes an underwater viewing device for use by a person standing in relatively shallow water and comprising a central transparent viewing window peripherally surrounded by a support structure which floats the device and keeps the transparent pane below the water's surface. The support structure or floatation ring houses one or more storage compartments. A light affecting element is disposed within the support structure adjacent the window. To one skilled in the art, this is a costly device to manufacture, especially the water tight construction necessary for the lighting element. This lighting element is also stationary. It cannot be adjusted for varying water depths. There is also no means to prevent extraneous water from entering the viewing area. So consequently, one could not swim with this device in deep water. If or when, extraneous water was splashed onto the single transparent pane the view below the water would end and the user would be forced back to shallow water to remove the obstruction. The device is obviously too large to pack into a suit case.

U.S. Pat. No. 7,547,238 B1 issued Jun. 16, 2009 to Michel Mclancon describes a floatable water board with an underwater viewing assembly for supporting at least an upper portion of a user lying on the board when in a body of water. The board is formed of a flotation body construction of buoyant material. A viewing cavity is provided in the flotation body disposed in a forward region of the flotation body. A transparent pane is sealed and retained at the bottom end of the viewing cavity. An inflatable circumferential flotation collar assembly is secured about the cavity flexible and extendable section "scalingly" engaged about the viewing cavity and deployed above the top surface of the flotation body to prevent extraneous water from entering the viewing cavity. Being one skill in the art, one look at this flotation device and one can see just how uncomfortable it would be to use. To lie on the board keeping your head suspended above and over the viewing cavity would be neck breaking. The other approach of propping yourself up on your elbows, as FIG. 2 shows, would fatigue users and preclude many people with physical limitations from using the device, such as the elderly and the physically impaired or just adults in general. Furthermore, you cannot travel with this device or use lying supine.

U.S. Pat. No. 1,397,456 issued Jun. 11, 1975 to Arthur Wyatt Warren describes a buoyant board of buoyant material comprising a rigid, substantially flat elongated base portion having a pair of generally longitudinally extending fins projecting from the underside surface thereof and a watertight transparent window therein. When the board is floating on the water, a person lying on the board is able to see into the water beneath the board. Preferably, the window is formed adjacent one end of the base portion, this one end serving as the front or bow end of the board and being raised to the remainder of the base portion for restricting the passage of water over and onto the window when the board is propelled forwardly through the water. This invention is again costly to manufacture requiring expense tooling of molds and the manufacture and insertion of the viewing window into the craft. The window also is of a two pane design, a top pane and bottom pane, sealed water tight, encapsulating a small space or walled cavity between them. This design, with climate changes, will produce condensation that cannot be removed once there. Nor does this invention address comfort in anyway, only function.

U.S. Pat. No. 4,553,819 issued Nov. 19, 1985 to Charles Correll describes a visual aid apparatus for viewing objects beneath the water's surface. The apparatus includes a relatively thin transparent sheet which is preferably circular. A buoyant, closed-wall member is secured in a leak proof manner to define a relatively shallow, pan-like container for floating on the surface of the water. This invention is primarily for pool cleaning and comes with an attached metal sleeve for a pool vacuum wade to be inserted through. The device moves with the vacuum through the water enabling the user to see what is being cleaned. Being one skilled in the art, this device can only be used in very calm water. It's mentioned that it could be used in shallow water for spear fishing, as would many underwater viewing devices. This device would be impossible to swim with and keep water out of the unit.

U.S. Pat. No. 1,451,096 issued Apr. 10, 1923 to Oscar Hagen describes a telescope for viewing underwater from a boat. The device is a very long conical shaped tube with a lens attached; water tight, to the bottom of the tube and the upper most portion of the viewing tube is curved to accommodate a user's face and eyes. It comes with a cloth hood to be draped over the users head to eliminate outside light from entering the viewing tube and causing view blocking glare. It comes also with a light attachment with an external switch and the light is secured in a non adjustable manner. This is again a large bulky device that one cannot swim with or travel with easily, such as air travel.

U.S. Pat. No. 5,672,082 issued Sep. 30, 1997 to Emanuel Binder describes a floating underwater viewing device having a column with a first and second end, and a first viewing window and a second viewing window. The first viewing window is integrally formed with the first end of the column, and the second viewing window is integrally formed with the second end of the column to form a watertight viewing chamber. A first "toroidal" float and second "toroidal" float are disposed about the column. At least one of the first and second toroidal floats is slide ably attached to the column. This device is a multiple transparent pane design. Prior art with this type of design employed means to eliminate external light from entering the viewing area which would cause a glare between the top and bottom panes. Thus the glare would block ones view of the underwater world. This invention has no means of preventing glare which will occur with this device, unquestionably. Not to mention climate changes that would cause the inside of the watertight viewing chamber to form condensation and completely block the view. This device is large, bulky and would be costly to manufacture and would not be something one could pack in a suit case.

U.S. Pat. No. 4,691,658 issued Sep. 8, 1987 to Dane S. New describes an aquatic sport device that includes a buoyant board configured for supporting a user in a prone position thereon and sized to enable the user, supported thereby, to manually paddle while in a prone position. A sight opening is provided through the buoyant board in an optical system disposed therein enables a visual perception through buoyant board by the user when in a prone position. The optical system may include a first and a second transparent member with the first transparent member being supported by topside portions of the buoyant board at an acute angle with the second transparent member which is disposed in the buoyant board opening and generally parallel to the hull of the buoyant board. The angular relationship between the first and second transparent members enables the person looking there-through to perceive in a forward direction towards the bow of the buoyant board. The first transparent member is held at an elevated position above the paddle board deck portion and in an angular relationship therewith to enable a person in a prone position on the buoyant board deck portion to look forwardly into the sight compartment towards the buoyant boards bow. A boot or shroud, FIG. 80, made of a flexible material, such as plastic, synthetic rubber, or the like, page 4, paragraph 35, 40, 45, that is fitted around the first transparent member for engaging a user's head and thereby operative for substantially eliminating the entry of light and water between the users head and the first transparent member.

The flexible shroud being flexible would not support a users head. Requiring, with the first transparent member raised above the deck of the board, the user to hold their head up, even more so, over the first transparent member fatiguing the neck, shoulders and arms, while keeping their head in the flexible shroud to prevent extraneous light out. Furthermore, with the forward angled viewing chamber, the distance between the users eyes and the underwater features will be increased, not a snorkeling objective. In the detailed description, second paragraph, the craft is made of plastic or fiberglass and maybe filled with foam for add buoyancy. This constitutes a heavy and cumbersome boat like craft and one not suited for travel.

U.S. Pat. No. 2,165,186A issued Apr. 9, 1986 to Alan Johnson that describes a buoyant underwater viewing device that provides a device for a person to be supported on water and be able to view the underwater scenery by means of a transparent panel built into the device. The viewing area could consist of two transparent panels with one panel sealed, watertight, to top extreme of a void within the craft, flush with the top deck portion of the raft or device and one transparent panel at the bottom extreme of said void, flush with the bottom hull portion of the craft. Thereby, creating an air gap between the two transparent panels. Another embodiment is that this gap could be of solid transparent material. Function, again, is the only issue addressed here. What's more, the flotation device would have to be of a buoyancy thickness to support a user in the water. Thusly a solid transparent material within the void or cavity within the craft would require it to be of equal thickness, as depicted. A piece like this made of acrylic, poly carbon, or the like, would be extremely expensive. Holding ones head up over the viewing area, with no support, for any length of time would be for the very youthful to say the least.

U.S. patent issued Oct. 14, 1987 to Anthony James Myatt that describes a raft provided which will support a person lying face down, so that the person can peer into the water through a window at the bow end of the raft. The window FIG. 12 has the shape of the window of a well known type of goggle (not shown) used in the above mentioned activity of goggling. The window is in direct contact with the water on which the raft floats, so as to present a clear view into the water.

It appears that the well within the raft is covered or sealed at the bottom end of the well, contacting the water. Thereon are attached goggles with a clear panel within the goggles. Drawing 1 shows this goggle attached to the bottom of the well and it seems to be lower than the top deck portion of the raft. This, obviously, would require the user to put their head down into the well to contact the goggles in order to see below the water. This positioning, with the head and neck out of line with the spine, would be very uncomfortable, limiting use time. Not to mention, the goggles, being of a soft flexible material, would not support the weight of the users head. There is more given to the craft here, and its esthetics, than to comfort or the underwater viewing aspect of the craft.

U.S. Pat. No. 5,476,055 issued Dec. 19, 1995 to Robin M. F. Hackett describes a watercraft with underwater viewing port having a hull with a viewing opening therein extending between upper and lower portion of the hull. A transparent viewing unit is fitted within the viewing opening and has a periphery space apart from side wall of the viewing opening to define a draining space between the side wall and the viewing unit. This provides a peripheral clearance extending generally around the unit for draining water through the hull. A cowl extends peripherally around the viewing opening and has a lower portion sealing the viewing opening to prevent passage of water and an upper portion to embrace portions of the users face to exclude extraneous light that would create glare.

Prior art using a single lower clear pane or top and bottom clear pane have used cowls or dive mask flange configurations to accept a user's face to block extraneous light that would cause a glare within the viewing area. This invention places the cowl or goggles in close proximity to the upper clear pane of the viewing area. The user placing the upper portion of their face into this inventions cowl and relaxing would not only be hot but the peripheral boundaries of the cowl against the users face would cause perspiration. Furthermore, relaxing onto the cowl would put excessive pressure on the area where the cowl contacts the face causing the equivalent to what is called mask compression experienced when using a conventional dive mask. This leaves an uncomfortable, lasting, impressed ring around the users face. Glass, as shown, could not be used with this goggle design. Condensation forming with temperature changes is also an issue here. The comfort aspect of this craft cannot be fully achieved because of the main need to block extraneous light from the viewing unit. The craft here along with the viewing unit would be very expensive to manufacture.

U.S. Pat. No. 4,844,595 issued Jul. 4, 1989 to Robert B. Nealy describes a viewing device for flotation bodies that comprises a body having an interior defined by its side walls and at least one transparent end wall. In one embodiment using two transparent end walls, the transparent end walls define spaced-apart viewing ports, one port being normally above the surface of the water and the opposite port being below the surface of the water. The interior of the body is adapted to be substantially condensation free by evacuating the interior of the body and sealing the body in the evacuated condition or filling the body with a fluid to the exclusion of air so that condensation and air bubbles are thereby avoided. In a preferred embodiment the viewing device consists of a singular piece body having a single transparent end wall.

To one skilled in the art, comfort is not an addressed issue. A user must lie on the board and prop themselves up on their elbows in order to see down into the viewing port. Only the young or the very physically adapt could use this device for any length of time. Above, the interior body space between two transparent end walls is evacuated of air and sealed or water in that space could be used. Water permanently contained in that manner will grow algae. Additionally, expensive tooling is required to manufacture this viewing port.

U.S. patent issued Mar. 19, 1963 to W. M. Betts describes an underwater viewer which contemplates the provision of a relatively flat, hollow and buoyant float, preferably composed of fiberglass or of a material of similar characteristics, and provide with a flat top or deck upon which a bather can rest in a prone position, and with a raised tower or turret having a window at the bottom, provided on the float and positioned to receive the face of the float occupant and through which an underwater inspection is made available. The invention further contemplates the provision of means by which comfortable breathing by the user is had during his use of the viewing tower or turret.

The use of a turret or collar is used again to eliminate extraneous water. One must prop themselves upon their elbows to use the device. It is also an expensive and heavy product, being made of fiberglass.

U.S. Pat. No. 2,712,139 issued Jul. 5, 1955 to E. L. Kelly describing an underwater viewing device having an opening extending through the platform, said opening being closed adjacent its lower end by a transparent window, and having an upstanding collar member mounted on the upper surface of the platform surrounding said opening to support the face of the viewer while serving to exclude water which may splash on or flow over the upper surface of the platform.

There is nothing about these collars that form an ergonomic shape to comfortably accommodate a viewer's face. It is mention herein that a viewer could place their chin upon the collar. This would become uncomfortable in a short amount of time and would be nearly unusable if the viewer finds it necessary to breathe through their mouth.

U.S. Pat. No. 5,447,459 issued Sep. 5, 1995 to Norman R. Hammond describing an underwater viewing board for viewing underwater objects while an observer is lying in a prone position is of seamless, unitary construction, and has a viewing well extending through the body of the board that is integrally formed within the body. The body may be formed of rotomolded plastic. An upper end of the viewing well has a contoured shape that conforms generally to the contours of the human face. A transparent window is mounted at the lower end of the viewing well and may be recessed from the bottom of the board. In this configuration the opening at the top most extreme of the viewing area is unshielded which would allow water from such sources, as rain, to enter the viewing area onto the bottom transparent window. This, according to the craft design, would be very difficult to remove. Yet again the user must use their head to block out extraneous sunlight to avoid view blocking glare. It is further noticed, that the upper opening of the viewing well is said to have "a contoured shape that conforms generally to the contours of the human face. Again, light into the viewing well causes glare and the viewer must use their head to block out the glare causing light. Also the user must hold up their head while using the device to view below the water.

U.S. Pat. No. 6,241,569, B1 issued Jun. 5, 2001 to Kent Harkrider describing sea windows for rafts with an underwater observation device in combination with a buoyant craft provides an observer with a clear and unobstructed view of the underwater scenes. The underwater observation device comprises an upper transparent window, a lower transparent window, and a body portion disposed between the upper transparent window and the lower transparent window. The body portion has a centrally disposed cavity that is filled with a transparent fluid material and vent for permitting the ingress and egress of the transparent fluid. A person lying in a prone position on a buoyant craft can comfortably peer down into the water and enjoy the underwater scene.

This invention speaks of rigid crafts with unnecessary embodiments, complicated costly construction of the crafts and underwater viewing devices. The headrests are not designed properly, in that the aft perimeter wall of the headrest is practically 90 degrees to the upper transparent window. Noting the drawings, the user must position them forward passed the upper transparent window in order to place their forehead upon the headrest. This places their eyes looking into the headrest or, at best, looking down the forward wall of the viewing cavity. Furthermore this is a fixed headrest that would allow head, neck and spine alignment for only one particular user size. It cannot adjust to another users comfort level.

U.S. Pat. No. 6,572,424 issued Jun. 3, 2003 to Kent Harkrider which describes a personal swim craft with an underwater viewing area that has a liquid filled viewing area that is simply and inexpensively created within the craft requiring no tooling for molds or related costs. A walled cavity through the craft is sealed at its upper and lower openings with transparent panes. These panes are sealed in place without drilling or tapping holes or otherwise altering the surface of the panes.

This invention speaks of primarily rigid crafts which are very costly to manufacture, difficult to transport, and are for practical reasons, for only the rental market. Not to mention, the vertical shafts to either side of the headrest for the removal of bubbles from the lower transparent pane are an added cost to the craft and are unnecessary. An inflatable craft is also mentioned. I noted in this patent that the transparent panes were of acrylic or PVC, page 9 and FIG. 3. After this patent, I found that PVC is not that clear and to have two pieces of PVC to look through produces a very poor, cloudy, distorted view. I even checked out plexiglass. It has a bluish tint to it and looking through two pieces the view is discolored and obscured. Use of these materials eventually impedes clear underwater viewing.

In FIG. 3B a method of installing a rigid transparent pane in an inflatable craft is shown. Consisting of a perimeter piece of PVC that covers the peripheral ends of an acrylic or otherwise rigid clear pane and the PVC piece is electronically welded, so I said in my patent, to the craft with the clear pane sandwiched between the PVC piece and the craft. The craft is not the foundation for the lenses to rest on and be watertight. In an inflatable, the PVC expands and contracts with temperature changes and with inflating and deflating and the weight pressure of a user atop the craft creating outward movement of the craft, there is no way this installation could or would remain watertight. Especially to hold the water that would fill the expanse of the walled cavity, it would leak. Also in claim 16 it states that the transparent panes would be installed by means of electronic welding. None of the transparent material mentioned in this patent can be electronically or otherwise welded to PVC, plus sonic welding is used on PVC, according to the internet. Furthermore, the inflated embodiment shows rectangular transparent panes. Corners, on acrylics and the like, would break or crack. They must be rounded. The headrest with this craft is also of poor design. The aft peripheral wall of the headrest is again 90 degrees to the upper transparent pane. The user's eyes are not going to be centered, above the upper transparent pane.

FIG. 4 shows an inflatable craft with an exterior horse shoe shaped air chamber with an interior lateral air chamber. This design with the interior air chambers going all the way to the stern, without interruption, does not give adequate resistance to bending.

SUMMARY OF THE INVENTION

In accordance with the present invention, possessing improved ergonomically designed PVC inflatable crafts that exemplify singular purpose comfort, ease of use, function and craft air chambers designed not to bend and a unique pillow design. The underwater viewing lenses are integrally installed within the crafts using, such as but not limited to, PETG, PET or derivatives (DuPont product) as the lens material. The nature of these materials, like others DuPont might produce, allows them to be sonic welded to the crafts top and bottom extreme of a walled cavity extending vertically through the bow end of the crafts. Wherein, an underwater viewing window of unique and revolutionary construction is created. This one piece union of transparent lenses to a PVC craft will stay watertight, when filled with a clear liquid, through temperature expansion and contraction, use and abuse, repeated inflation and deflation, packing and unpacking. The lenses are one with the craft and collapses with deflated craft.

The craft designs and sizes provide for a plurality of user sizes and ages from infants to adults. Some crafts are fitted with a unique unprecedented pillow design allowing a person lying prone to place their forehead upon the pillow and with their eyes centered well above the top viewing lens, with no facial or head confinements or ventilation problems. Users lie in total comfort. Further embodiments are to be revealed. It is well known that the scuba mask, snorkel and scuba tank changed how we view the underwater world. Snorkeling fast became a popular sport. An affordable, packable, comfortable, up close and personal view below the water was brought to the masses. The view was unequal for those who mastered the sport. Comfort was also a plus because the body was suspended, weightlessly, in the water with no stress or strain on the neck, shoulders or back. However there were a tremendous number of people that could not use a mask and snorkel. They are either to young, to old, do not swim well or were too claustrophobic to use the mask. The need for alternatives was apparent so inventions to accommodate such people and allow them to enjoy the underwater world came to be. These inventions concentrated on function to achieve their goals to see below the surface of the water. No real considerations were addressed when it came to comfort. There were crafts with viewing ports installed using a single clear pane affixed at the lower end contacting the water and one problem here was there were no means for a user to rest their head upon. Another problem came from extraneous water entering and blocking the view. It was exactly like that of getting water in a miss fitting scuba mask. So answers to this came in the form of turrets, collars, and cowls extending up and around the viewing port, which force the user to hold their head up over these appendages to see below the water. This would very quickly, for many people, bring about neck, shoulder and back stress and preclude many people from using the device at all.

Then the two pane design was introduced, wherein a clear pane was attached to the top of the viewing port and one to the bottom. This design did prevented extraneous water from blocking the view, however light would refract within the space between the two panes negating the underwater view. Furthermore the space between two water tight clear panes would form condensation with temperature changes that could not be removed. Just like a dive mask fogging. This problem was answered with turrets or collars for the user to plug their face into to block extraneous light. In a functional sense it worked, however comfort was again negated. The user once again had to prop themselves up on their elbows and insert their face into a hole to block out the light. Neck, shoulder, neck and back stress are but one drawback, for the user now had to paddle around on a craft with their eyes blinded. There also came along hand held devices. These devices suffered the same problems as the above crafts, but more over, were heavy, cumbersome and in some instances designed to be used alongside a boat. In all the cases above none came close to matching in any way the comfort experienced with a mask and snorkel suspended in the water. In fact these devices prevented more people from using the above devices than the people who can't master the sport of snorkeling. The view was not equal, up close and personal, and comfort using the above devices went out the window. None of the above could be packed in a suit case and then travel by air with. The present invention delivers a crystal clear view below the water, provides the user with full support comfort when lying prone on PVC crafts with their head resting, comfortably, on a pillow with no facial confines or holes to plug, and no problems with extraneous light or water. Plus, being inflatable, can be purchased and used by the masses, and packed in a suit case for travel. The present invention offers to those who cannot use a mask and snorkel the same offered by the mask and snorkel; affordable, packable, comfortable, with an up close and personal view below the water.

It is the Intent of this Invention to Show the Following

A) To provide a PVC inflatable craft for children from, approximately, infant to three years of age, with fixed and adjustable seating and possessing an integral underwater viewing window.

B) To provide PVC inflatable crafts, to accommodate children from, approximately, three to five years of age, with fixed and adjustable seating, with the above integrally installed underwater viewing window lenses.

C) To provide a PVC hand held underwater viewing device, wherein the device can be waded with or swam with, allowing use for ages 1 to 90 years of age, furthermore the device takes, approximately, seven breathes to inflate and packs very small:

D) To provide a PVC inflatable craft, with the above integrally installed underwater viewing window lenses, at a predetermined length to accommodate user heights from, approximately, 4½ feet to 5½ feet tall.

E) To provide a PVC inflatable craft, with the above integrally installed underwater viewing window lenses, at a predetermined length, to accommodate user heights from, approximately, 5½ to 6 feet.

F) To provide a PVC inflatable craft, with the above integrally installed underwater viewing window lenses, at a predetermined length to accommodate user heights from approximately 6 feet to 7 feet.

G) To provide a PVC inflatable craft with an integrally installed underwater viewing window, wherein an aft length adjusting air chamber(s) can change the length of the craft by inflation or deflation H) To provide a PVC inflatable craft with the above integrally installed underwater viewing window, wherein a portion of the crafts sides, port and starboard, are recessed slightly to provide easy reach of the water and unobstructed movement of a users arms when paddling the craft.

I) To provide PVC inflatable craft with the above integrally installed underwater viewing window, possessing an air chamber design and arrangement that are designed not to bending, providing, absolute, comfort lying prone.

J) To provide inflatable bottom stand offs installed on the inflatable PVC underwater viewing crafts hulls, to either side of the viewing windows bottom clear lenses, at a predetermined length, width and height to support the craft when laid down or dropped, holding the bottom clear lens above the surface of the ground to prevent scratches.

K) To provide inflatable boarding guides, of sufficient height, width and length, mounted topside to either side of the craft, port and starboard, to act as feelers to position and guide the user to the center of the craft when boarding and keep them there.

L) To provide a PVC inflatable pillow of a unique design and construction, that extends over the viewing window, sufficiently, and allows a user, lying prone, to place their forehead upon the pillow, and relax. Wherein the user's eyes are automatically centered over the top clear lens of the viewing window, and holds the users face several inches above the top lens, providing open air ventilation and peripheral vision, with no facial confines M) To provide PVC inflatable crafts wherein a flag pole mount is installed that allows a flag, such as a dive flag, to be installed, providing additional visual presences for the user. A safety factor especially where boat traffic is near. Thus being a consideration for children as well.

N) To provide a viewing window consisting of a walled cavity viewing port through a PVC craft just aft and under the pillow wherein the lenses that cover the top and bottom extremes of the walled cavity viewing port, vertically through the craft, are of a material that allow these lenses to be sonic welded into place, becoming integrally one with the craft, forming collectively, an underwater viewing window.

O) To provide a sonic welded lens installation with means to reinforce the sonic welding of the clear lenses to the craft's viewing port, constituting two different means of reinforcement to prevent leak defects.

P) To provide a PVC inflated craft wherein the bottom half of the craft is of a heavier gauge PVC to provide additional puncture resistance to the entire bottom of the craft.

Q) To provide for these PVC crafts a dive light mount to each side, outboard, port and starboard, of the viewing window, for night snorkeling, that are directionally adjustable to place the light where needed.

R) To provide a closeable vent sonic welded to the bottom clear lens, that is opened to break the vacuum during the discharge of the clear liquid, such as water, from the viewing port cavity, allowing accelerated regress of the clear liquid that would exit very slowly if from only a top closeable vent.

S) To provide an underwater viewing hand held device that can be used by all ages from 1 to 90, which can be waded with in any clear body of water or swam with, wearing a life preserver and fins.

T) To provide a craft that is more cost effective to produce because there are no scuppers or other obvious means to remove extraneous water.

U) To provide a craft with a viewing area that is void. Wherein a modified underwater hand held device, separated from the craft, can be inserted into the crafts void viewing area and serve as that crafts viewing area and underwater viewing window. This makes for easy filling of the viewing cavity and easy transport.

V) To provide a means to quickly deflate prone use craft of this invention, wherein quick air deflate valves are installed on the bottoms of the crafts.

Further objects and advantages are to provide an underwater viewing window which provides a crystal clear, unencumbered view below the water, incorporated, integrally, with crafts designed for children and adults with single purpose comfort, operation and function.

DESCRIPTION OF FIGURES

FIG. 10 is a side isometric view of craft 99A with

FIG. 12 is a side isometric view of child craft 99B with

DETAILED DESCRIPTION OF FIGURES

Figure 1:
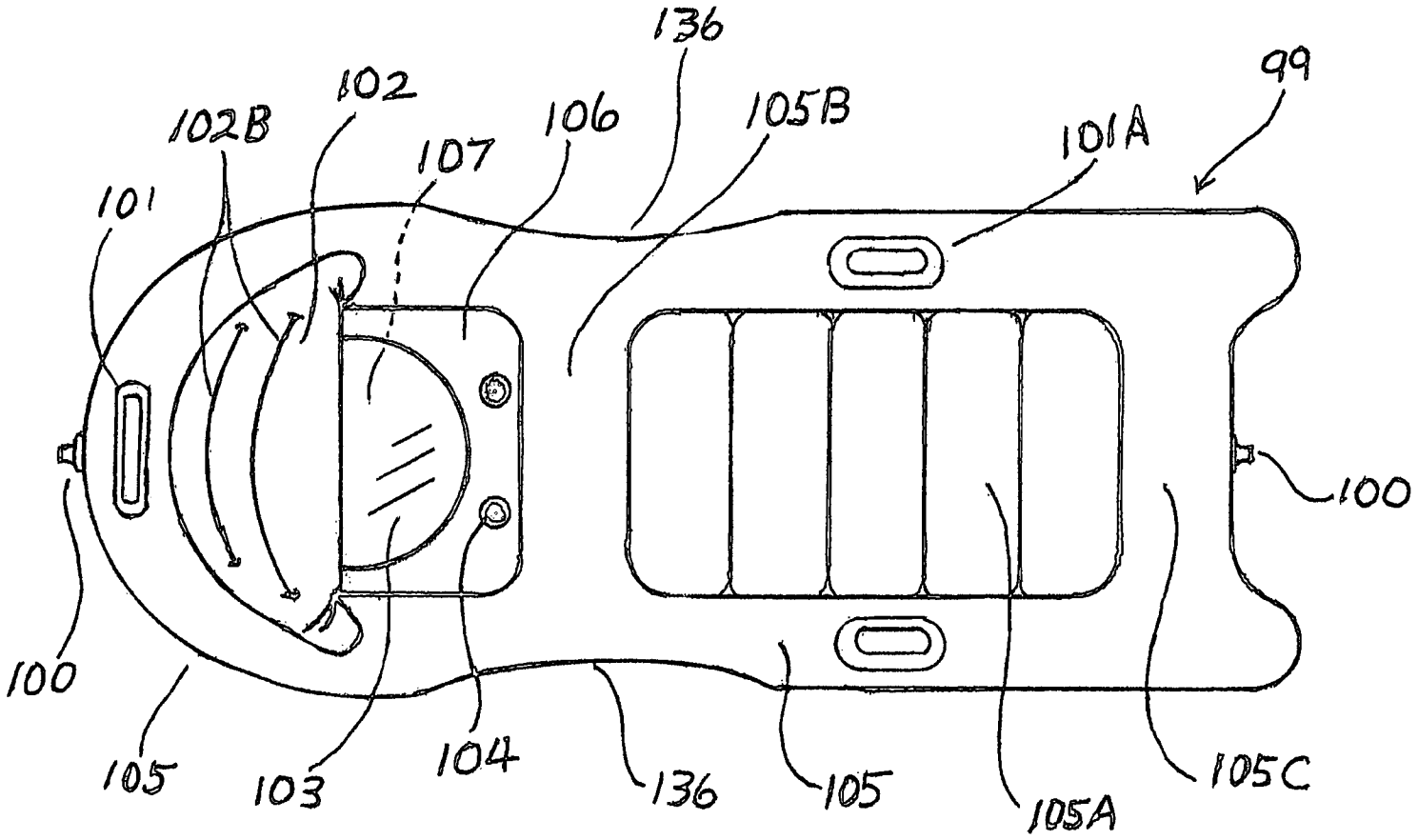
FIG. 1 is a top view of craft 99

A preferred embodiment of inflatable crafts with an integral underwater viewing area installation of the present invention is illustrated in:

A top view of FIG. 1 shows the top view layout of craft 99. Starting at the bow there is a towing eye 100 and a tow eye 100 on the stern. Said tow eyes 100 are for when parents are snorkeling and their child is on said craft 99, for their size, parents can tie a line to said bow towing eye 100 and pull a child along with them and explain to a child what they are seeing. The stem said tow eye 100 can be used to tie to said crafts 99 and be pulled in tandem. There is also a bow handle 101 that can be used to transport said craft 99 when inflated.

Next is a unique pillow 102 design that, using I-beams 102B, extends out over top clear lens 103 of viewing port cavity 107 by about a third.

Said pillow 102 is constructed around said viewing port cavity 107 and said top lens 103 in a semi-circle shape said I-beams 102B then pull up on the bottom of said pillow 102 and down on the top of said pillow 102. This action pulls the aft edge of said pillow 102 more over said top clear lens 103 of said viewing port cavity 107. Said I-beams 102B creates an opened space under said pillow 102, and over said top clear lens 103. The opened space under said pillow 102 provides open air breathing space, with no confinements and the vision of a user is not totally blocked. No holes to plug or clothe over the head. Viewing area air chamber 106 consist of viewing port said walled cavity 107 vertically through the bow end of said craft 99 with exceptionally clear said lenses 103 and 103A, sonic welded, integrally, to the top and bottom extremes of said viewing cavity 107. These lenses are made, such as but not limited to, of PETG or PET (DuPont product) or derivative. Said lenses 103, 103A, 103B and said craft become an integrally assembled underwater viewing assemble.

Moving on, there are air cross overs 105B and 105C. One aft of said viewing area 106 is cross over 105B and one on stern 105C. Said cross overs connect to out-board air chambers 105, that is a separated air chamber.

Next is inboard lateral air chamber 105A, being also a separate air chamber. With said inboard lateral air chamber 105A running laterally to said outboard air chamber 105 and said outboard air chamber 105 in conjunction with forward said air cross over 105B and stern air cross over 105C, encapsulates said inboard lateral air chamber preventing said craft 99 from bending. The next handles on said craft 99 are mid-ship handles 101A. Said handles 101A provide security and stern boarding assistance. Another revolutionary feature of said crafts 99, are recessed portions 136 of said craft, on each side, port and starboard. This gives a user much more freedom of movement when paddling. Sectional said recesses 136 will be ergonomically placed. Scuppers 104 are used here to remove extraneous water from said top clear lens 103B.

Figure 2:
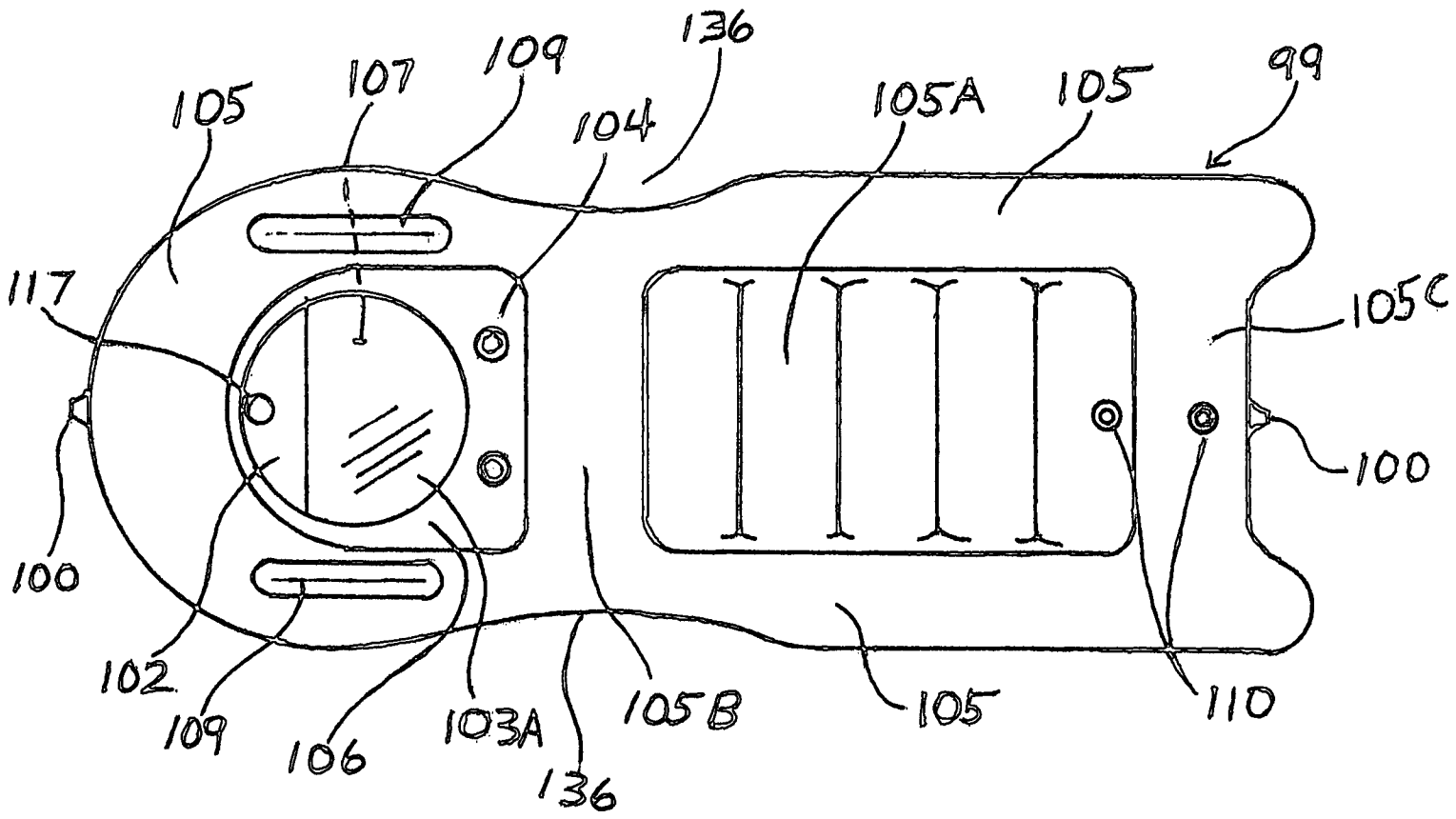
FIG. 2 is a bottom view of craft 99

FIG. 2 is a bottom view of said craft 99. Here we have, said towing eyes 100, said outboard air chambers 105, said inboard lateral air chamber 105A, said air cross overs 105B and 105C and said scuppers 104. Said top lenses 103 and closeable vent 117 for ingress and regress of a fluid is seen through bottom said clear lens 103A. Shown also are stand offs 109. They protect bottom said clear lens 103A from scratches, shown located, port and starboard, of said bottom lens 103A.

Figure 3:
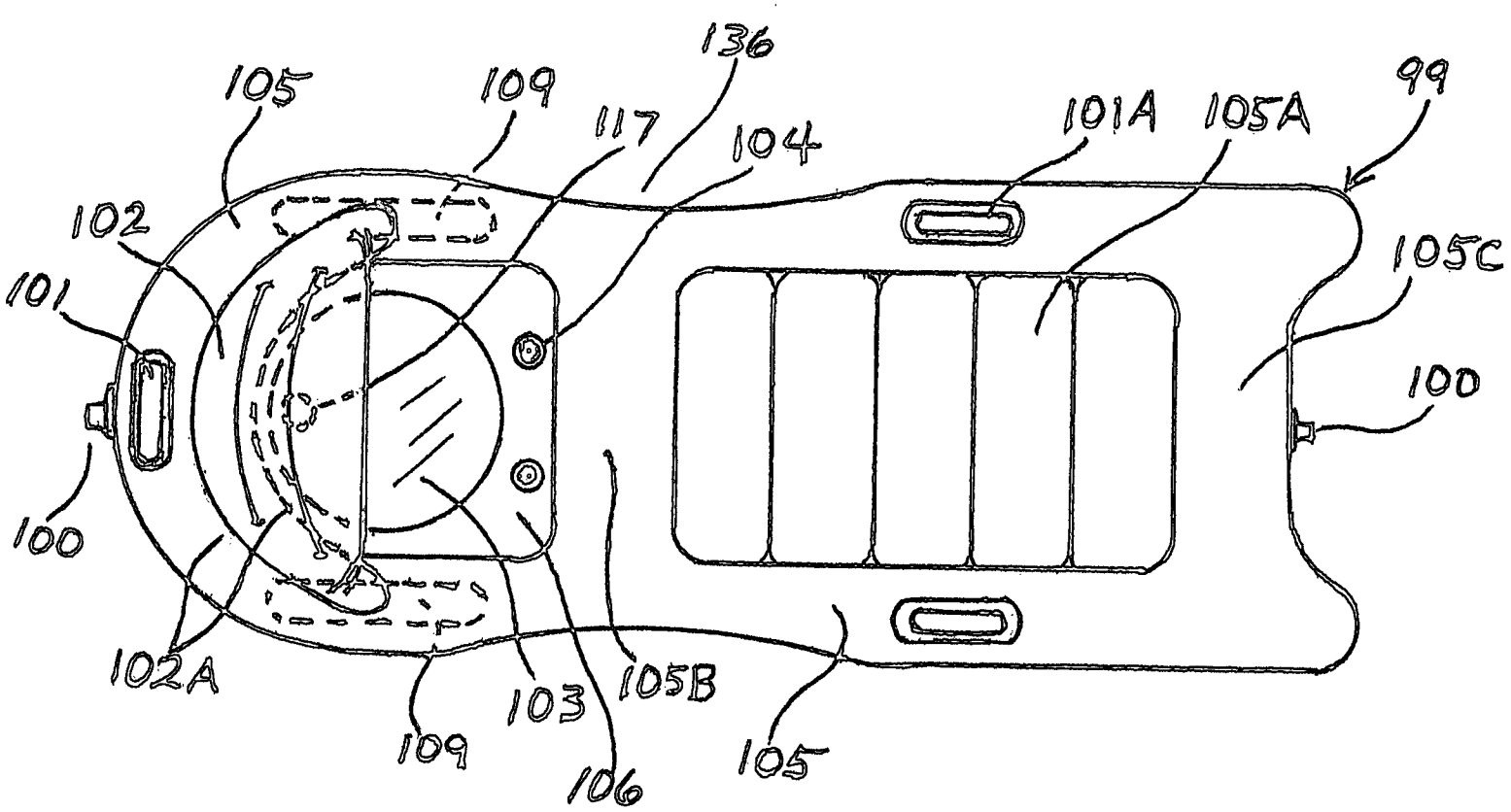
FIG. 3 is a top isometric view of craft 99

FIG. 3 shows a top view of said craft 99 partially isometric. Seen are attachment points 102A of said pillow 102 to a craft. Illustrating said pillow's 102 constructed in a semi-circle, cup-like shape forming a space between the undersides of said pillow 102 and said top clear lens 103. Also shown are said stand offs 109 which protects said bottom clear lens 103A from scratches. Said air cross overs are forward 105B and aft 105C in conjunction with said outboard air chamber 105 encapsulating said inboard lateral air chamber. Closeable vent 117 for the ingress and regress of a fluid, such as water, is show.

Figure 4:
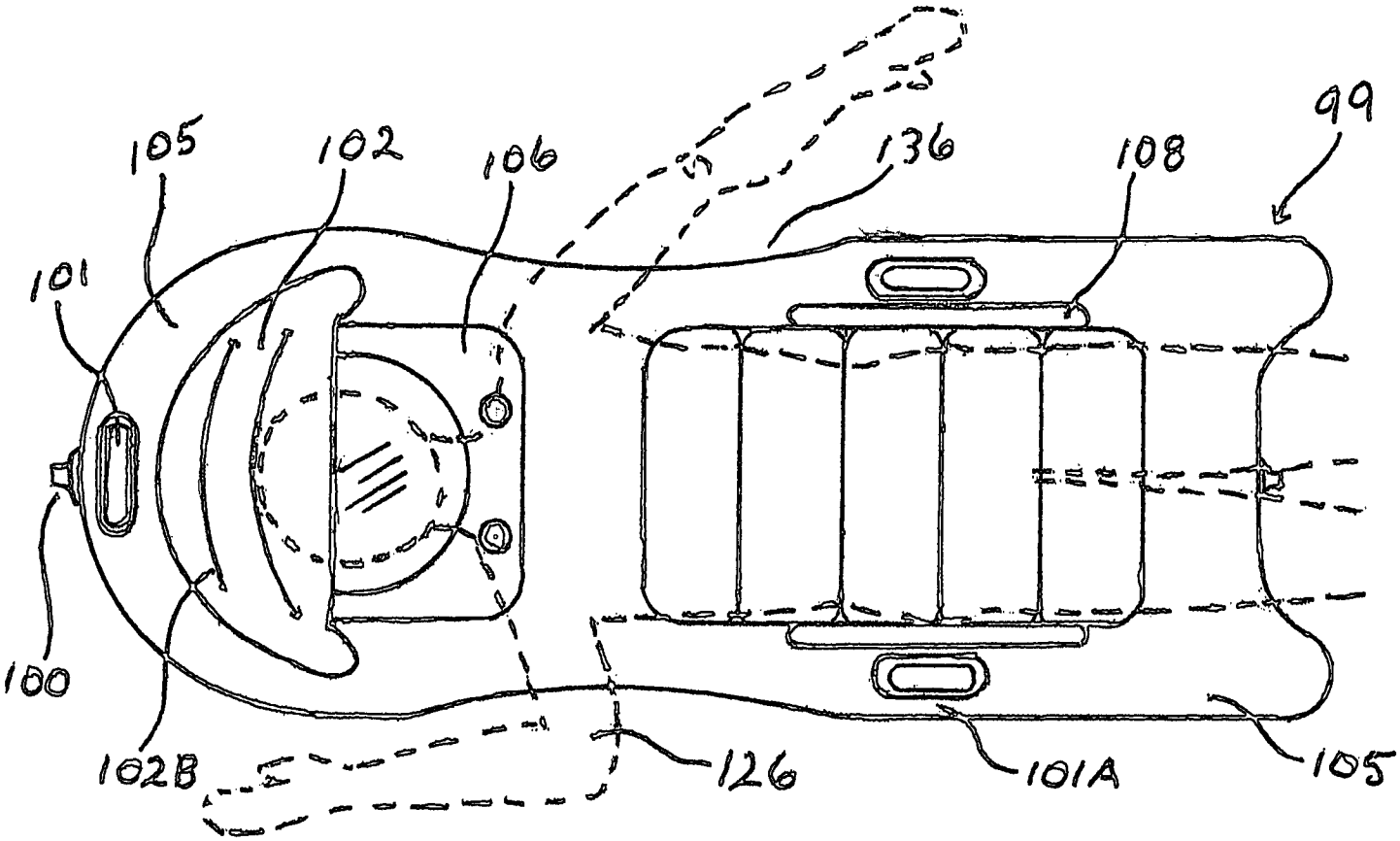
FIG. 4 is a top view of craft with user

FIG. 4 is a top view of said craft 99 showing a user 126 upon said craft 99. Note that said users 126 legs are going down slightly into the water from the weight and height of user 126, tilting said craft 99 down at the stern. This allows the use fins for propulsion. Shown also, is the user paddling said craft 99. Note said side recesses 136 and how they allow the arms to easily reach the water and move freely. On this drawing one can see boarding guides 108 to either side of said users 126 hips. Said boarding guides 108 are of a predetermined length, height and width to guide a person to the center of a craft by acting as feelers.

Figure 5:
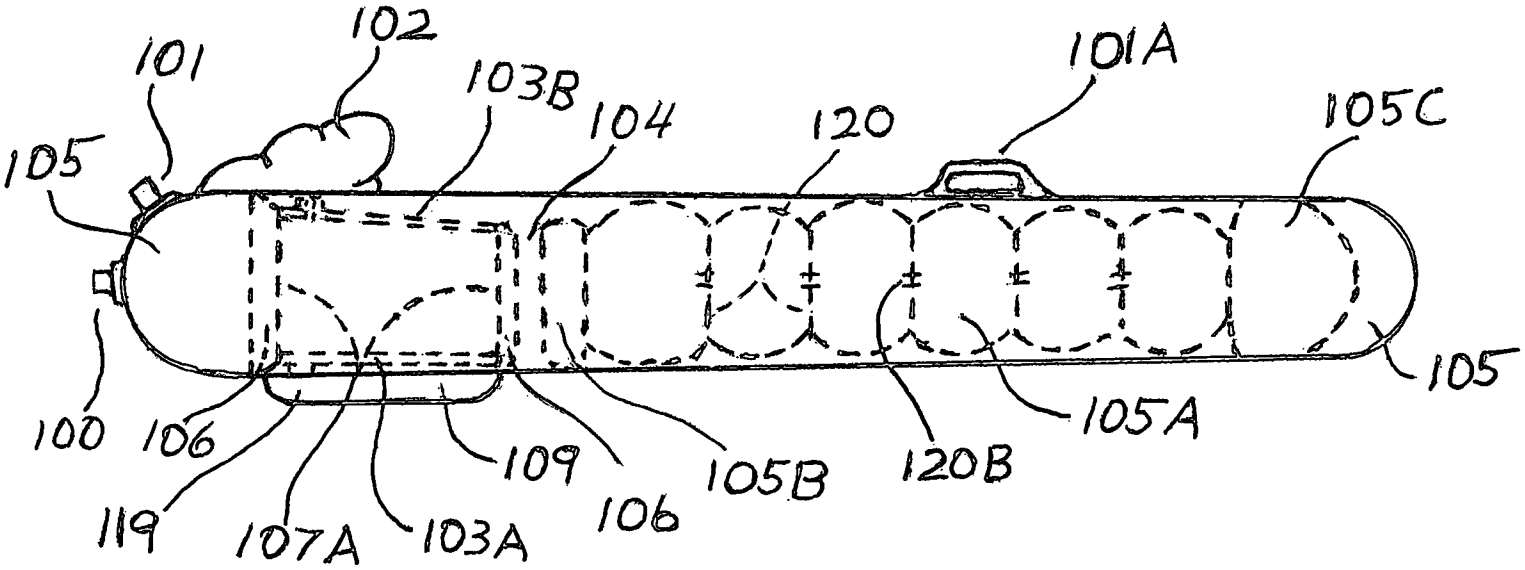
FIG. 5 is a side isometric view of craft 99

FIG. 5 is side isometric view of said craft 99 showing a slanted upper clear lens 103B for quicker removal of extraneous water installed on said PVC craft 99. Said scuppers 104 receive that water and remove it from said top lens 103B. Viewing port cavity walls 107A being within said viewing area air chamber 106. Said crossover air chambers 105C and 105B, are also shown. Said Inboard lateral air chamber 105A, I-beams 120 show how craft 99 gets its shape. Also note holes 120B through I-beams 120 they allow said inboard lateral air chamber 105A to inflate as one.

Figure 6:
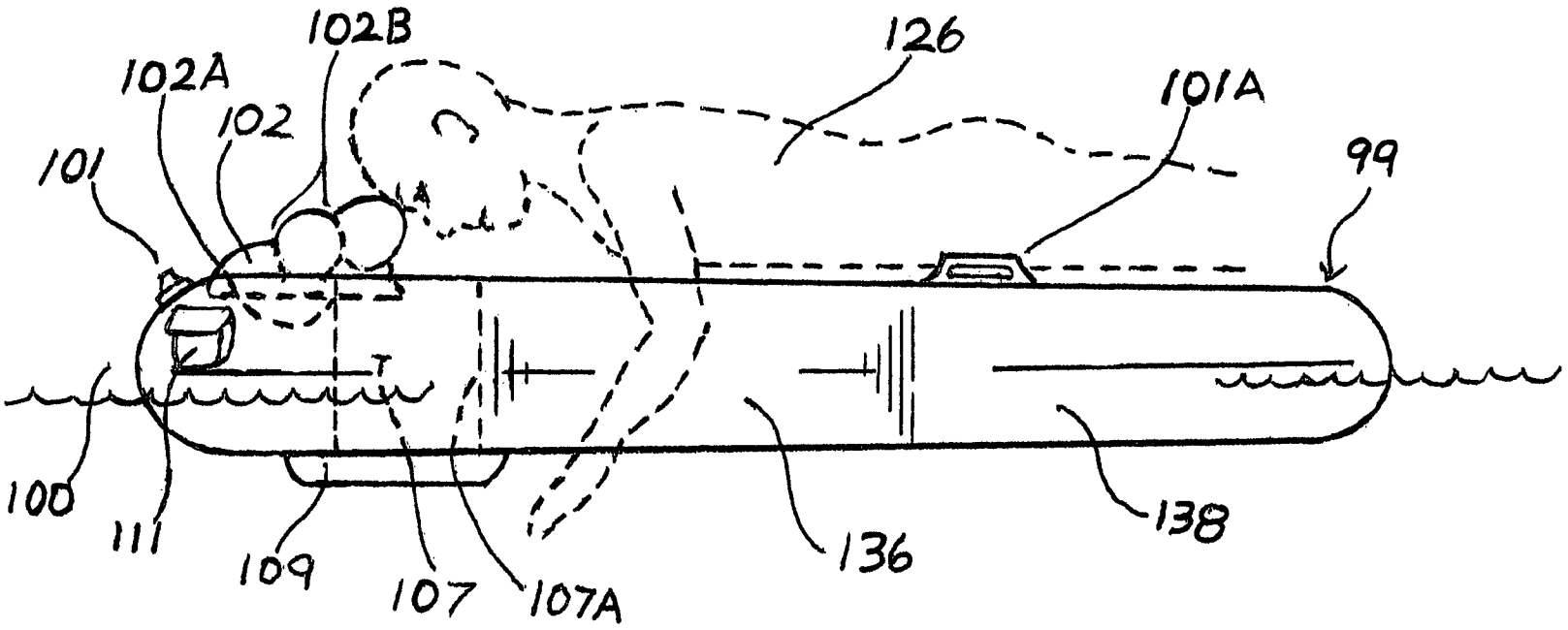
FIG. 6 is a side view of craft 99

FIG. 6 is a side isometric view of said craft 99 with said user 126. Looking at the drawing one can see said recessed sides 136 which offer the user absolute freedom of movement for their arms. A waterproof pouch of PVC 111 is for holding money, room keys passports or jewelry. Here said pillow 102 and said I-beams 102B show how they form said pillow 102. The bottom half or hull of said craft 99 is of a heavier gauge PVC 138. This adds extra support around a water filled said viewing port cavity 107, beyond any type of lens reinforcement. Furthermore, said heavier gauge PVC 138, adds more puncture resistance to the bottom half of said craft 99. Also shown here are said mid ship handles 101A, said tow eye 100, said bow handle 101 and viewing port cavity walls 107A.

Figure 7:
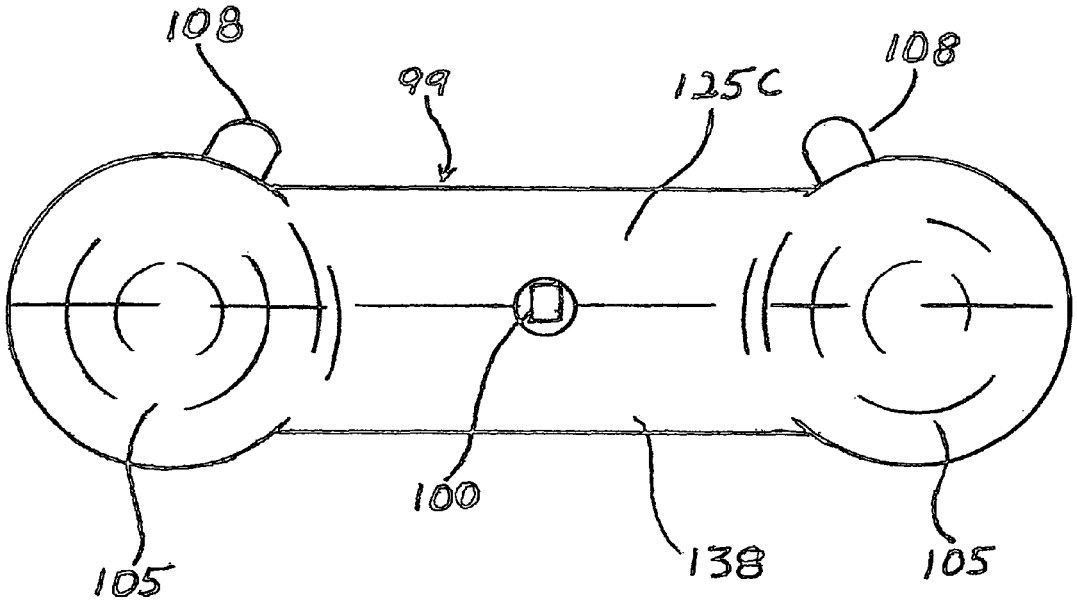
FIG. 7 is a stern view of craft 99

FIG. 7 shows a stern view of said craft 99. You can see said heavier gauge PVC 138 on the bottom half of said craft 99. Said outboard air chamber 105 is also shown. This view gives a good idea about the placement of said boarding guides 108. Said aft air cross over 105C and said towing eye 100 are shown.

Figure 8:
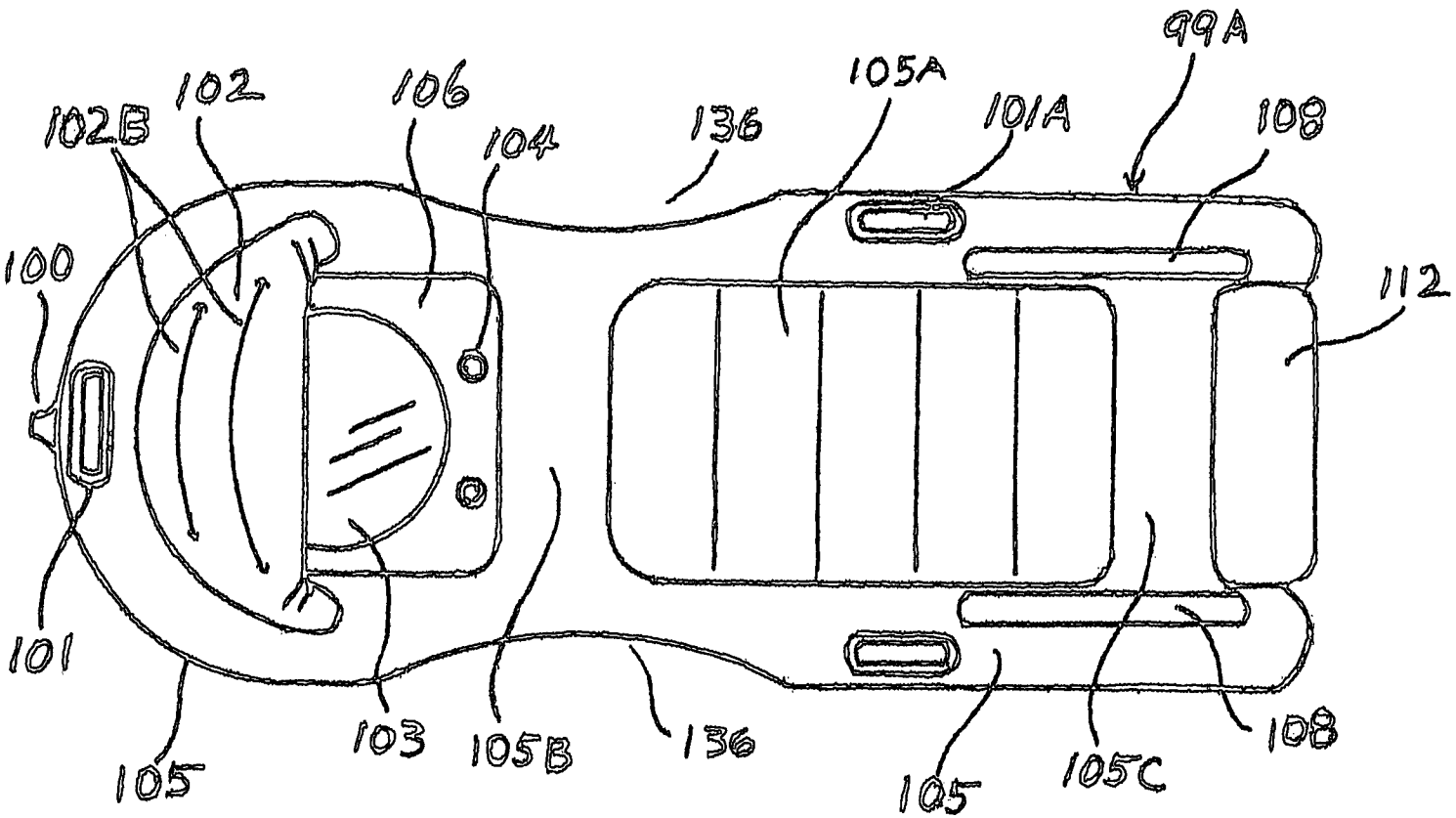
FIG. 8 is a top view of craft 99A with square stern

FIG. 8 is a top view of said craft 99A. It has all the embodiments that have been covered. The one different feature is a length adjustable stern air chamber 112. Said air chamber 112 is an addition to said craft 99 as a separate air chamber. Said chamber 112 could be multiple, allowing the length of said craft 99A to be lengthened or shortened to accommodate a plurality of users.

Figure 9:
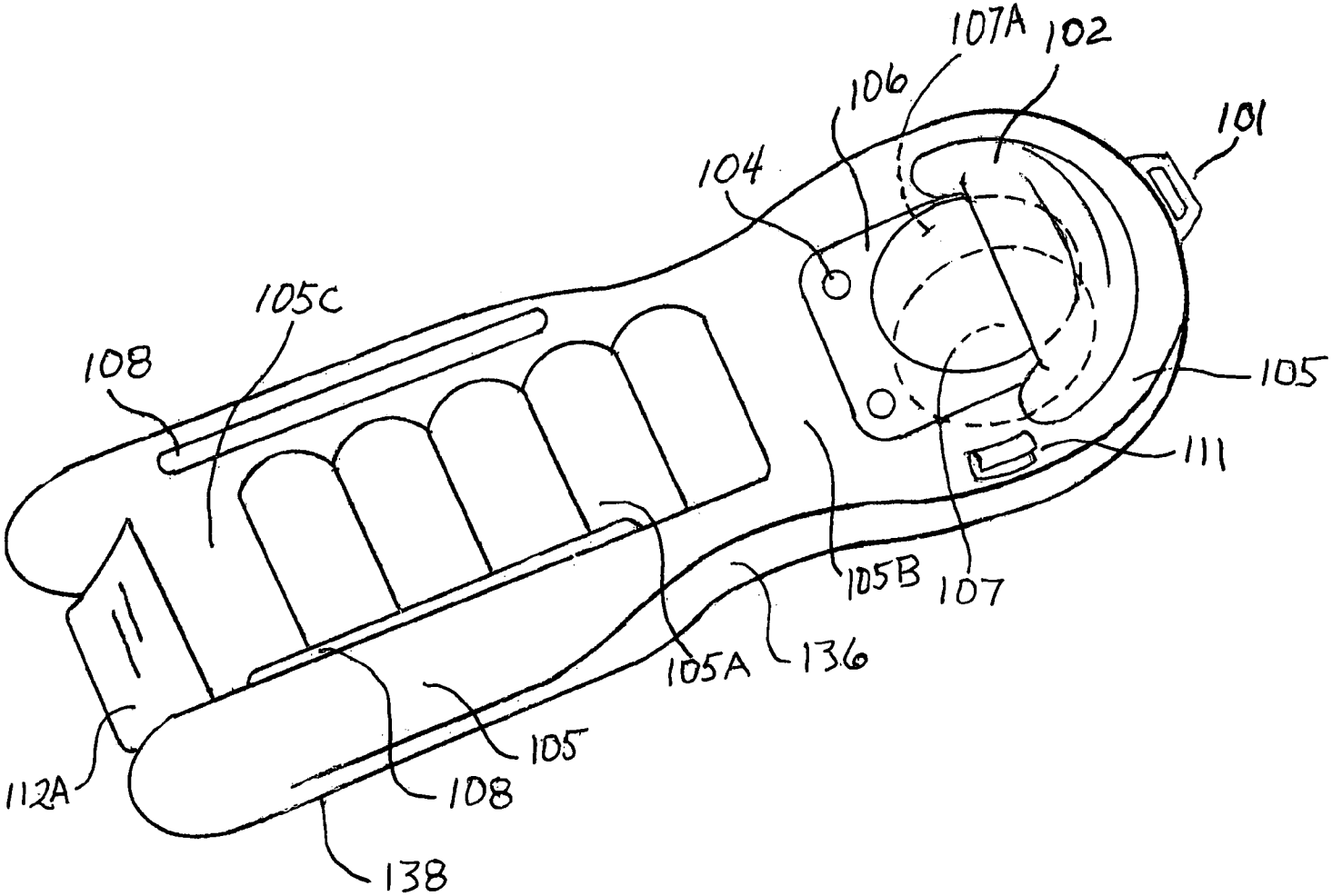
FIG. 9 is a perspective view of craft 99A

FIG. 9 is a perspective view of craft 99A showing said viewing area 106, said walled cavity 107. Also, said length adjustable stern air chamber 112A deflated. Said water pouch of PVC 111 is shown along with said boarding guides 108 and said recessed sides 136. Again, said pouch of waterproof PVC 111 can be made to accommodate said passports, room keys, money, and jewelry. The isometric part of this drawing show said viewing port cavity 107 and said viewing port cavity walls 107A. Said upper clear lens 103 is shown. Also, shown is said outboard air chamber 105, with said inboard lateral air chamber 105A, said air cross-overs 105C, 105B and said boarding guides 108 in place.

Figure 10:
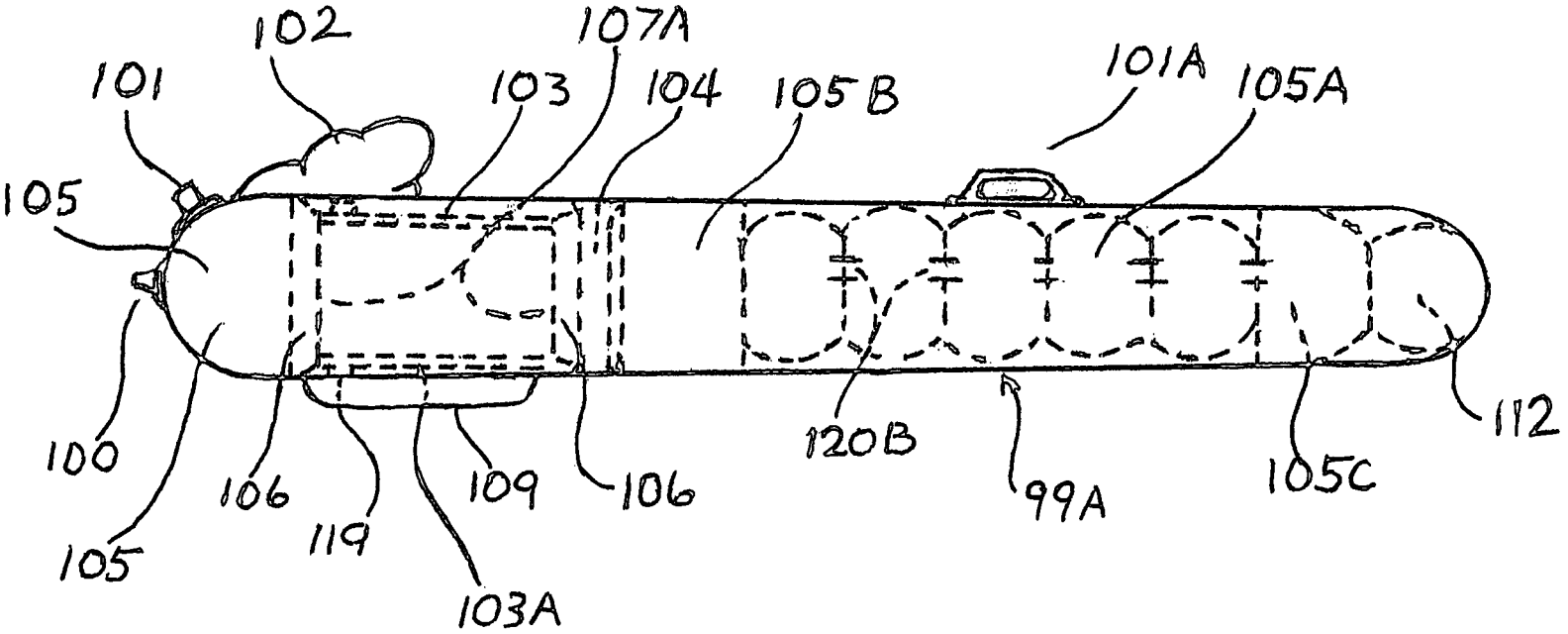

FIG. 10 is an isometric side view of said craft 99A. Again you can see said length adjustable stern air chamber 112 is inflated. Said Inboard lateral air chamber 105A is shown with said holes 120B through said I-beams 120. Walls of said viewing port cavity 107A are depicted with upper most, said clear lens 103 and said bottom clear lens 103A. A separate air chamber constitutes said viewing area 106 can be seen that not only provides separate air chamber buoyancy but protects said viewing port cavity 107. Said scuppers 104 and said air cross overs 105B and 105C are also depicted.

Figure 11:
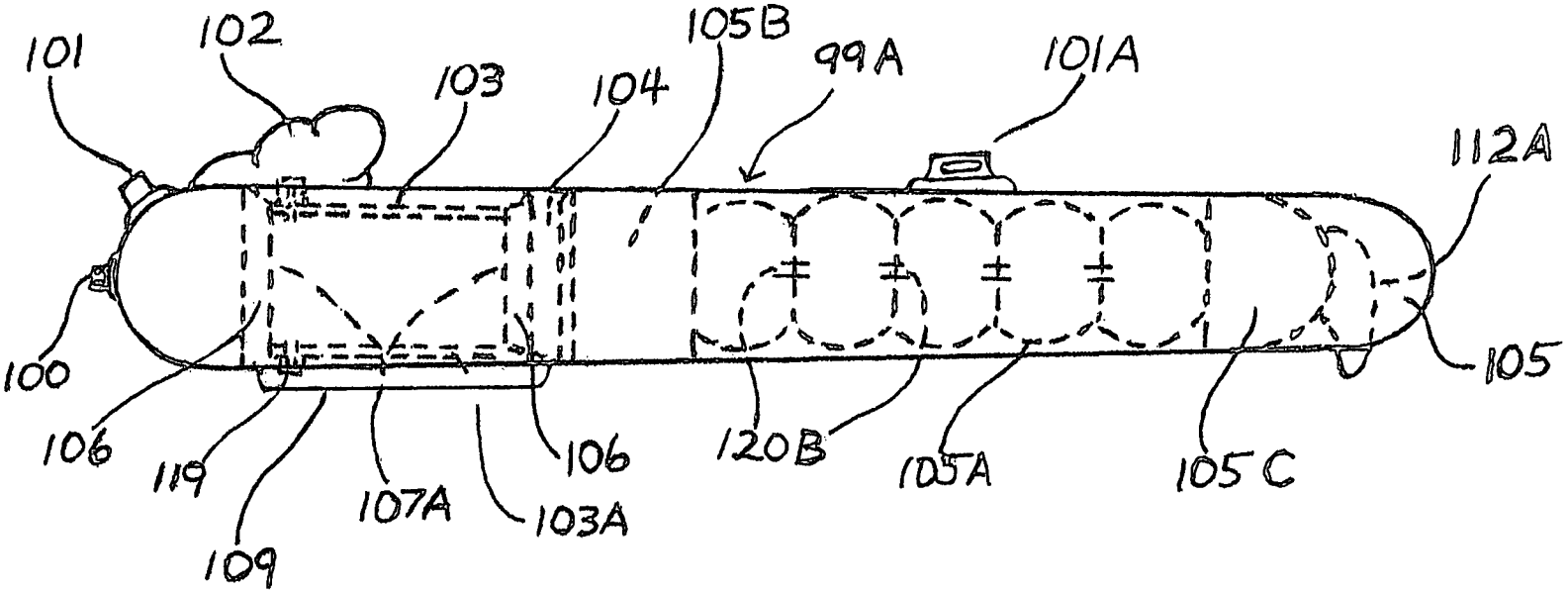
FIG. 11 is a side isometric view of craft

FIG. 11 is an isometric side view of said craft 99A showing said length adjustable stern air chamber 112A deflated. Along with said inboard lateral air chamber 105A in conjunction with, sandwiching, said outboard air chamber 105, said air cross overs 105B and 105C encapsulating said inboard lateral air chamber 105A. Also shown, said viewing cavity walls 107A, said stand offs 109, large vacuum release vent 119, said bow handle 101, said tow eye 100, said scuppers 104, top and bottom said lenses 103, 103A, and said viewing area air chamber 106.

Figure 12:
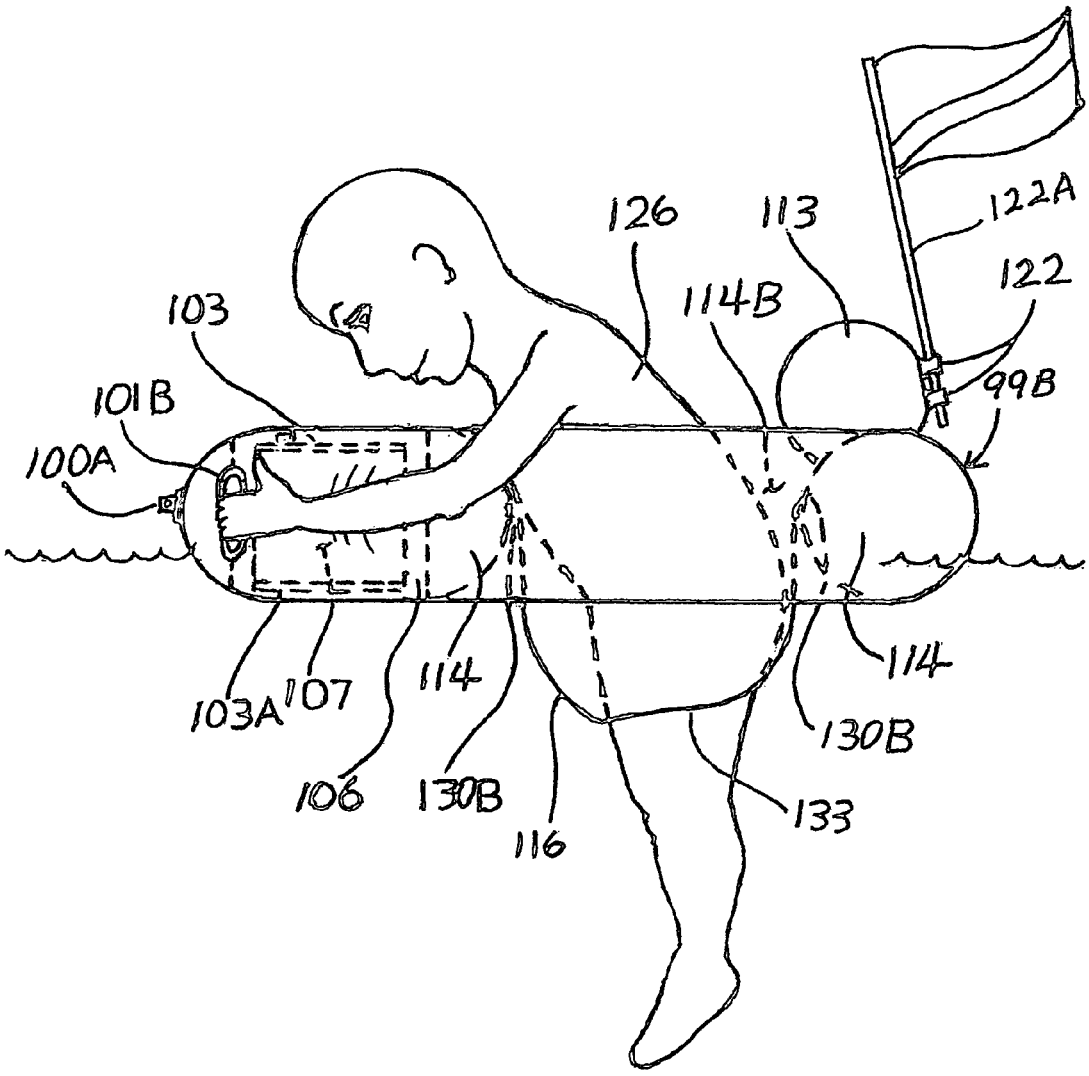

FIG. 12 is a side isometric view of craft 99B, a craft for babies six months to two years of age, approximately. This exemplifies a fixed PVC seat 116. Said viewing area 106 air chamber, with an integral underwater viewing window installed, is a separated air chamber. The main air chamber is donut shaped air chamber 114 with somewhat centrally disposed seating cavity 114B. Said viewing port walled cavity 107, with said top clear lens 103 and a bottom lens 103A. Shown also are sonic welds 130B location for a fixed said PVC seats 116, along with back brace 113. Plus flag pole mount 122, with flag 122A which is not really needed, in a pool, but fun for the kids. Said child user 126 has forward handles 101B gripped. Said handles add some security if a child is a bit afraid of the water. Said viewing port cavity 107 is positioned close to said user 126 to avoid having to lean over to much to be able to see below the water. Said craft 99B will also act as a swimming aid to prepare children for swimming lessons, in that the child will be able to reach the water to paddle. The lanyard attachment 100A keeps baby from drifting away.

Figure 13:
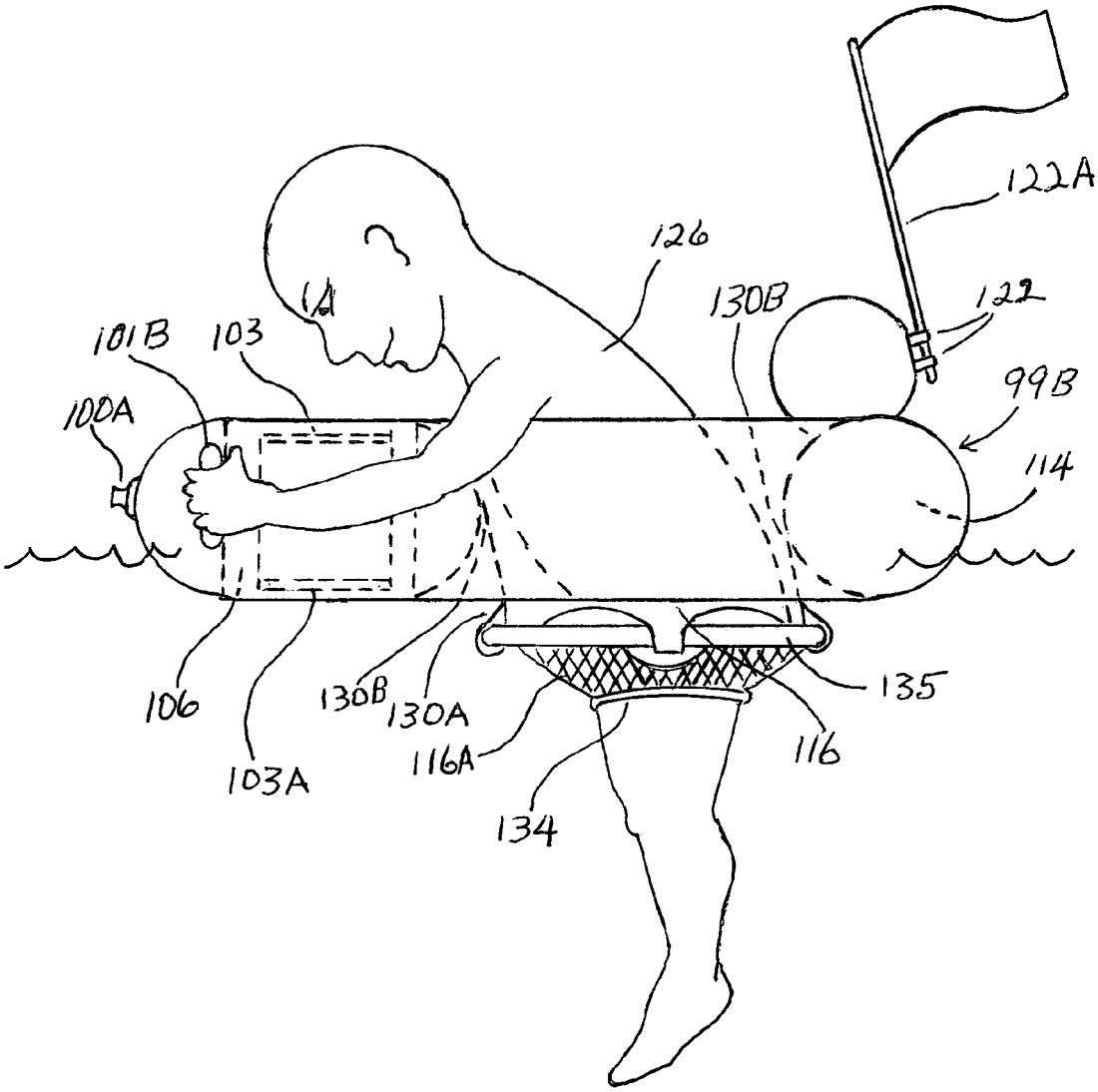
FIG. 13 is a side isometric view of child craft 99B

FIG. 13 here shown, on craft 99B, is fixed fabric seat 116A, of any number of materials, with a PVC 116A suspension holding or securing said fabric seat and PVC suspension 116A. This is said fixed seat model 116A, seen here are looped and sonic welded 130A sections of where said 116A PVC suspension assembly attaches to said fabric seat. Also here is a seat anti-compression solid ring 135 which keeps said seat assembly 116A from clinging tightly around a child. Shown again said flag pole mount 122 and flag 122A attached to said back brace 113. The attachment of said PVC to fabric seat assembly 116A is by the PVC being said looped around and sonic welded 130A to said anti-compression ring 135 which is attached to said fabric seat 116A. Said sonic welds 130B are depicted at PVC attachments to said craft 99B. Also shown, are hemmed and padded leg holes 134 which are a plus for baby's comfort. Also shown are said top and bottom clear lenses 103 and 103A, said child handles 101B, said viewing area air chamber 106 and said lanyard attachment 100A.

Figure 14:
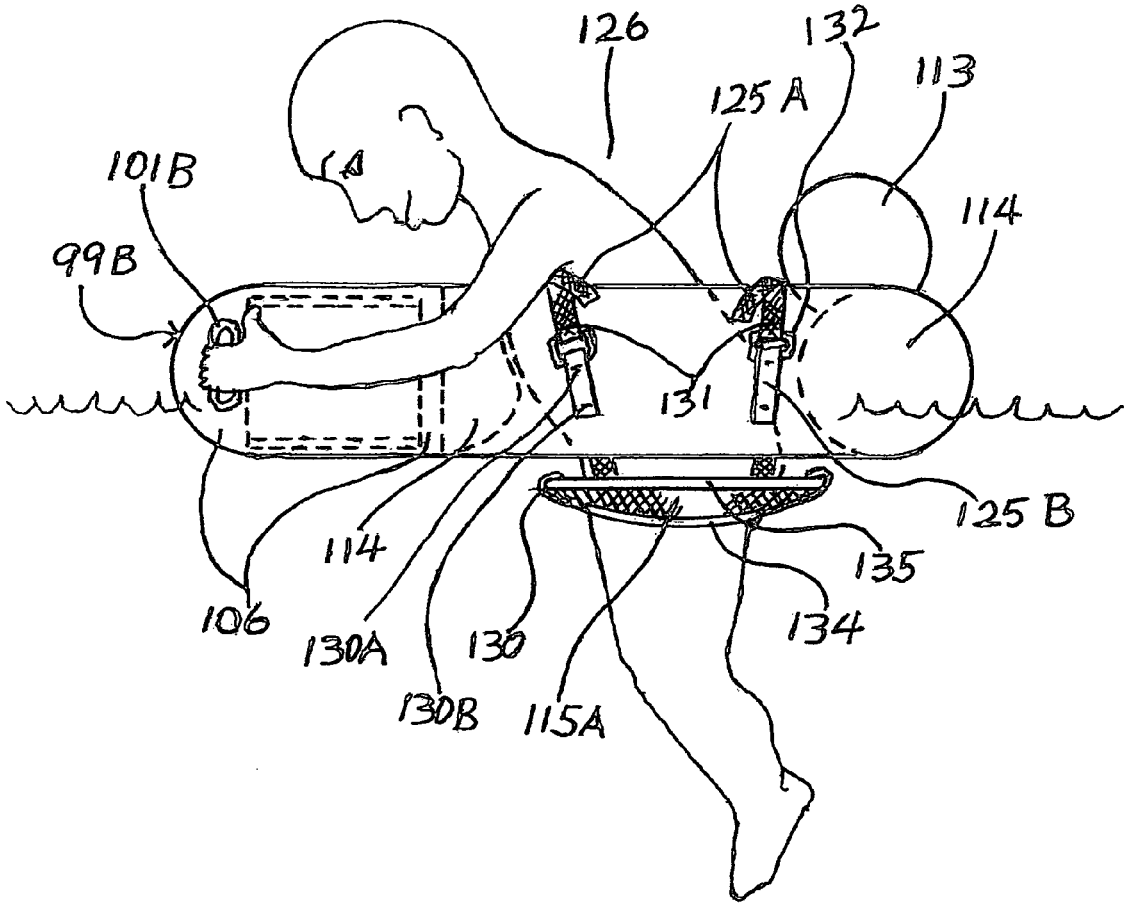
FIG. 14 is a side isometric view of craft 99B with adjustable fabric seat

FIG. 14 is an adjustable height fabric seat is featured for said craft 99B. The assembly constitutes a seat 115A, said anti-compression solid ring 135 and said hemmed and padded leg holes 134 for comfort. Starting from outboard wall 127 of said craft 99B, one sees PVC straps 125B that are said sonic welded 130B to said outboard wall 127 of said craft 99B. Said sonic welds 130B and 130A are pointed out on said PVC straps 125B. Then said PVC straps 125B are connected by said looping around and sonic welding 130A to one end of transition fitting 132. Attached to the other end of said transition fitting 132 are adjusting said fabric straps 125A that go over said donut air chamber 114 and attaches, in an adjustable manner (not shown) to the inboard side 127A of said air chamber 114. The crafts with adjustable seating can accommodate a number of different aged children. Shorter kids go up and the taller kids go down. Said child handles 101B, said viewing area air chamber 106 and said back brace 113 are shown.

Figure 15:
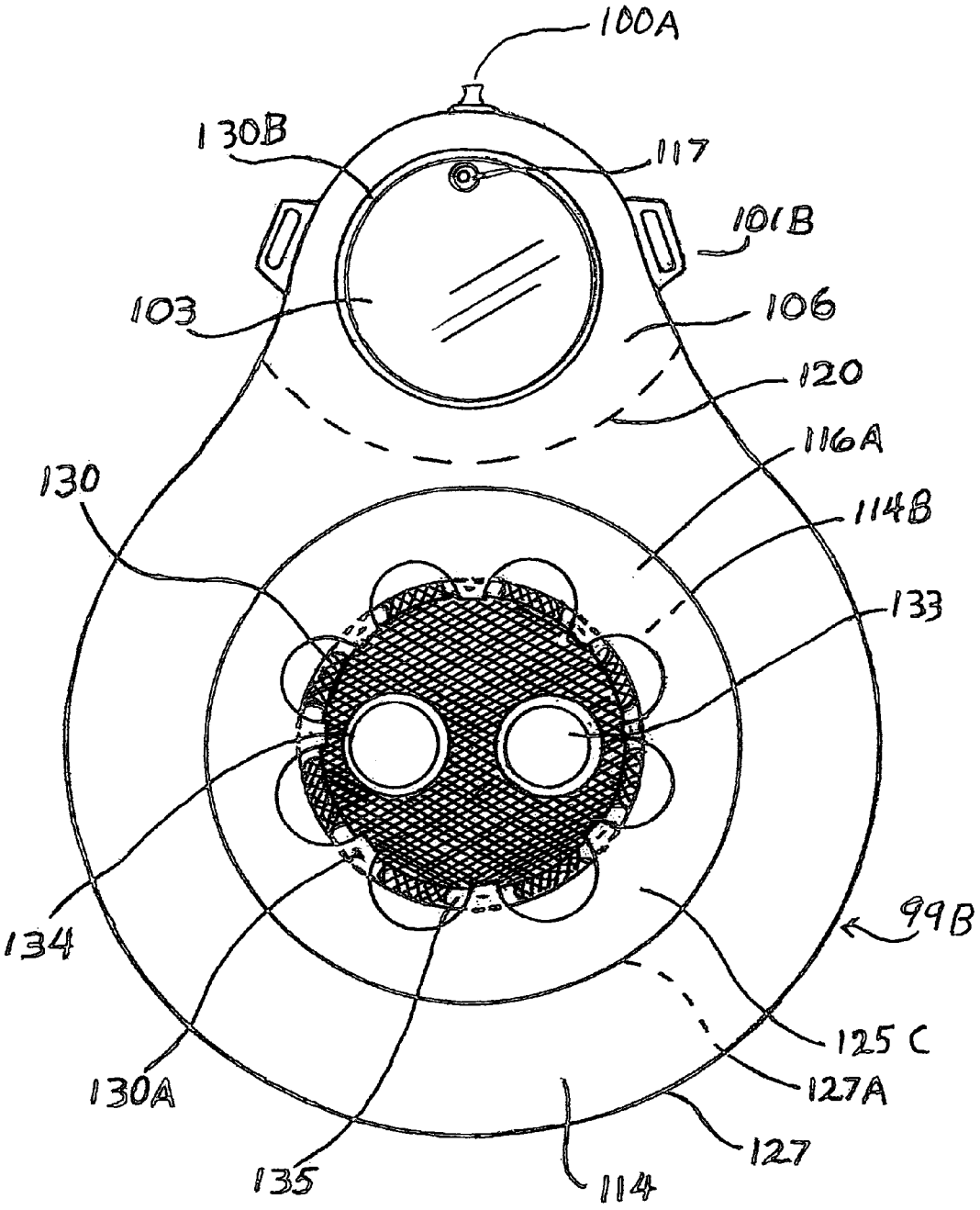
FIG. 15 is a top view of child craft with fixed fabric seat and PVC suspension

FIG. 15 is a top view of said craft 99B with fixed fabric seat and PVC suspension 116A. One can see said hemmed and padded leg holes 134 and said seat anti-compression solid ring 135 that would encircle said child. The attachment of said PVC 125C to said anti-compression ring 135 is said looped around and sonic welded 130A means of attachment. One can see said sonic weld 130B attachment of said PVC suspension 116A to said inboard wall 127A of said donut shaped air chamber 114. Also seen is the attachment of said fabric seat assembly 116A to said anti-compression ring 135 by a looped around and sewn 130 attachment. Here is a centrally disposed seating cavity 114B through craft. Leg holes 133 are made comfortable by said hemming and padding 134. Now said viewing area 106 is a separate air chamber around said viewing port cavity 107, being sealed water tight, with said top clear lens 103 and (not shown) said bottom clear lens 103A being sonic welded 130B to said viewing port walled cavity 107 creating an integral viewing assembly. There is said top vent 117 shown said sonic welded 130B to said top clear lens 103 for the ingress and regress of water. Separating said I-beam 120 makes said viewing area 106 a separate air chamber for added protection as backup buoyancy. Note how said viewing area 106 protrusion slopes inwardly or narrows, this allows a child to put their hands in the water making said craft 99B a precursor to swimming lessons. There is located on the bow said lanyard attachment 100A. This allows said craft 99B, to be towed by a parent of the child when on a beach vacation in the protected waters of a resort and not drift away. The excitement said craft 99B will bring to children is going to be overwhelming, especially for handicapped children.

Figure 16:
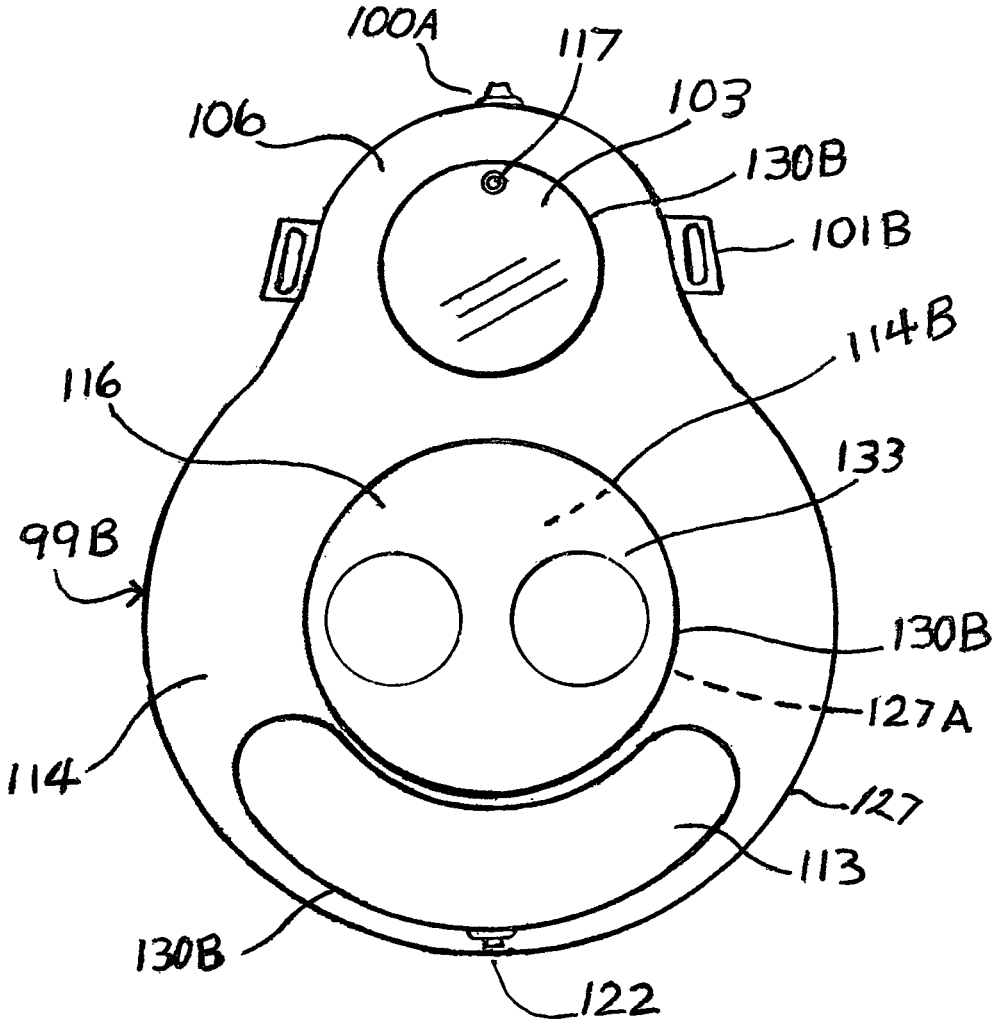
FIG. 16 shows a top view of child craft 99B with fixed PVC seat

FIG. 16 is a simple top view of said craft 99B with said fixed PVC seat 116. Said craft 99B is said donut shaped air chamber 114 with a centrally disposed said seating cavity 114B. Said back brace 113 is depicted along with said flag pole mount 122. Said lanyard attachment 100A and said viewing area air chamber 106. Said top vent 117 for the ingress and regress of a fluid, preferably water, is clearly shown, along with said top clear lens 103. Said inside wall 127A and said outside wall 127 of said donut shaped air chamber 114 are shown with the said PVC seating area 116 said sonic welded 130B to said inboard wall 127A of the said seating cavity 114B through craft 114. Shown also, said handles 101B that will give the child a more secure feeling.

Figure 17:
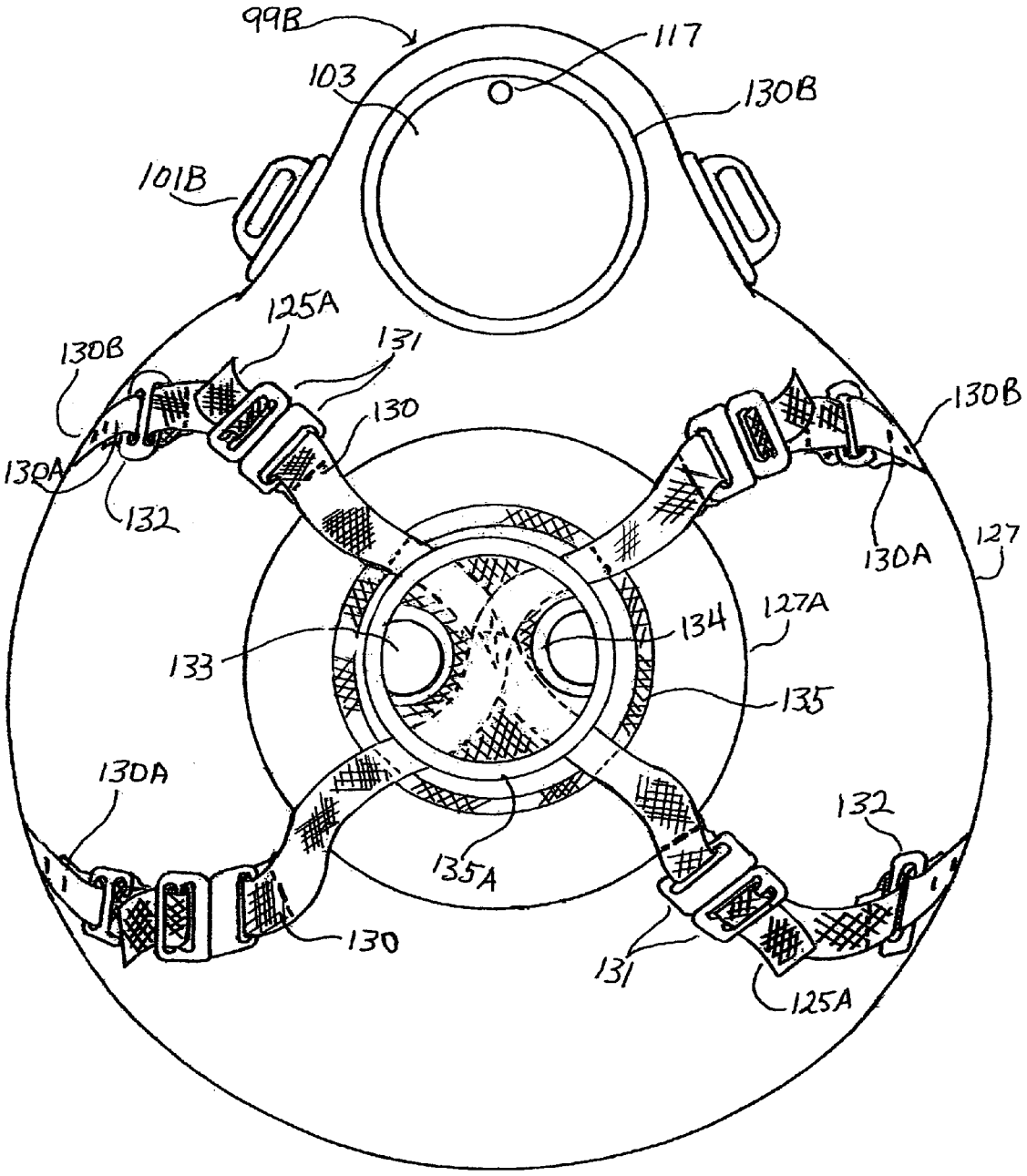
FIG. 17 is a top view of a height adjustment assembly for fabric seat

FIG. 17 is a top view of adjustable fabric seat 115A. The assembly starts from outboard, with said PVC straps 125B said sonic welded 130B to said craft 99B outboard above water level. The upper end of said PVC straps 125B are said looped around and sonic welded 130A, to said transition fitting 132. To the other end of said transition fitting 132 are said adjustable fabric straps 125A that are attached to said transition fitting 133 by a looped around and sewn 130 means. Said fabric strap 125A comes up to an upper end of said two part clasp 131, where said clasp 131 is shown snapped together. Said clasp 131 has an end that allows said fabric straps 125A to attach, in a manner, whereby said straps 125A can be adjusted. Attached, said looped around and sewn 130, to the lower end of said two part clasp 131 are fabric straps 125 moving downward to said fabric seat 115A and are shown passing under said seat 115A and crossing one another. This is but one way to contend with said fabric straps 125. Said fabric straps 125 (not shown), could be attached directly to said inter anti-compression ring 135A. One can see said hemmed and padded leg holes 134 and said anti-compression solid ring 135.

Figure 17A:
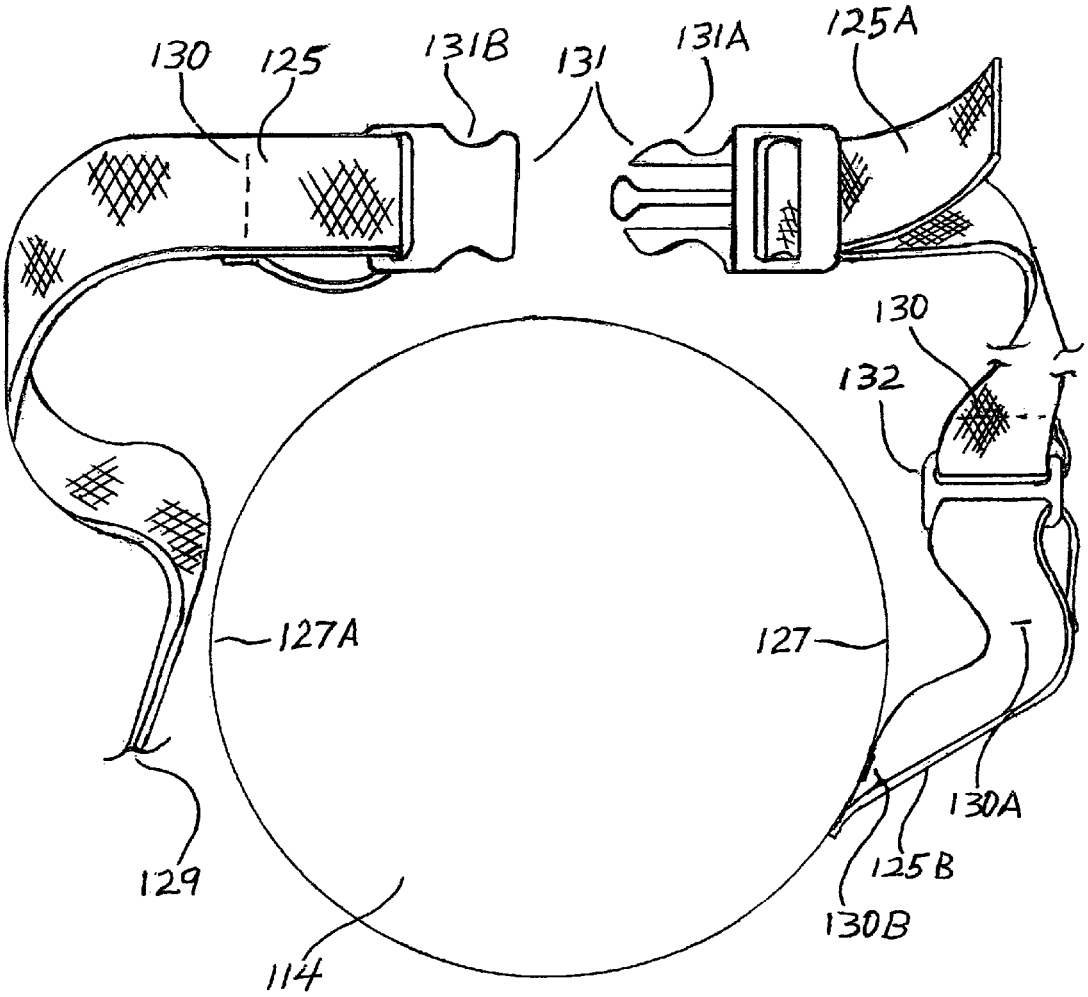
FIG. 17A shows a detail of a height adjustment harness for fabric seat

FIG. 17A shows a detail of said height adjustment harness for said fabric seat 115A. One can see the said donut shaped out-board air chamber 114 and said outboard wall 127 of said air chamber 114 and said inside wall 127A of said air chamber 114. Starting said outboard 127, said PVC strap 125B is sonic welded 130B to said outboard side wall 127 of said craft 99B. Said PVC straps 125B come up to said transition fitting 132. Said PVC strap 125B is attached, by said looping around and sonic welded 130A to lower end of said transition fitting 132, thus said strap 125B is attached. Now said transition to said fabric straps 125A, for adjusting, begins with said looped around and sewn 130 attachment of said fabric strap 125A to other end of said transition fitting 132. This said adjusting fabric strap 125A goes to said male end 131A of said two part clasp 131. This clasp's said male end 131A is designed for said fabric strap 125A to be woven through the end of said clasp 131A in a manner to allow said fabric strap 125A, to be adjusted up or down. Continuing, said fabric strap 125 is attached, by said looped around and sewn 130 to end of said female end 131B of said two part clasp 131. Said fabric strap 125 precedes downward 129, to be connected to said fabric seat 115A (not shown).

Figure 18:
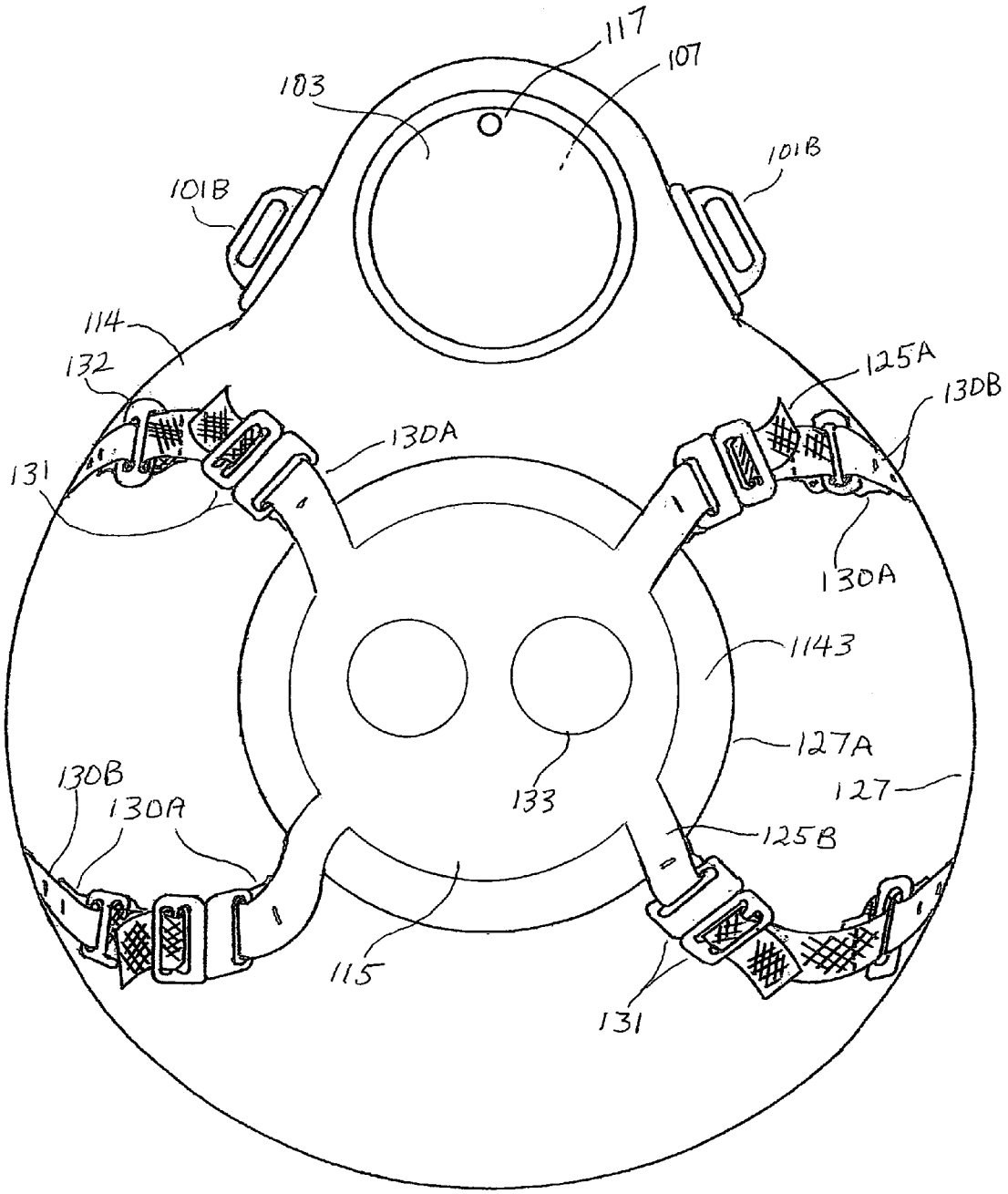
FIG. 18 is a top view of height adjustment assembly for PVC seat

FIG. 18 showing a top view of said craft 99B with adjustable said PVC seat 115. The assembly begins where outboard said PVC straps 125B are said sonic welded 130B to said outside wall 127 of said donut shaped air chamber 114. The other end of said PVC strap 125B comes up to said transition fitting 132 and attached by said looped around and sonic weld 130A means. Next, at the other end of said transition fitting 132 is attached said fabric straps 125 by said looped around and sewn 130 means. Said adjusting fabric strap 125A continues up and over said donut shaped air chamber 114 to one end of said two part clasps 131 in a manner that allows up and down adjustments of said PVC seat 115. Said PVC straps 125B are an integral part of said adjustable PVC seat 115. Said PVC seat 115, being height adjustable, can adapted to a variety of kid sizes.

Figure 18A:
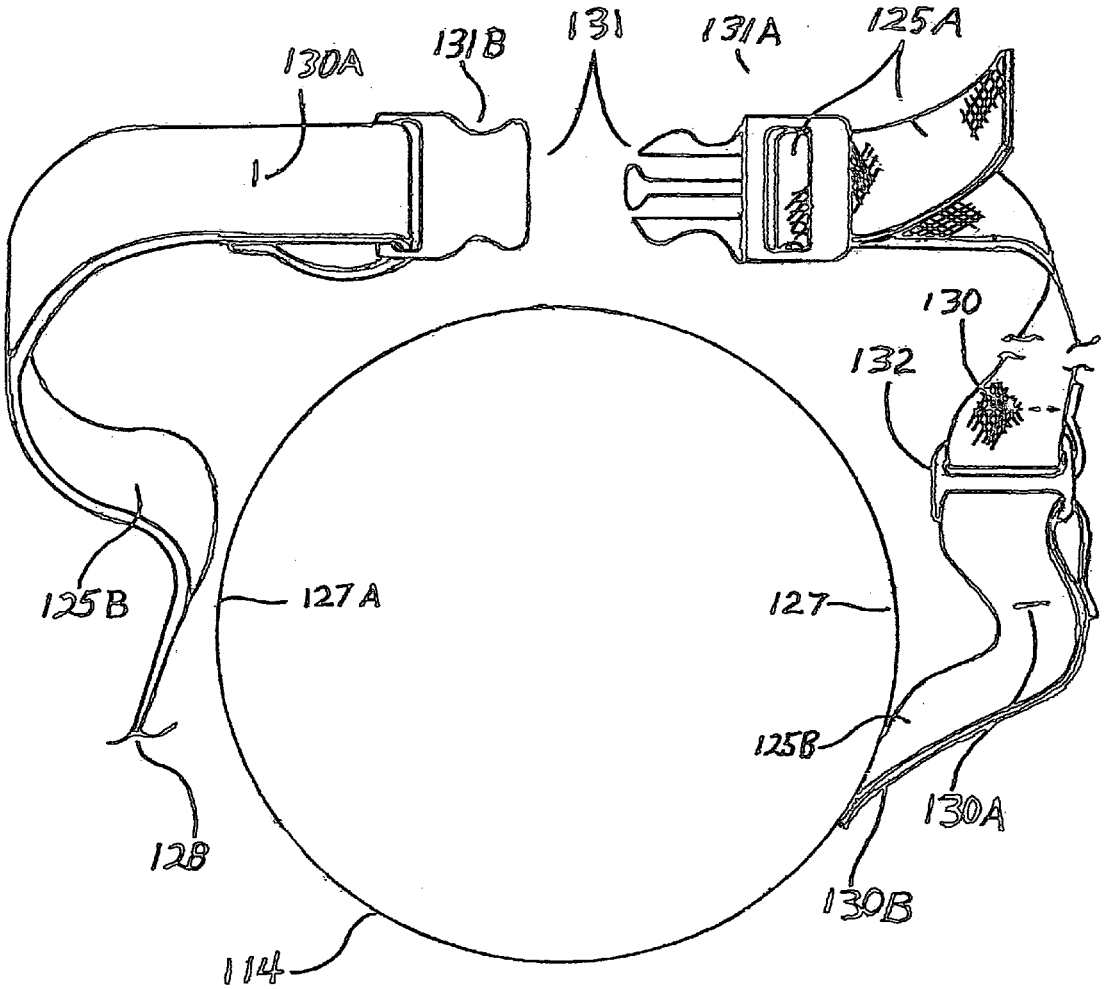
FIG. 18A shows a detail of height adjustment harness for PVC seat

FIG. 18A is a detail of a height adjustment harness for said PVC seat 115 showing the parts and assembly. Again starting from said out-board air chamber wall 127 of said donut shaped air chamber 114, there said PVC strap 125B that is said sonic welded 130B to said craft 99B said outboard sides 127. The other end of said PVC straps 125B rises up and attaches to the lower end of said transition fittings 132 by means of said looped around and sonic welded 130A. On the other end of said transition fitting 132, said fabric strap 125A is attached by said looped around and sewn 130 manner. Then said fabric strap 125A comes up to said male end 131A of said two part clasp 131 and connects to said male end of clasp 131A in the proper manner allowing height adjustments of said PVC seat 115 (not shown). To said female end 131B of the said two part clasp 131 is attached to said PVC strap 125B, by said looped around and sonic welded means 130A. Said PVC strap 125B is shown descending to said PVC seat 128 and is an integral part of said PVC strap 125B.

Figure 19:
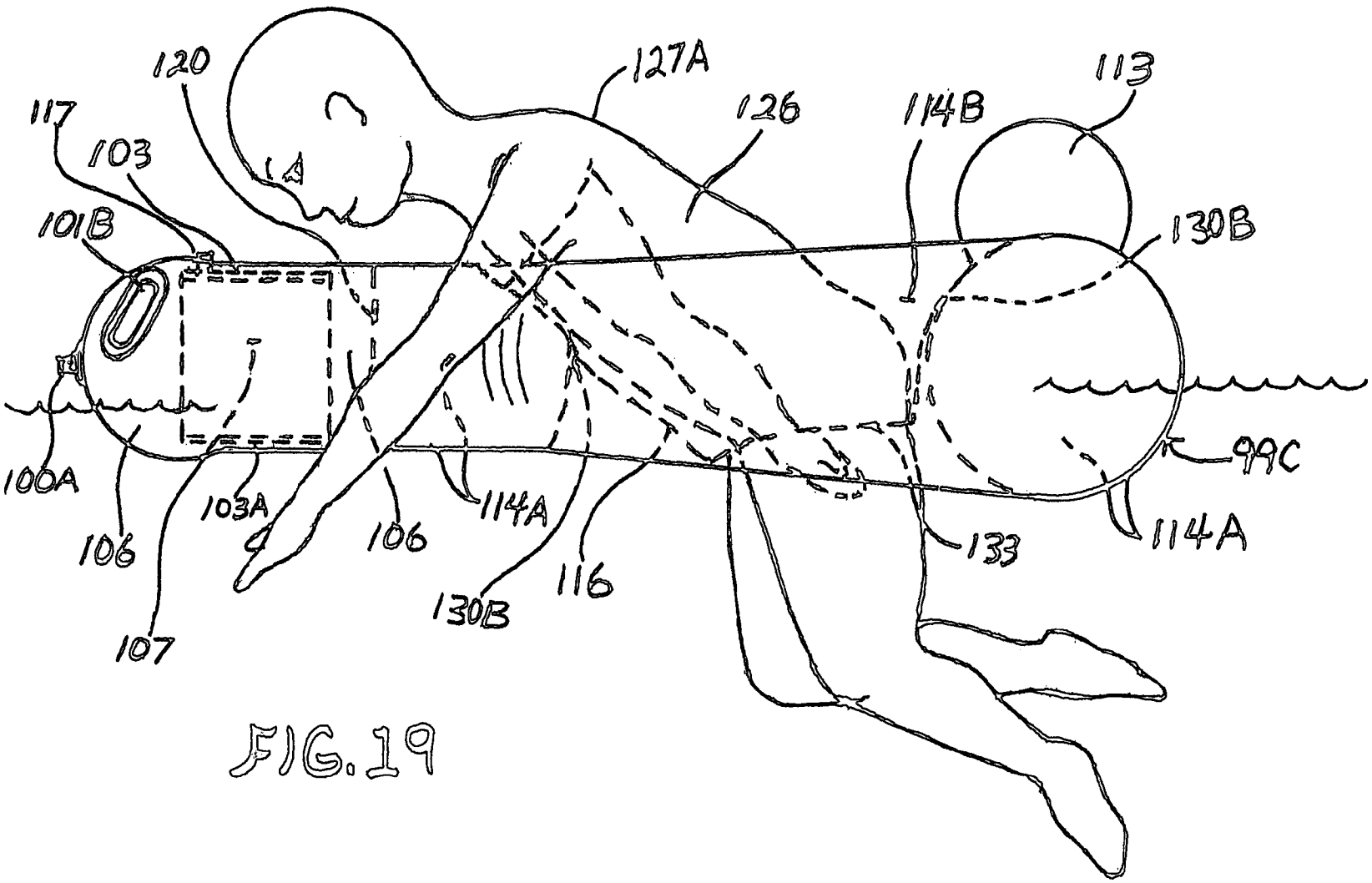
FIG. 19 is a side isometric view of child craft 99C

FIG. 19 shows a side, isometric view of craft 99C. This craft is for older children from approximately two years of age to 4 or 5 years of age. Said Craft 99C consist of an elongated main air chamber 114B, with elongated seating cavity 114B disposed aft. There is said back brace 113 attached to the stern of said elongated main air chamber 114A, and said child user 126. Said I-beam 120 creates a separate said viewing area 106 air chamber. One can see said fixed PVC seat 116, said sonic welded 130B in place, and how, with said elongated seating cavity 114B, a child can lean forward in a more swimming position to see through the said viewing port cavity 107. Said child 126 is shown leaning forward, placing the chest against said inside wall 127A of said elongate seating cavity 114B, that supports the said child's upper body, allowing said child 126 to view through said viewing port 107. Said craft 99C offers said handles 101B that would allow further body support and security. Said lanyard attachment 100A is again present which allows for towing. Again shown are said back brace 113, and said viewing area air chamber 106. Along with said top and bottom lenses 103, 193A and said top closeable vent 117.

Figure 20:
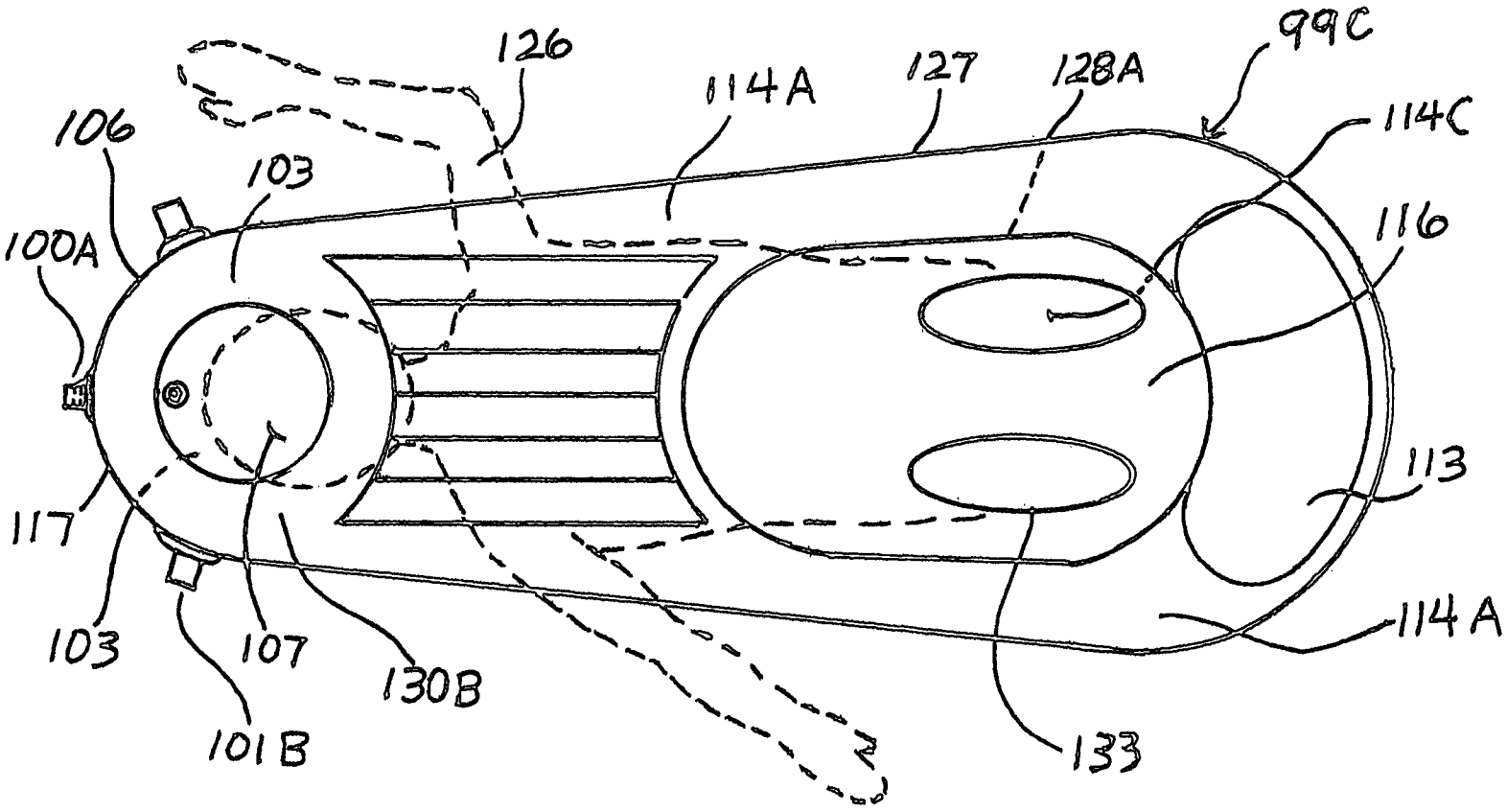
FIG. 20 shows a top view of child craft 99C with user

FIG. 20 is a top view of said craft 99C showing said user 126 lying, somewhat prone and paddling with his arms. The forward said handles 101B are shown along with said top clear lens 103 and said top vent 117. One can see how the said craft 99C allows a child to lean forward and propel said craft 99C in a swimming motion. This is said fixed PVC seat 116 that resides in said elongated main air chamber 114A with said elongated seating cavity 114B. Said inside wall 127A of said elongated main air chamber 114A is depicted with fixed said PVC seat 116. Said craft 99C also possesses said back brace 113 for comfort and safety, said lanyard attachment 100A and said handles 101B.

Figure 21:
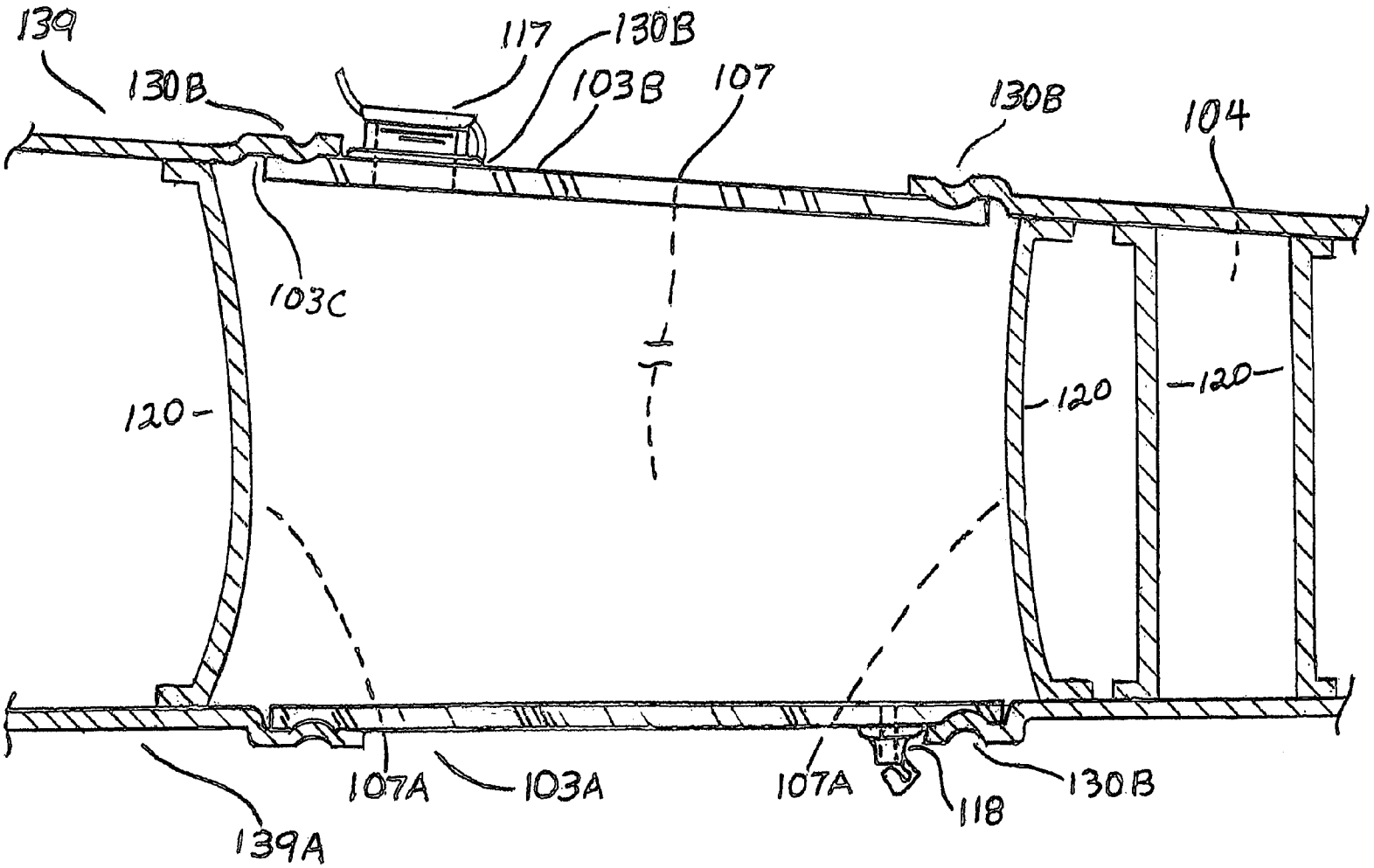
FIG. 21 is a sectional of viewing cavity

FIG. 21 is showing a sectional of a said viewing port cavity 107 with non reinforced said lenses 103B, 103A said sonic welded 130B to the top and bottom perimeter extensions 103C of craft into and around the perimeter of said viewing port walled cavity 107 sealing said viewing port cavity 107 water tight and creating an underwater viewing assembly that is one with the craft. This installation will remain water tight through temperature related expanding and contracting, inflations and deflations, user abuse, packing and unpacking. This is a slanted said top clear lens 103B design that allows for faster extraneous water runoff. Said clear lenses 103B and 103A are made of, but not limited to, PET or PETG, (DuPont product), and can be said sonic welded 130B in place to be watertight and one with the crafts. One can see this is a simple construction having one said sonic weld 130B to attach said lenses 103B and 103A. Shown also is said top vent 117, that is closeable. Said vent 117 allows the ingress and regress of a fluid, such as water, that would be contained within said viewing port walled cavity 107. Said viewing port walls 107A, of said viewing port walled cavity 107, are shown along with a small bottom vent 118. When it is time for the water within said viewing port cavity 107 to be evacuated through said top vent 117, said bottom vent 118 is opened. All said sonic welds 130B are depicted along with the said I-beams 120 that are constructed within said craft to form it. Said scuppers 104 are shown here also. Said top and bottom of the craft 139, 139A are also shown.

Figure 22:
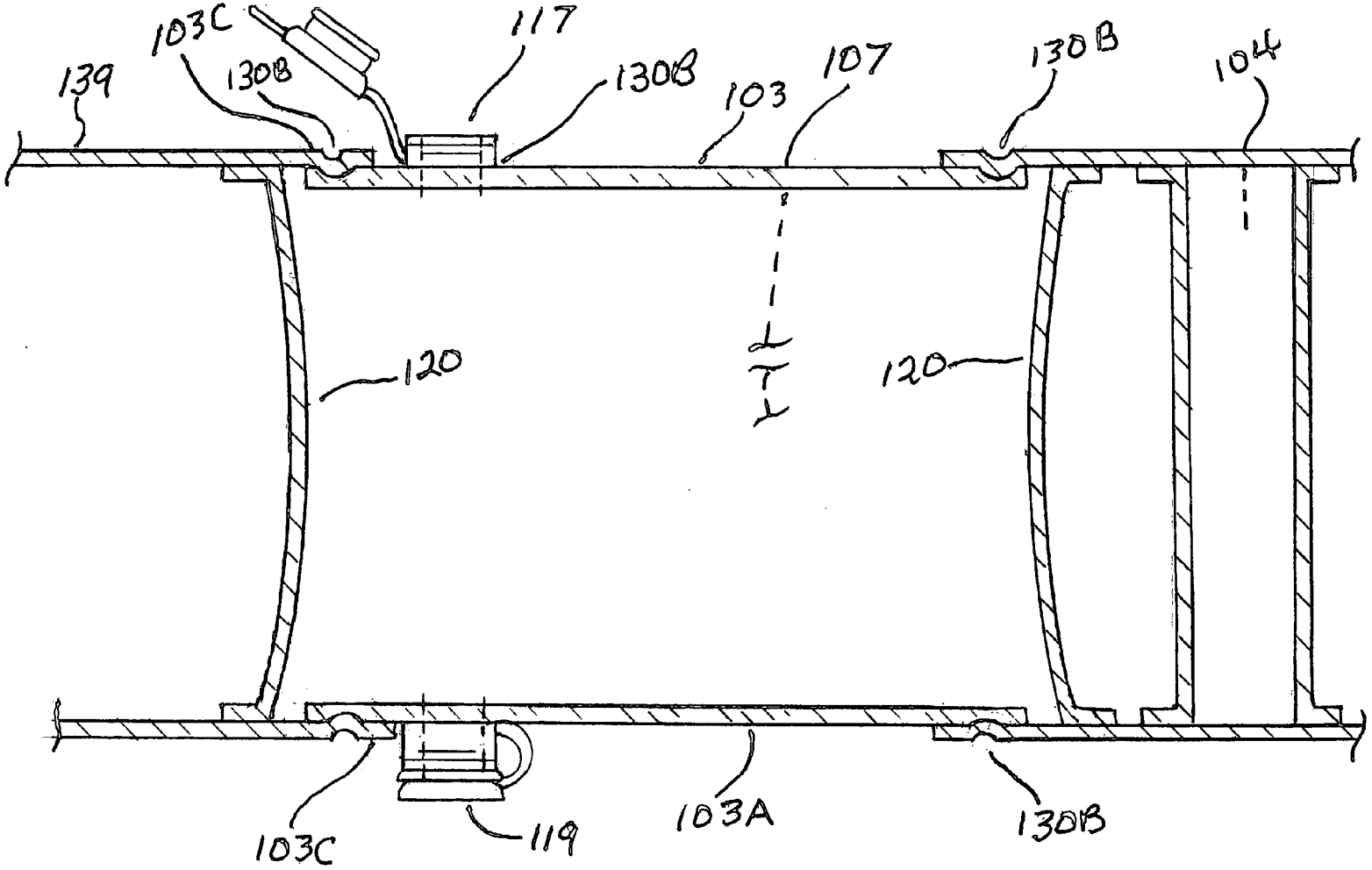
FIG. 22 shows a sectional of viewing window

FIG. 22 is a sectional of a viewing area with non-reinforced lenses, showing a level said top clear lens 103 and said bottom clear lens 103A with said large bottom vent 119 that can be opened when water that fills said viewing port cavity 107 is to be evacuated from said viewing port cavity 107. Said bottom vent 119 breaks the vacuum, allowing the water to flow freely and quickly from said viewing port walled cavity 107. All said sonic welds 130B locations are shown along with said I-beams 120 that make up said viewing port walled cavity 107 and said scuppers 104. Sonic welding is the simplest and most inexpensive means of attaching said lenses 103 and 103A to the upper and lower extremes of said viewing port walled cavity 107. Note, said PVC perimeter extension 103C, partially into said viewing port cavity perimeter. Said extensions 103C and said clear lenses 103 and 103A are said sonic welded 130B, sealing, integrally, said viewing port cavity, with said single non-reinforced weld 130B.

Figure 23:
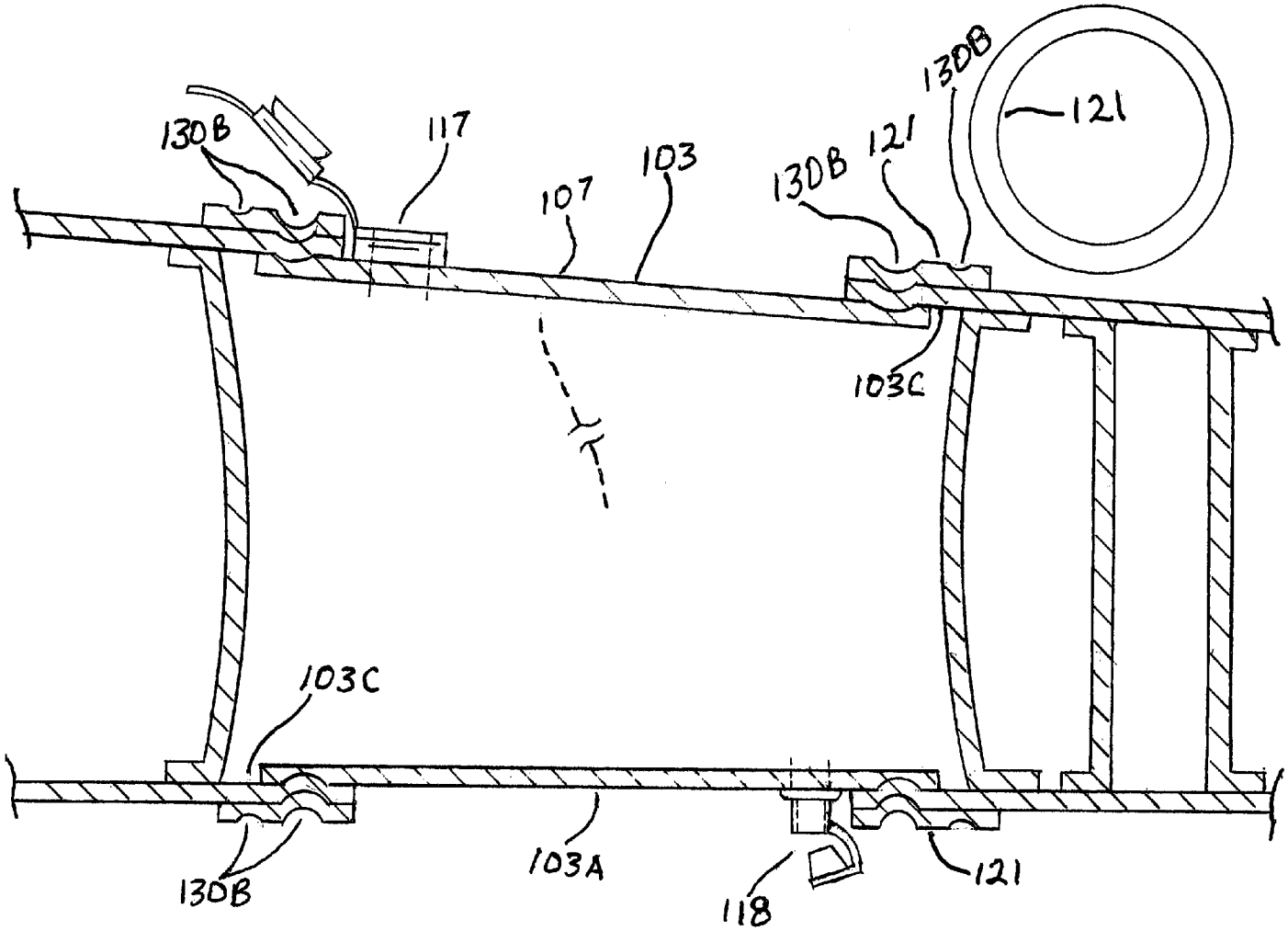
FIG. 23 is a sectional view of lenses reinforced

FIG. 23 is a sectional view of said lens 103B, and 103A being reinforced with said PVC overlay 121. When something of PVC is mass produced, or anything else, there will be defects. Said lenses 103,103A and 103B being installed with a single sonic weld 130B, could be a concern for defects within a water tight seal, Defects cannot be avoided, but can be minimized. This invention does that with FIG. 23. The reinforcement is said PVC ring overlay installation 121. Said PVC ring 121 goes around the upper and lower opening perimeters of said viewing port viewing cavity 107, extending out-board, a substantial amount, of said perimeter extensions 103C of the craft and, inboard, around the perimeter of said viewing port cavity 107 over said lenses 103B and 103A an adequate amount. Said PVC ring reinforcement 121 overlays are then said sonic welded 130B to said craft outboard said viewing port cavity 107, then said sonic welded 130B to said PVC perimeter extensions and said lenses 103B, 103A. Thus becoming integrally one with said craft. Said PVC ring reinforcement 121 also adds more strength to said viewing port viewing cavity 107 for containing water within said viewing port walled cavity 107. The inboard said sonic welds 130B could be staggered (shown FIG. 25). Said top and bottom 139, 139A sides of the craft are shown. All said sonic welds 130B are shown along with said top vent 117 and said small bottom vent 118 for vacuum release.

Figure 24:
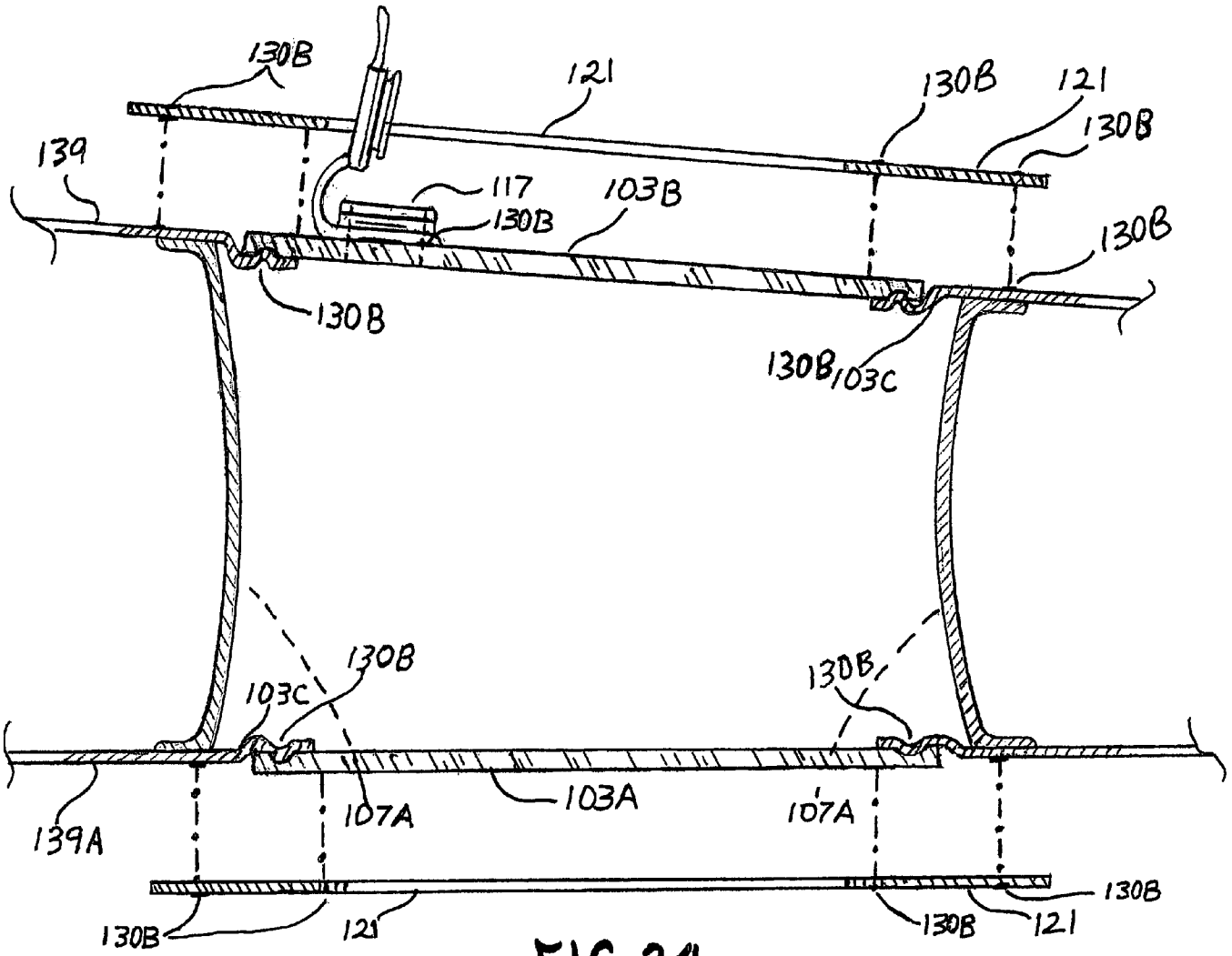
FIG. 24 is a sectional exploded view of PVC ring overlay reinforcement

FIG. 24 is showing a sectional exploded view of said PVC ring overlay 121 and the manner in which said PVC ring 121 is applied with said lenses 103B and 103A place on top of said crafts said extensions 103C into outboard perimeter of said viewing cavity 107. Wherein said lenses are said sonic welded 130B in place, first to the crafts said topside 139 and said bottom side 139A, said perimeter extensions 103C into the said outboard perimeter of viewing port cavity 107. Then said PVC ring overlay 121 is said sonic welded 130B to said craft outboard said viewing port cavity 107 perimeter and said sonic welded 130B to the inboard perimeter of said top and bottom lenses 103B and 103A with staggered said sonic welds 130B, creating a strong, watertight, underwater viewing window assembly. Also shown is said top vent 117.

Figure 25:
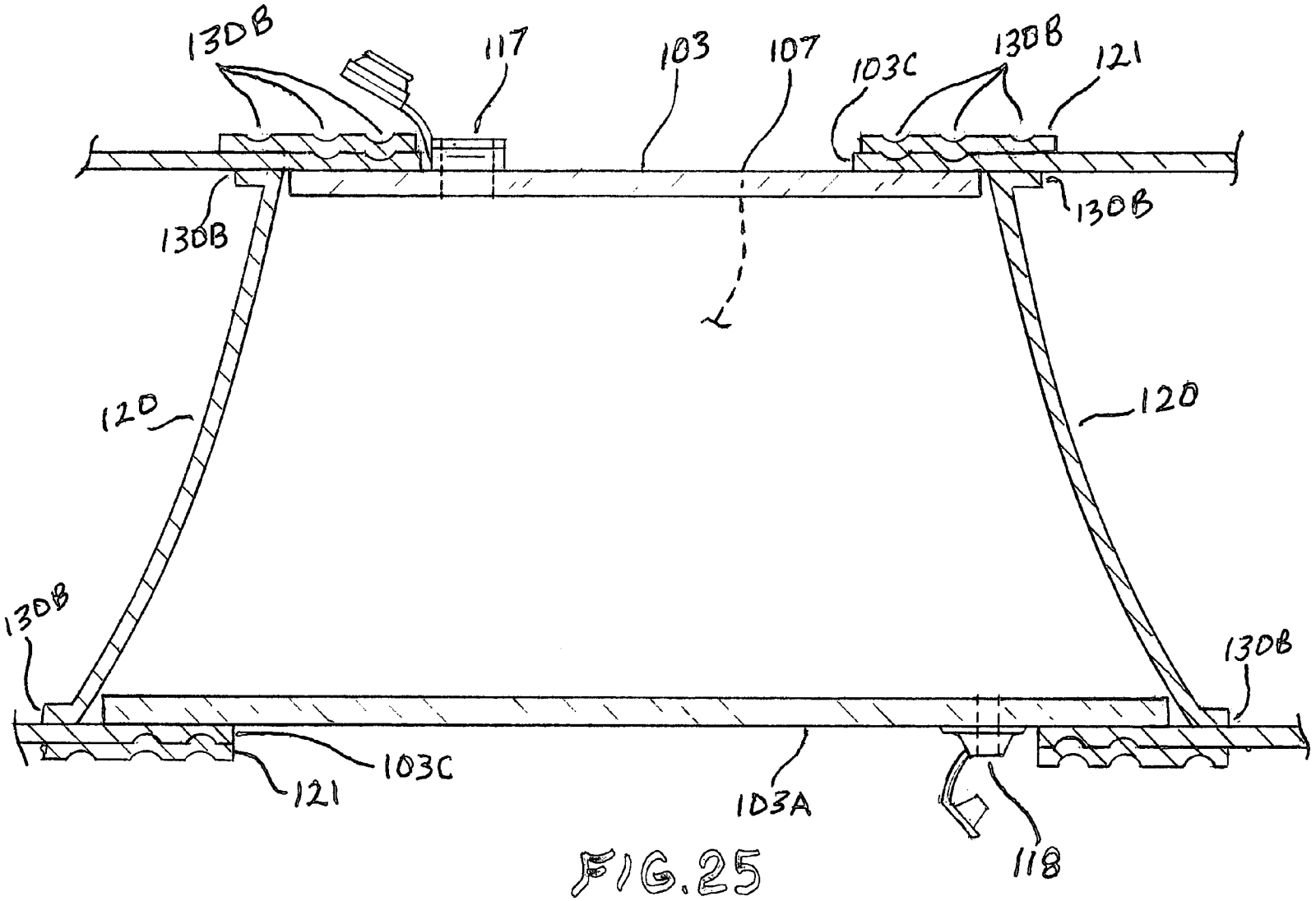
FIG. 25 is a sectional view of a conical shaped viewing area

FIG. 25 is a sectional view of a conical shaped said viewing port cavity 107 that is reinforced with said PVC ring 121 reinforcement. Said sonic welding 130B alternative, for said PVC ring reinforcement 121, is shown here. One can see that said lenses 103 and 103A were first welded in the simple installation manner, said single sonic welds 130B, to said perimeter extensions 103C of said crafts said top and bottom sides 139, 139A into said viewing port cavity 107. Then said PVC ring 121 overlays attachment to said top and bottom clear lenses 103 and 103A are said sonic welded 130B slightly inboard of the first said sonic welds 130B on said lenses 103, 103A and then said PVC rings 121 are said sonic welded 130B outboard of said viewing port cavity 107 to said craft. These staggered said sonic welds 130B onto said lenses 103 and 103A, make sure the seal is water tight and practically defect proof. Then there is said conical shape of said viewing port walled cavity 107. Wherein said bottom clear lens 103A is larger, thus providing a larger field of view below the water. Said small vent 118 is also shown on said bottom lens 103A, along with said viewing port cavity walls 107A.

Figure 26:
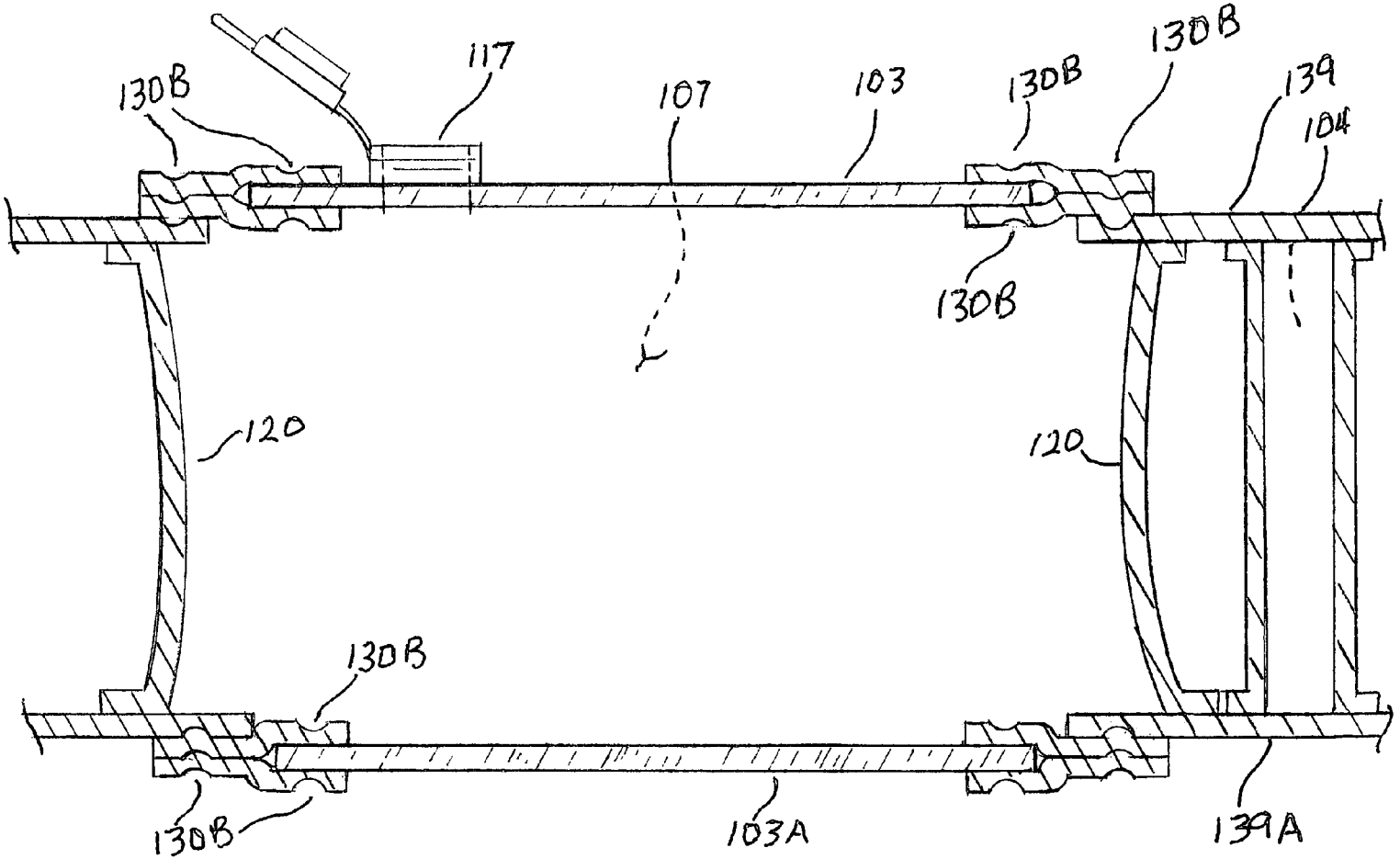
FIG. 26 shows a sectional view of sandwich type lens reinforcement

FIG. 26 is a sectional view of a different method of lens reinforcement called sandwich reinforcement 121A, whereby two said PVC rings 121A are incorporated. The explanation of this type reinforcement will, for simplicity, be restricted to said top clear lens 103. The installation applies equally to said bottom clear lens 103A. One can see from the drawing this installation is unique. Simply put, said PVC ring 121A is laid out, said clear lens 103 is then laid atop the first said PVC ring 121A in proper position. A second said PVC ring 121A is then laid upon said clear lens 103. Said PVC rings 121A will extend, a proper amount, over and inboard of outer perimeter of said lens 103 and said PVC rings 121A extends, a proper amount, over the outer perimeter of said viewing port walled cavity 107 onto said top side 139 of craft a sufficient amount and outboard of said walled cavity 107 perimeter. Herein, said PVC rings 121A sandwich said lens 103, then are said sonic welded 130B to the perimeter edge of said clear lens 103. Starting with said top sandwiching PVC ring 121A being said sonic welded 130B to said clear lens 103 in a predetermined place. Then the second, said bottom PVC ring 121A is said sonic welded 130B in place to a predetermined spot either inboard or outboard of said top PVC ring 121A weld. Then the portion of said PVC rings 121A that extend beyond the outer perimeter of said clear lens 103 are said sonic welded 130B to said craft said top side 139, outboard the outer perimeter of said view port cavity 107. Also shown are said I-beams 120 making up said viewing port cavity walls 107A and said scuppers 104, said top and bottom vents 117, 119. All said sonic welds 130B are also shown.

Figure 27:
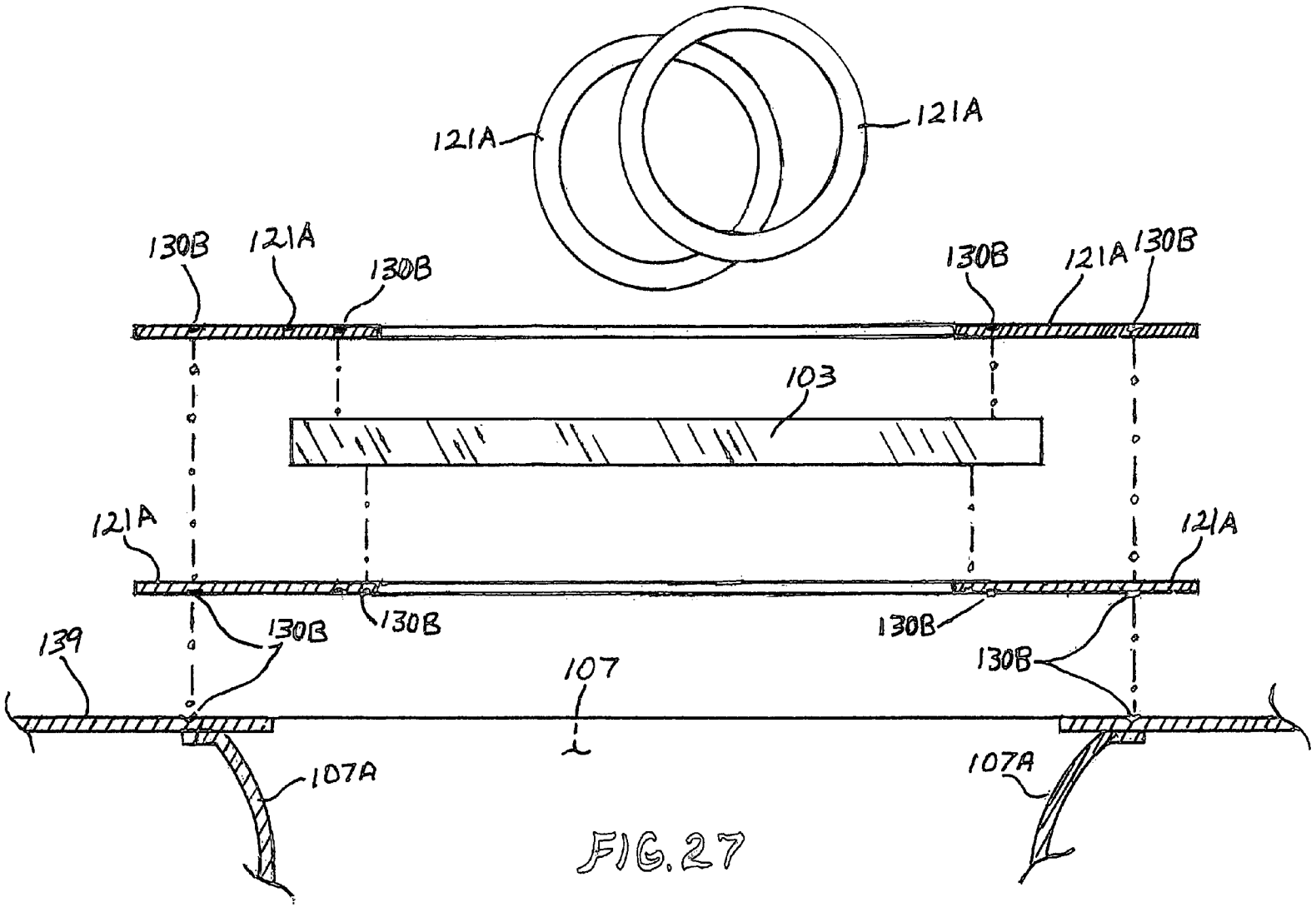
FIG. 27 is a sectional exploded view of sandwich type lens reinforcement

FIG. 27 is a sectional exploded view of said sandwich type reinforcement 121A of said top clear lens 103 sonic weld 130B attachment to the said top perimeter of said viewing port cavity 107. One can see just how said PVC rings 121A are positioned in regards to said clear lens 103, and said welds 130B are staggered on said clear lens 103. Said sonic welds 130B outboard said lens 103 and said viewing port cavity 107 are shown. Also shown are said viewing port cavity walls 107A. Multiple said sonic welds 130B ensures that at least one will be a good weld and defects can be diverted.

Figure 28:
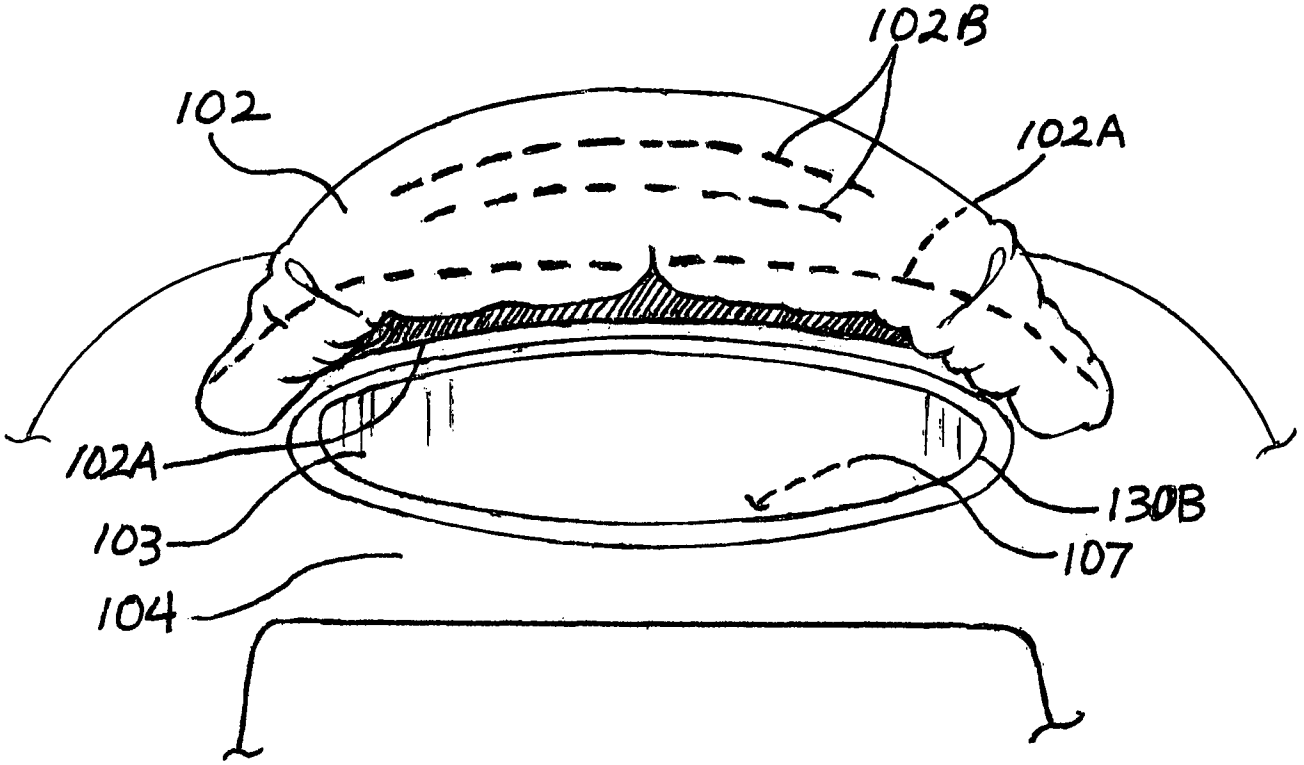
FIG. 28 shows a rear view of pillow

FIG. 28 is a rear view of pillow 102 showing said pillow 102 said sonic weld 130B attachment to craft 102A and said pillow's said I-beams 102B, which pull the top of said pillow 102 down and bottom of said pillow 102 up, keeping the user's face further away from said top lens 103. Also shown is said viewing port walled cavity 107. Said scuppers 104 are also depicted. Note the space under said pillow 102 and the distance said lens 103 is from the bottom of said pillow 102.

Figure 29:
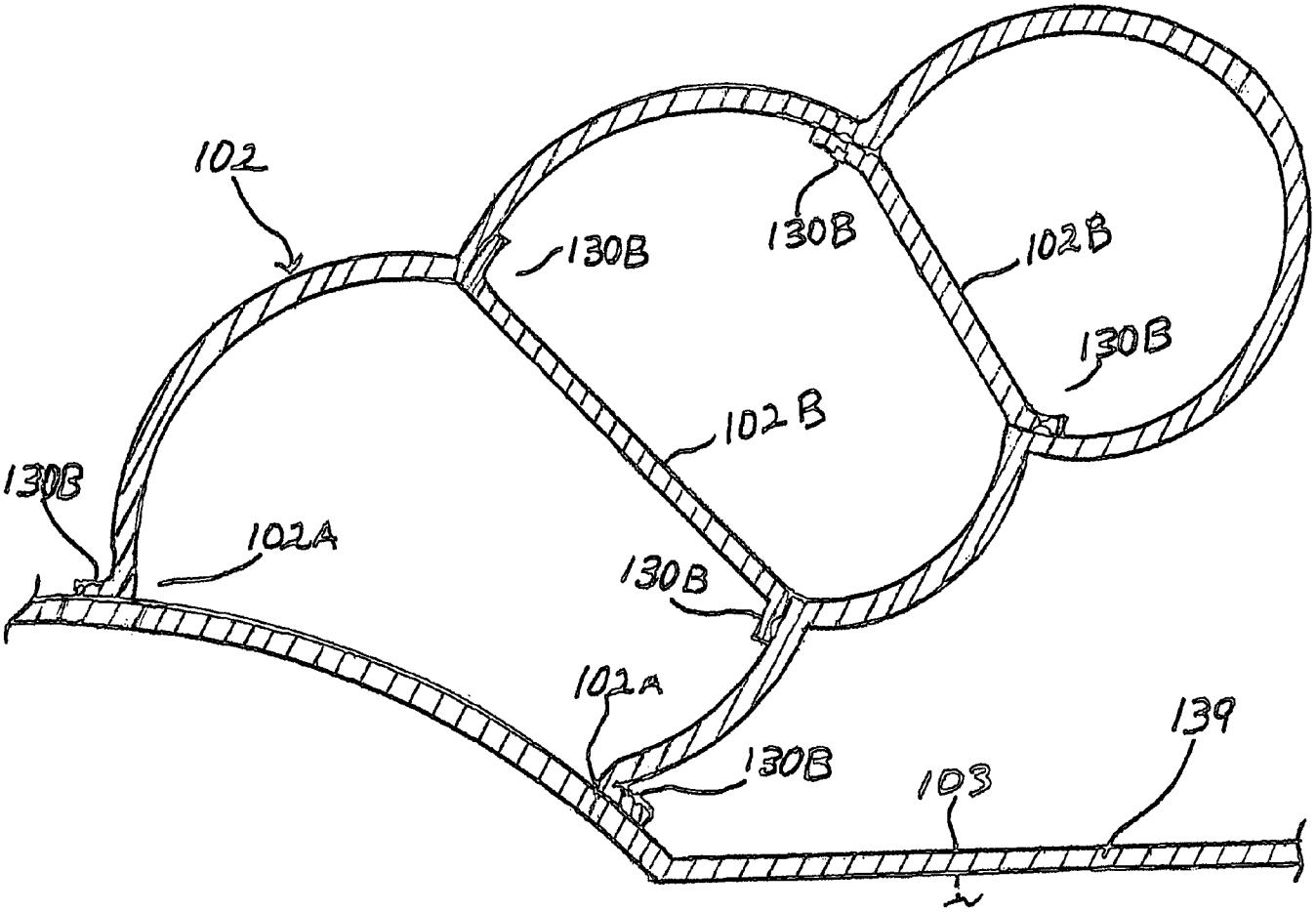
FIG. 29 is a sectional view of pillow

FIG. 29 shows a sectional side view of said pillow. One can see how said I-beams 102B form said pillow 102 by holding the lower part of said pillow up from said topside of craft 139 and keeping the top of said pillow 102 down. With said I-beams 102B working with the curved, semi-circle construction, of said pillow 102, around said top clear lens 103, a cupped shape is formed in said pillow 102. Wherein, a user's head is held above said top surface 139 of the craft.

Figure 30:
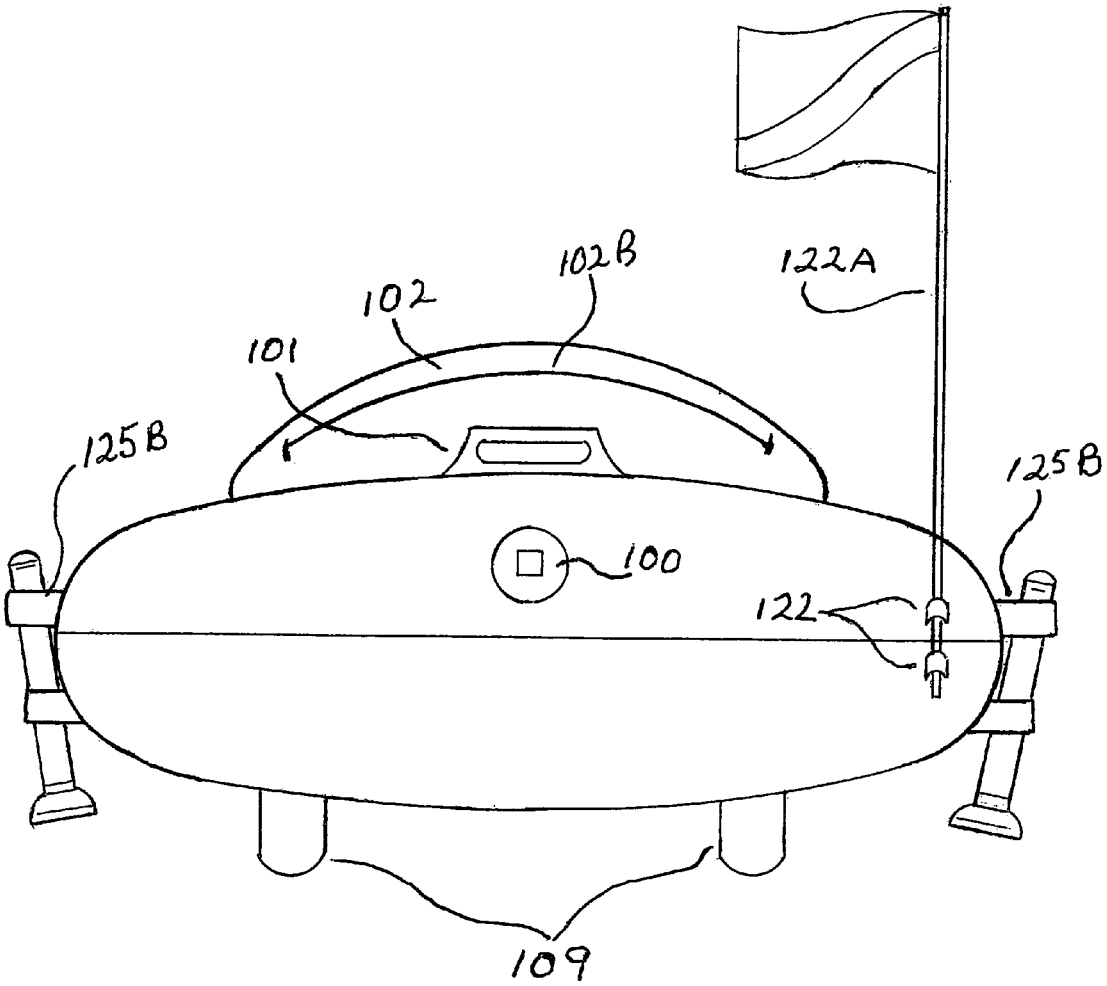
FIG. 30 is a front view of craft with flag pole and dive light mounts

FIG. 30 is a front view of said craft 99 showing said flag mount 122 and flag pole 122A inserted. This is truly a necessary safety item when snorkeling near or in boat traffic. There are said two towing eyes 100 mounted to either side of a craft and slightly forward on the bow of a craft, that makeup said mount 122 and how said flag pole 122A is installed. Here is a good view of the placement of said stand offs 109 and how they would work to protect said bottom clear lens 103A (not shown), from scratches. Another embodiment is dive light mount 123. One can see that it consists of two said PVC straps 125B on each side of craft, showing the manner in which said dive lights 123A are installed. This comprises said dive light mount 123. Showing also is said pillow 102 and said I-beams 102B, along with said bow handle 101. Said towing eye 100 is also depicted.

Figure 31:
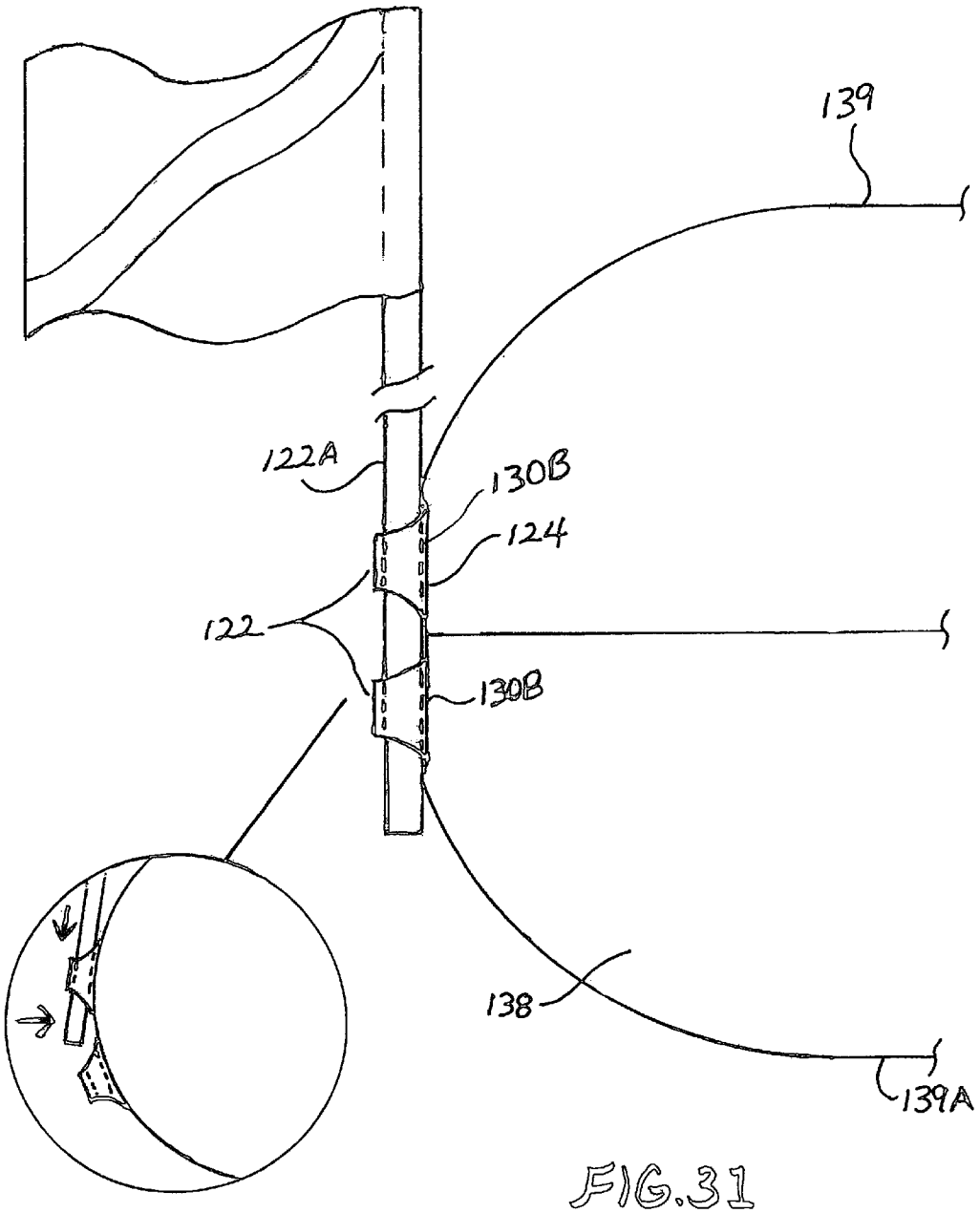
FIG. 31 is a detailed view of flag pole mount

FIG. 31 is a detailed side view of said flag pole mount showing the placement and orientation, on said craft 99, of two said towing eyes 100, said sonic welded 130B to said craft 99 forming said mount 122. The insert shows the procedure to load said flag pole 122A into said mount 122.

Here, said top and bottom of said craft are noted 139, 139B, also said heavier gauge PVC 138 on the bottom half of craft.

Figure 32:
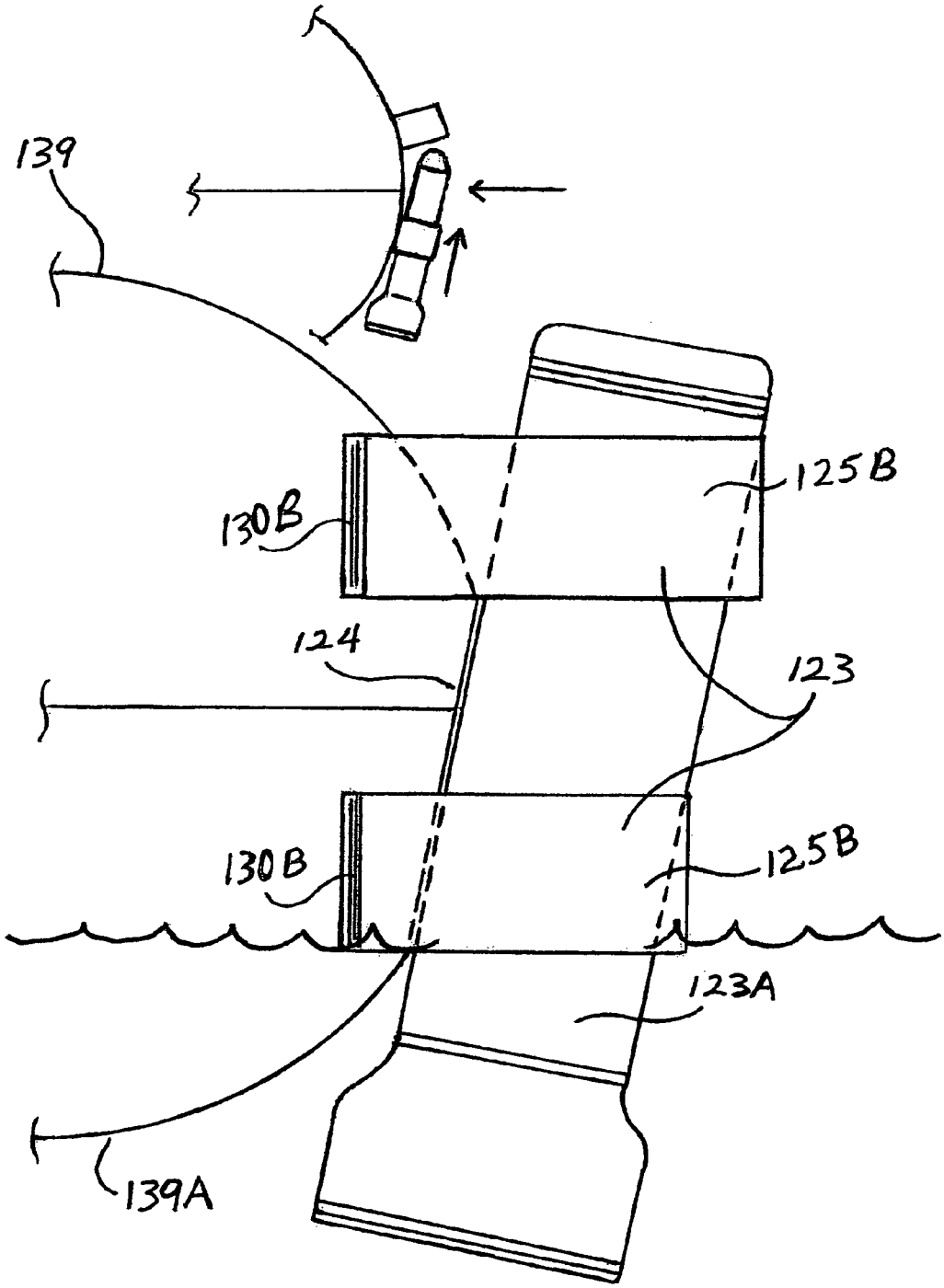
FIG. 32 is a detailed view of dive light mount

FIG. 32 is a detailed side view of said dive light mount 123. Two said PVC straps 125B are said sonic welded 130B to both sides of said craft 99. Note the placement of said dive light mount 123 is low enough for the working end of said dive light 123A to extend below the water. The loading of said dive light 123A is the same as flag pole 122A, just reversed in that said dive light 123A, butt end, comes from below said dive light mount 123 to be inserted. Said outward air pressure 124 will hold said dive light 123A in place.

Figure 32A:
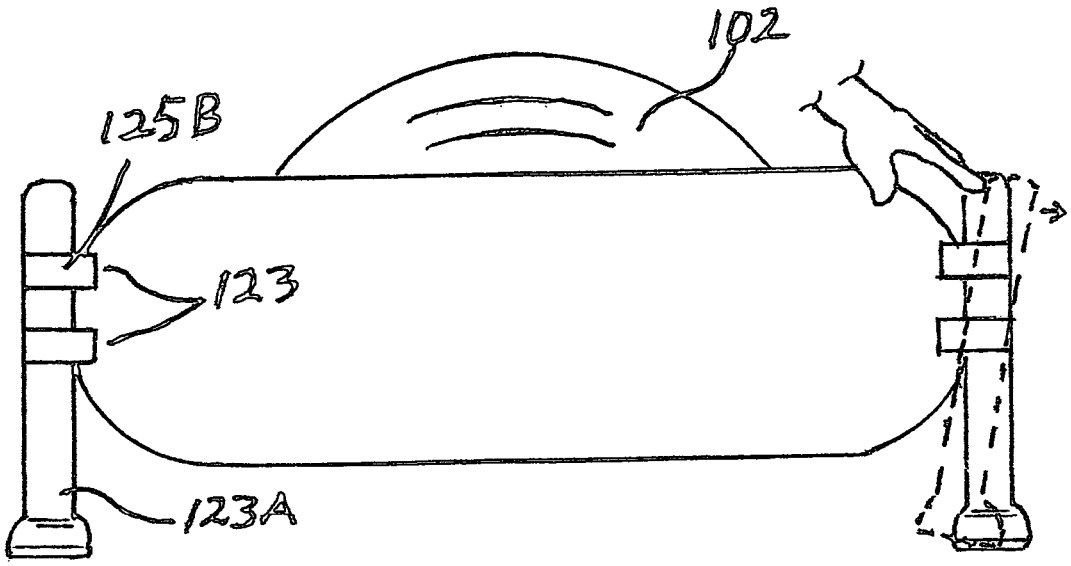
FIG. 32A shows dive light directional positioning by user
Figure 32A:
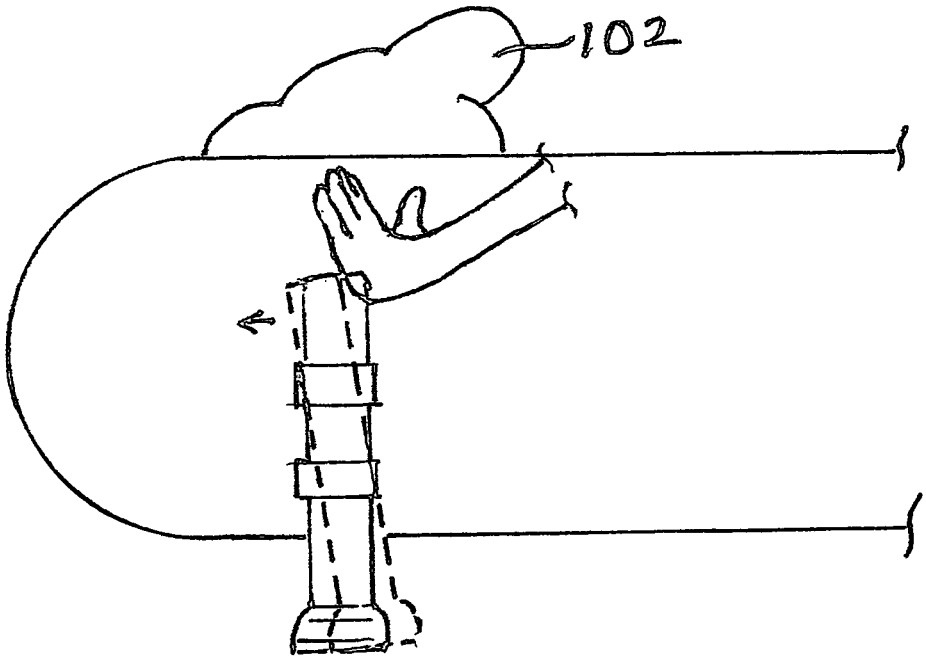

FIG. 32A is a detail showing said dive light directional adjustability. Starting from the top, looking at the front of said craft 99, to adjust said dive light 123A inward to illuminate under said craft, a user simply pushes the top end of said dive light 123A outward, as shown. To put light outward from said craft 99, the opposite is performed and the end of said dive light 123A is pulled inward. Looking at the side of said craft 99, if a user desires more light aft, the top end of said dive light 123A is pushed forward, as shown. To put light forward, the opposite move is performed and the top end of said dive light 123A is pulled back.

Figure 33:
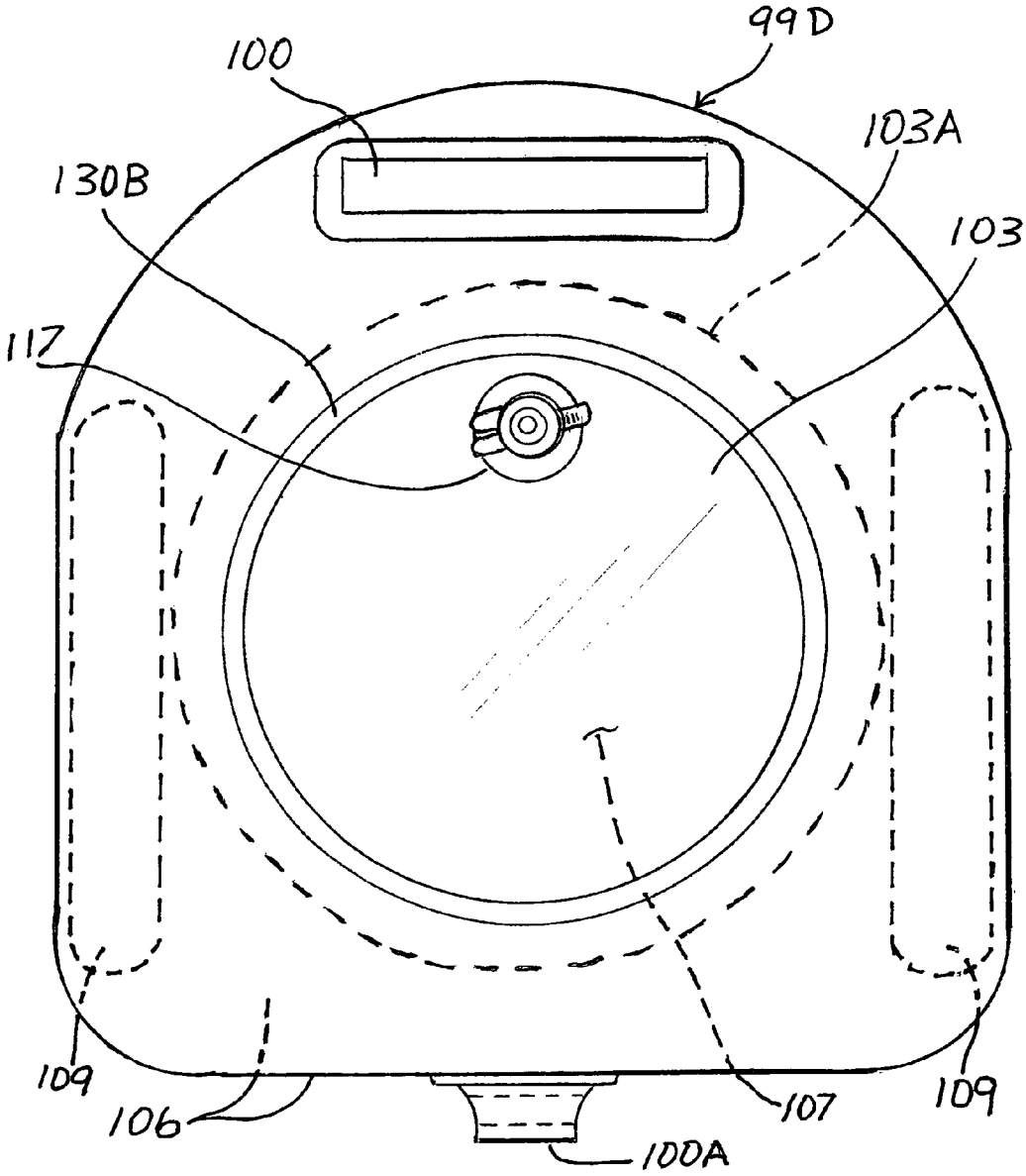
FIG. 33 is a top view of hand held underwater viewing device 99D

FIG. 33 is a top isometric view of a hand held underwater viewing device 99D (here on known as device) that allow users, one to ninety, to wade or swim with said device 99D. Shown is said handle 101 forward of the said viewing window, said viewing port cavity 107, said clear top lens 103, said op vent 117, and said lanyard attachment 100A. One can see that said bottom clear lens 103A is larger than said top lens 103. Making a conical shape creates a larger view below. Said sonic weld 130B of said top lens 103 is depicted and then seen is said viewing area air chamber 106. Also shown, located on the bottom to each side of said bottom lens 103A, are said inflatable stand offs 109 to protect said bottom clear lens 103A from scratches when set down.

Figure 34:
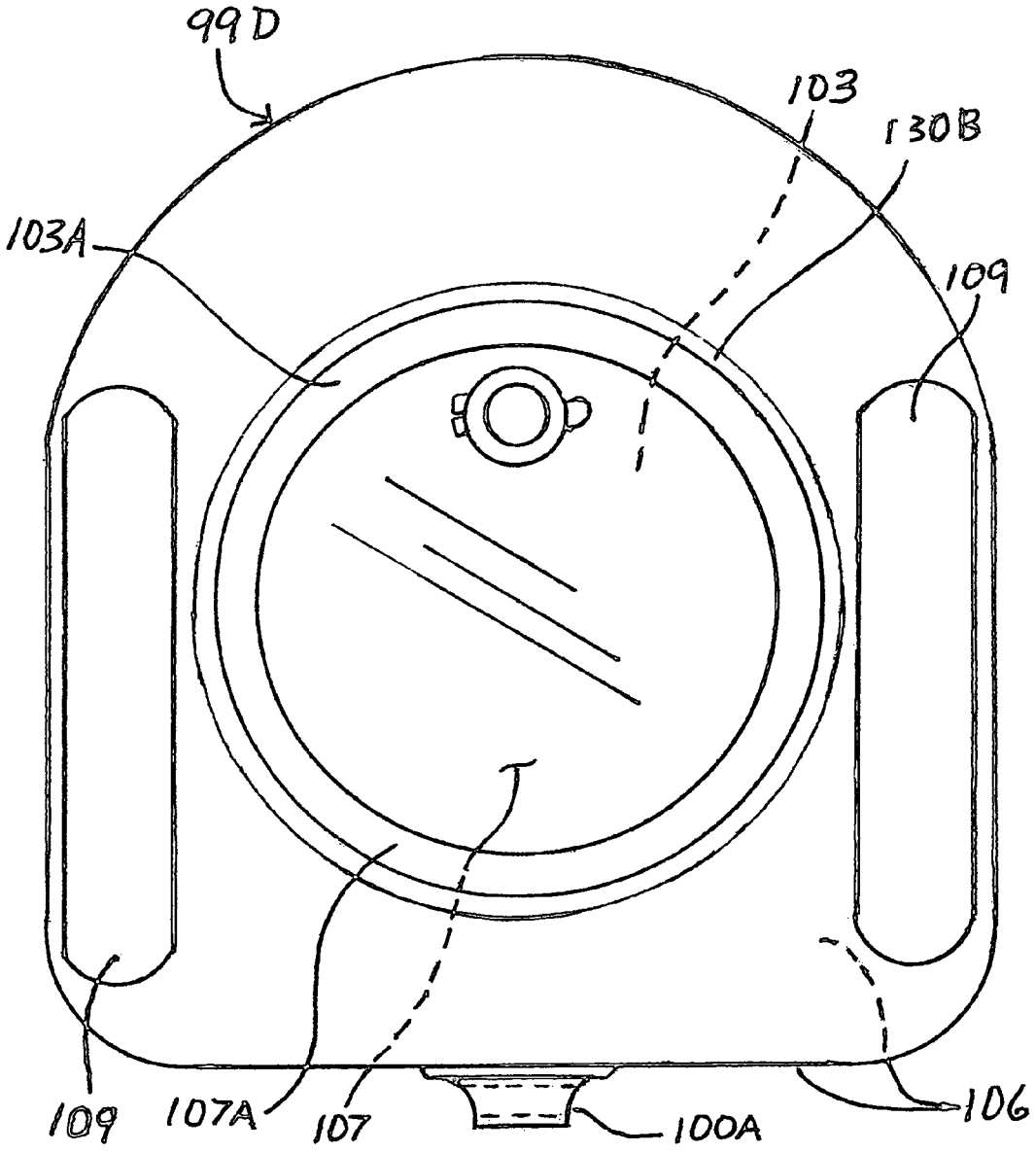
FIG. 34 is a bottom view of hand held underwater viewing device 99D

FIG. 34 is a bottom view of said hand held underwater viewing device 99D showing said top and bottom lenses 103, 103A, said bottom stand offs 109, said sonic weld 130B of said bottom lens 103A, said viewing port cavity 107 and said viewing port cavity walls 107A. Along with said viewing area air chamber 106 and said lanyard attachment 100A.

Figure 35:
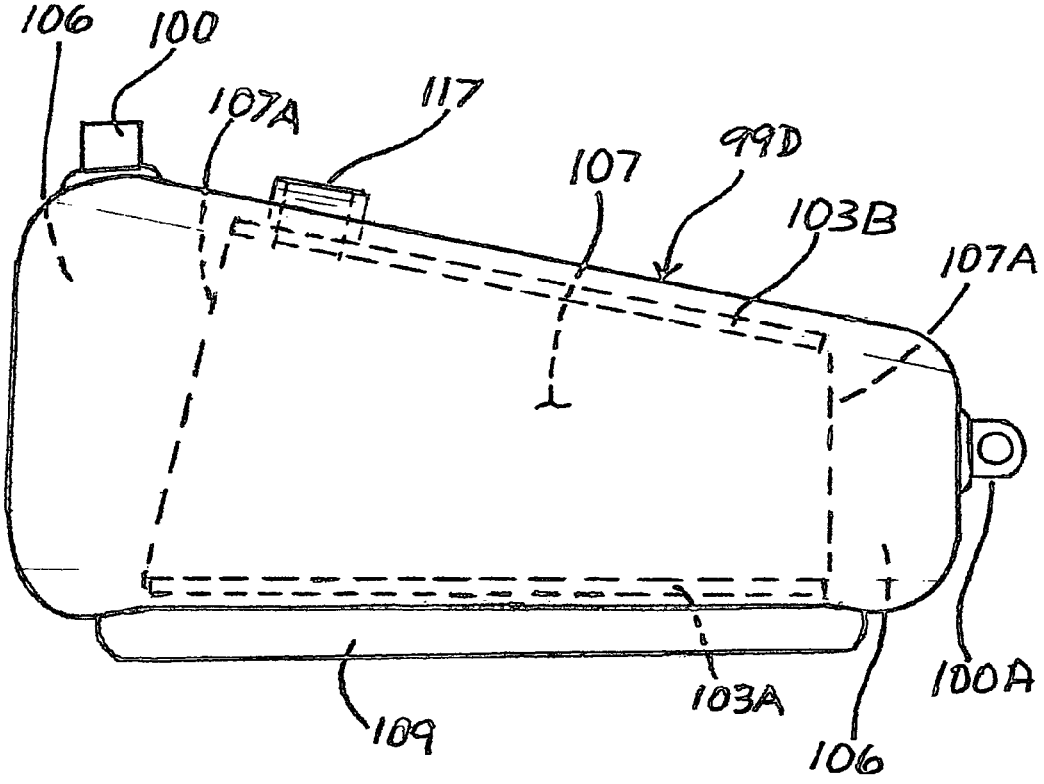
FIG. 35 shows a side isometric of hand held underwater viewing device 99D

FIG. 35 is a side isometric view of said hand held underwater viewing device 99D showing said viewing port cavity walls 107A, said viewing port cavity 107. There are also said inflatable bottom standoffs 109 shown on said device 99D. Said standoffs 109, located to outboard sides of said bottom lens 103A holds said bottom lens 103A off the ground. Also shown is said bow handle 101, said closeable vent 117 for the ingress and regress of a liquid, said lanyard attachment 100A and said viewing area air chamber 106 which keeps said device 99D afloat. Said lanyard attachment 100A keeps said device 99D connected to a user's hand, or draped around the neck, in case they are momentarily distracted.

Figure 36:
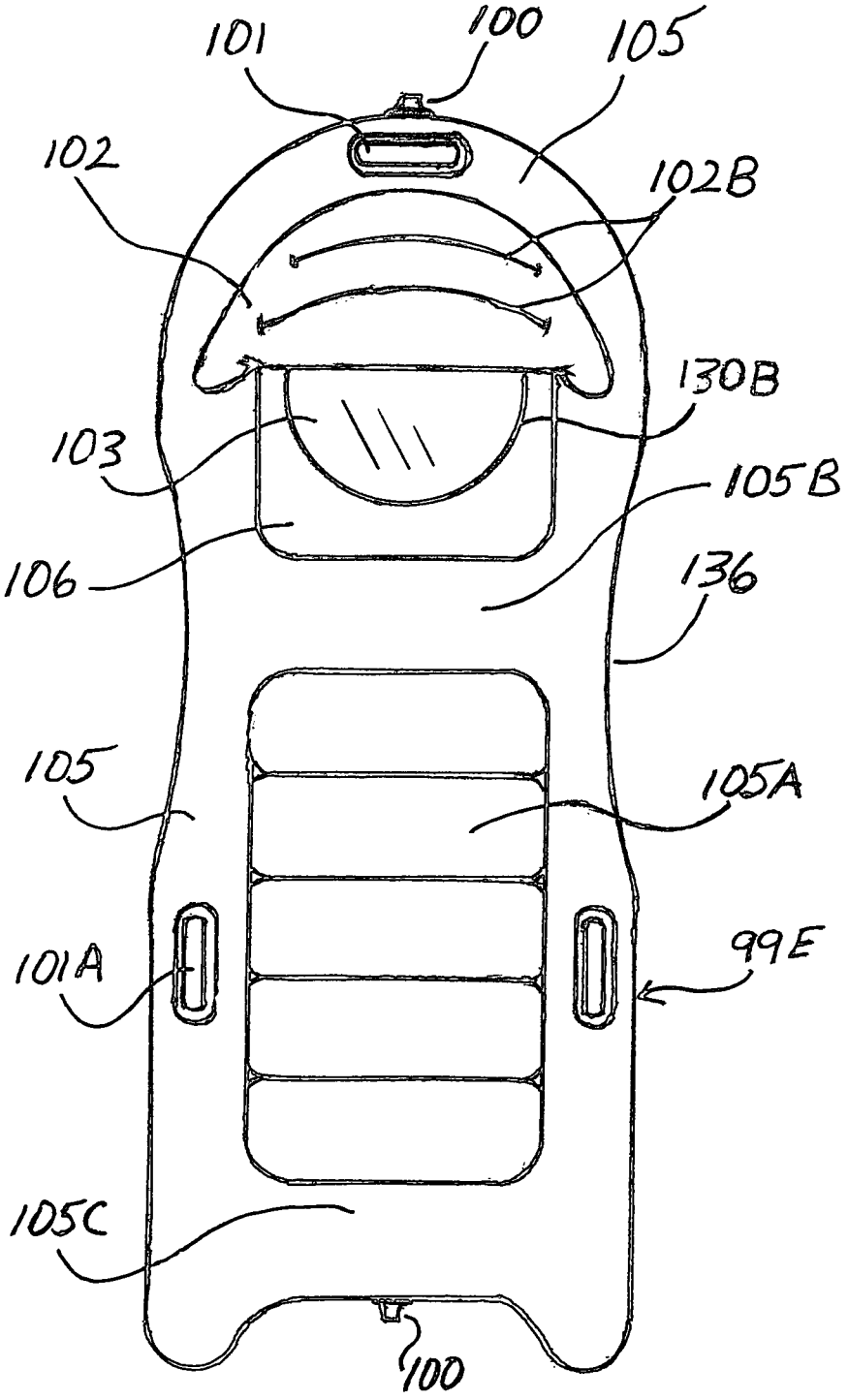
FIG. 36 is a top view of craft 99E with no scuppers.

FIG. 36 is a top view of craft 99E showing all the usual embodiments of craft 99, except one. There are no said scuppers 104 or any other visible, or dedicated, means of removing extraneous water, for there is no real need, for there is away to remove extraneous water.

Figure 37:
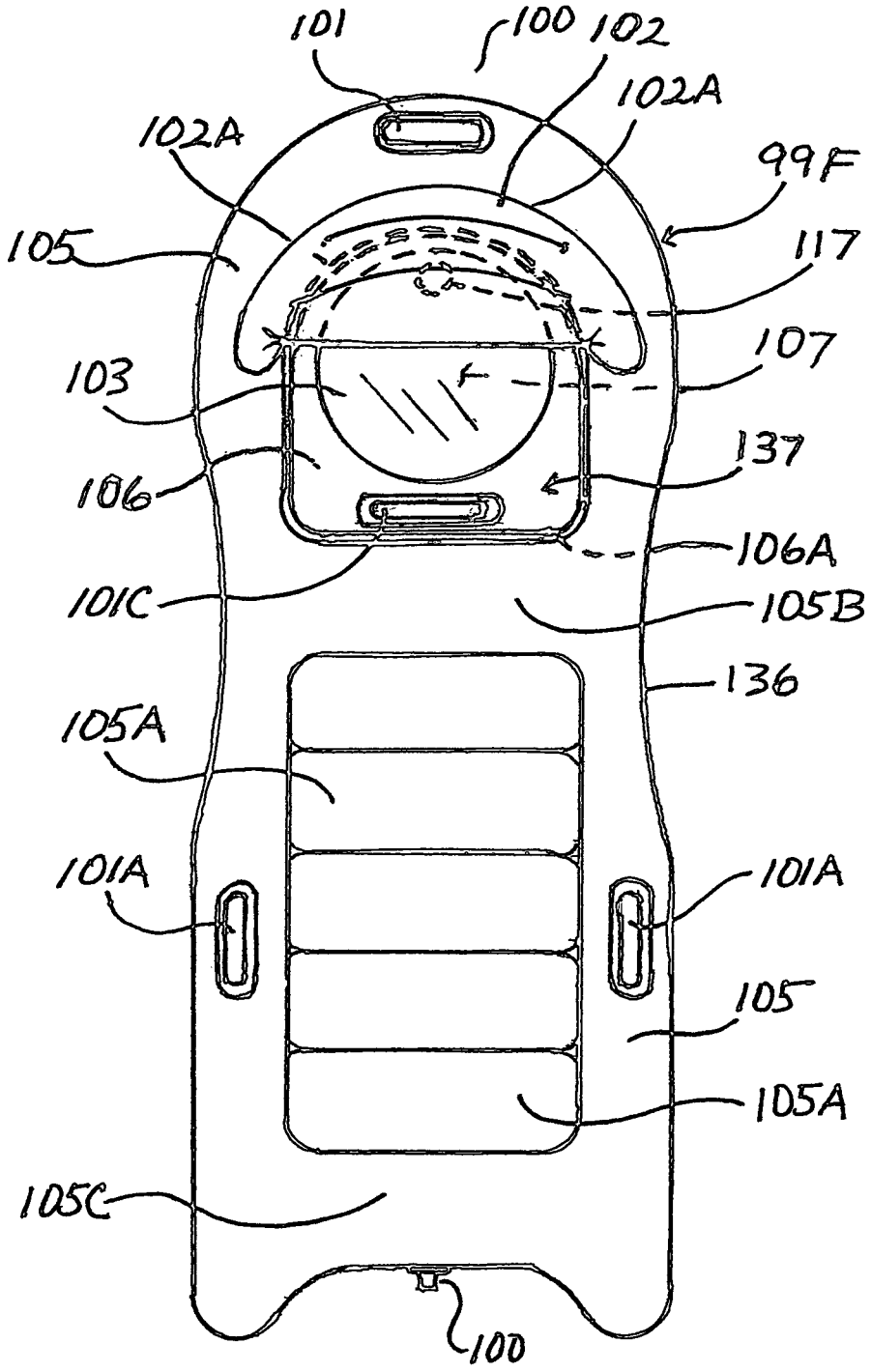
FIG. 37 is a side isometric exploded view of craft 99F showing insertion of modified hand held viewing device into void viewing area air chamber of craft

FIG. 37 shows a top view of craft 99F showing a modified hand held underwater viewing device 137, with said integral underwater viewing window, inserted into void viewing area air chamber 106A of said craft 99F. Said modified hand held device 137 thereby is said viewing area 106A of said craft 99F. Said craft 99F has been modified where upon said viewing area air chamber 106A is removed; creating said void viewing area air chamber 106A. Where upon said modified hand held device 137, composed of said viewing area air chamber 106 and said underwater viewing cavity 107 with said lenses 103 and 103A installed, can be inserted into said void viewing area air chamber 106A, whereby two units, said craft 99F and said modified hand held underwater viewing device 137 become one said craft 99F. Top stern handle 101C, shown, is for easy transport.

Figure 38:
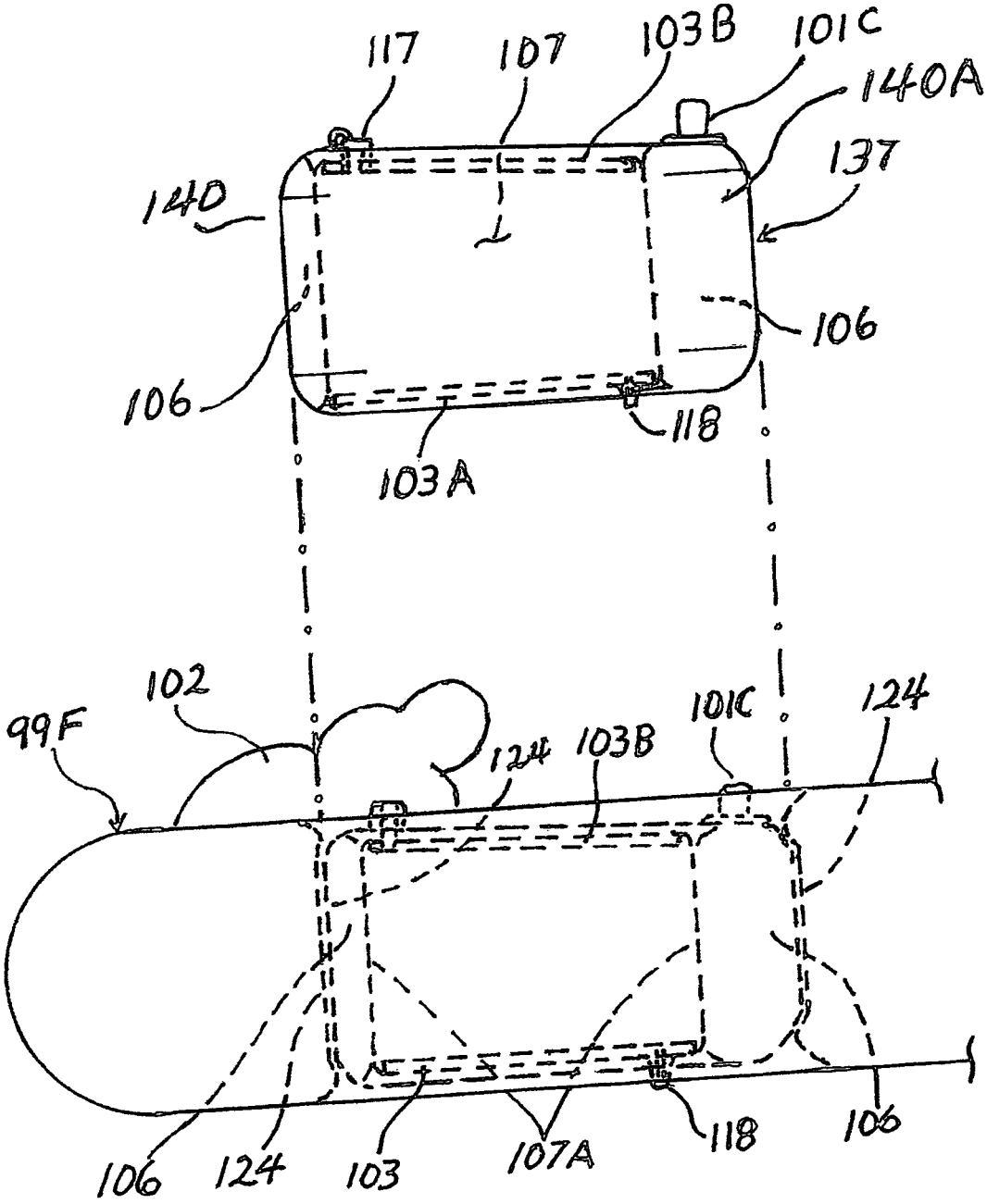
FIG. 38 shows a top view of craft 99F with a void viewing area air chamber

FIG. 38 showing an isometric exploded view of said modified hand held viewing device 137 placement into said craft 99F. One can see, starting with said hand held device 137, that the modification is on stern end 140A. Said stern 140A is heightened to be more in plane with top surface of said craft 99F. The normal said hand held underwater viewing device 99D slants extremely aft ward. The bow is approximately, but not limited to, 8 inches high and approximately, but not limited to, 2 inches high at said stern of device 99D. This is why a modification was necessary to create said modified hand held device 137 to be somewhat level with said top deck 139 of said craft 99G. Now looking at said hand held device 137 inserted into said void viewing area 106A of said craft 99F. One can see a top, slightly, slanted said lens 103B on modified hand held device 137, also said viewing air chamber 106. Note how said outward air pressure 124 of each units push against each other locking said modified hand held device in place. One can see the other standard features also. Shown, are said closeable top vent 117, said small bottom closeable vent 118, said viewing port cavity 107, said top and bottom lenses 103B, 103A, and said pillow 102.

Figure 39:
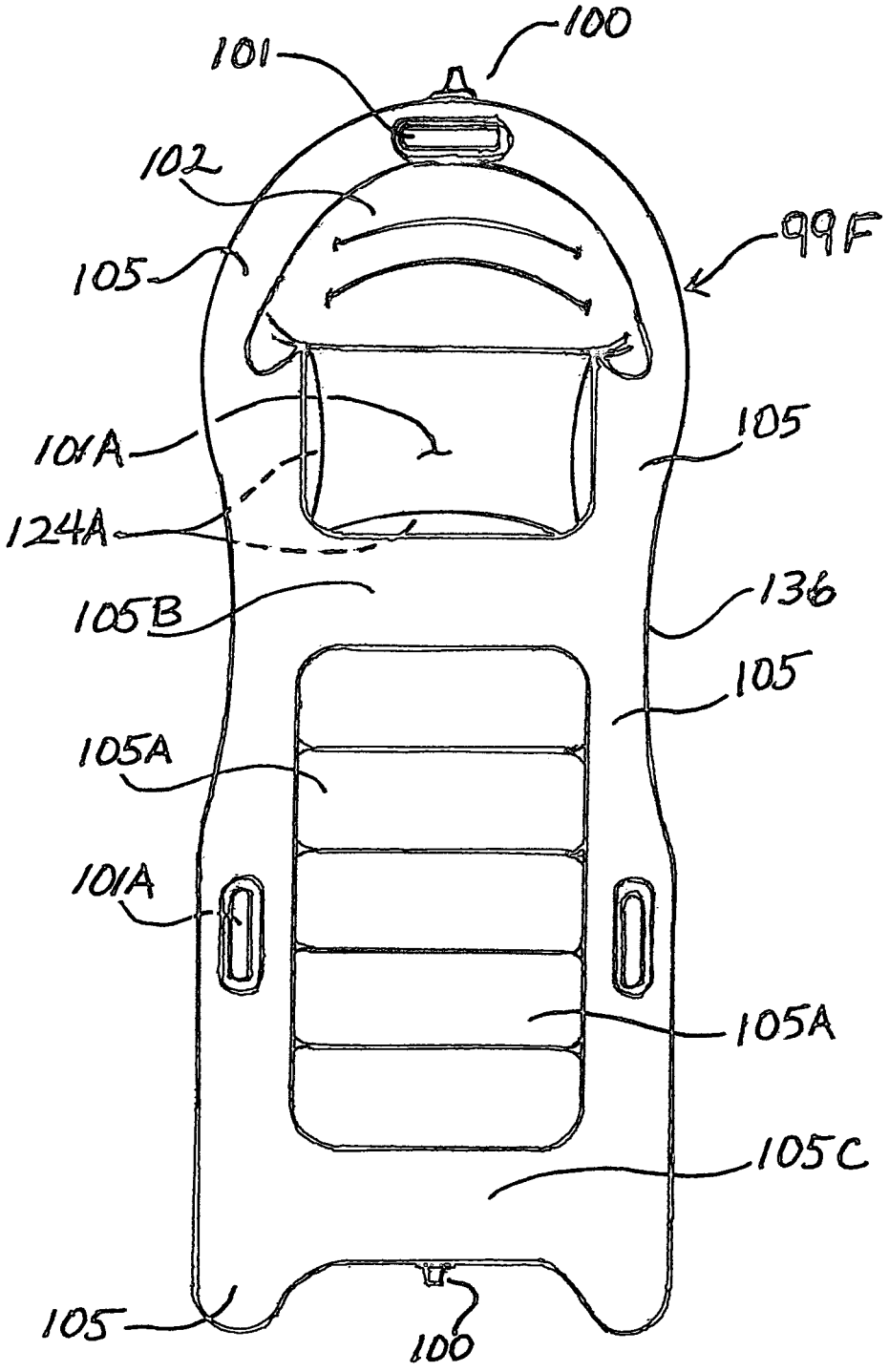
FIG. 39 shows top view of modified hand held viewing device 137 inserted

FIG. 39 is showing a top view of said craft 99F possessing all the features of said craft 99 with one exception. Said viewing area air chamber is void 106A. Depicted is the outward air pressure 124 into said viewing area air chamber 106A.

This invention possesses many operational embodiments that offer affordability, comfort and functionality. One such embodiment is that the crafts within this invention are of PVC, thus inflatable, making them affordable. This feature also allows them to be deflated and packed small to fit into a suit case for travel. Another embodiment is that the underwater viewing window is an integral part of the crafts and collapsible, another feature that allows for small packing. The following will be focusing on the other embodiments this invention possesses.

There are several crafts contained in this patent. All of which can be produced in varies lengths to accommodate various heights of people. The first craft 99 is designed for the user to lie upon prone as with crafts 99A, 99E and 99F. To operate the prone use crafts, the craft can be inflated first and then the underwater viewing port can be filled with water, removing all air, or do vise versa. With the lens being sonic welded to the craft, the water is contained securely, no leaks, especially if the lenses have been reinforced, another embodiment. Now the craft is ready to go into the water. One boards from the side or from the stern. When boarding from the stern, there are mid ship handles. A bow handle, mentioned later, may not be a new thing, but mid ship handles of the present invention are. Each size, of the prone use crafts, will have mid ship handles strategically attached to the upper port and starboard sides. The placement distance from the stern is important, for when one is boarding from the stern and their feet cannot touch the bottom of the water, one must be able to grasp these mid ship handles, for with these handles the user can pull themselves onto the craft with greater ease. Boarding guide embodiments now come into play, whether boarding from the side or stern. These guides help to position one onto the center of the craft and keep them there. This embodiment is important because many people, especially older people and the young can have a great deal of trouble boarding an inflatable craft. They either come on to the craft to far aft and the craft shots out from under them or they board the craft to far to one side or the other and the craft shoots out from under them to one side. The boarding guide embodiments will be a tremendous help for these people. Towing eyes are also mounted on the bow and stern of these crafts. Where upon, a craft with an integral underwater viewing window is sized for children, a line can be attached to the bow towing eye and the parent can pull the craft and child along with them, when snorkeling. Also, be able to communicate with the child on what they are seeing. This would be an interactive and educational experience for the child and rewarding for the parent. In the event there are two children, a line from the stern towing eye of the craft the parent is operating, to the bow towing eye of the first craft and a line from the stern towing eye of the first to the bow towing eye of the second craft, and the parent could pull them in tandem. There could be instances whereby the parent would want to tow a child on the craft because the child is not a really strong swimmer but wishes to keep the child close. The parent would simply tie a line to the bow towing eye; attach the other end to the stern towing eye. The parent can either, walk alongside the child and craft in swallow water or swim with the craft with their arm looped over the line beside the craft. Wherein, close proximity is maintained.

Another embodiment is the pillow design and use, where one can, after boarding, lying prone, rest their forehead upon the pillow and completely relax. The integral underwater viewing window is just aft of and under the pillow. The curved shape of the pillow is the same radius as the top lens of the viewing window. The pillow is a semi-circle, cupped shape that brings the aft edge perimeter of the pillow out over the top lens of the viewing window. With this, the user, lying prone, places their forehead upon the aft perimeter of the pillow, automatically placing the user's eyes centered above the top lens, with their face above the top clear lens several inches. This provides for a non confined, opened air space below their face for unrestricted ventilation, without blocking peripheral vision. The head or face is not used to block extraneous light or water, as with prior art. This pillow is for comfort only, making for prolonged operation of this invention. This pillow design is large, thus allows for comfortable supine use.

Now, when you are on board, the craft can be paddled by hand, and paddling is made easier because of the recessed sides of the craft allowing unrestricted arm movement and easy reach of the water. The crafts lengths can be of a predetermined length to allow your legs to extend beyond the stern of the craft, placing your legs in full contact with the water, allowing easy propulsion with the use of fins.

When the snorkeling is over the craft can be pulled ashore using a bow handle mounted on the craft. A bow handle will be mounted on the upper portion of the bow on all prone use crafts of this invention. The standoff embodiments now come into play. These inflated standoffs, mounted to each side of the bottom lens, are of a sufficient height and length to prevent the bottom lens from contacting the pool side or beach when laid down or dropped, thus avoiding scratches.

Let's say you are on vacation and it's time to pack and head for the airport and time is of the essence. The first thing to do is empty the underwater viewing window of water. The top closeable vent would then be opened and the craft turned over to evacuate the water contained inside the viewing cavity. However a vacuum quickly develops, for all the water is trying to exit through the one hole of the top closeable vent. This is not a time safer. The embodiment that solves this problem and speeds this process is a second closeable vent located on the bottom clear lens. When this vent is opened, while emptying the viewing window, the vacuum is broken; the water then flows out quickly, in one continuous flow. The craft now must be deflated completely to allow packing flat enough to be fit into ones suit case. Deflating the craft using an electric air pump could eat up precious time if you are running late for the airport and in most cases people will not have an electric air pump. The craft, on arrival of the hotel, will simply be inflated orally. In this scenario the craft, positively, could not be deflated enough to be packed into a suit case. The embodiments that solve this problem are quick deflating valves, on the bottom side of the outboard and inboard air chambers. When opened, all the air is quickly depleted, or dumped, from the craft and then packed into a suit case and arrival at the airport is on time. A flag pole mount is an embodiment that allows a flag, such as a dive flag, to be installed on a craft of this invention. A safety feature necessary when you are snorkeling in or near boat traffic. The flag and mount is inexpensive and the flag is easily installed. There are two eyes mounted on the side of the bow of a craft. The crafts are of two halves, an upper and lower, and sonic welded together. Then at this midway junction, a tow eye is mounted a couple of inches above the midway junction and the other tow eye mounted a couple of inches below the midway junction. The end of the flag pole is inserted into the top tow eye; it runs into the radius outward pressure of the craft. Simply push the end of the flag pole into this radius expanse until the bottom tow eye is accessible and insert the flag pole. The outward pressure, of the craft, will hold the flag pole securely.

In the event one would like to do some night snorkeling, an underwater lighting system is available. It is comprised of two PVC straps adhered, port and starboard, of any craft of the present invention, at a distance forward of the viewing window to be in easy reach. The dive light mounting straps are mounted low enough onto the craft for the dive light's working end to go below the surface of the water when installed. The PVC straps, two on the port side and two on the starboard side, at the predetermined locations mentioned above. They are spaced far enough apart to see the radius curve of the craft. To install, the butt end of the dive lights are inserted into the lower PVC strap, then the working end of the lights is pulled outward pushing the butt end into the radius curve of the craft, the butt end of the light can now be lined up with the top PVC mount and inserted. The outward pressure of the crafts radius holds the dive lights in place. Now with PVC being very pliable, the user can grasp the butt end of the dive light and move them, simultaneously, in any direction desired. All that is being seen, can be lighted, whether, aft, inboard or outboard.

The next craft 99A is operated in the same manner as craft 99 and having the same embodiments, except for one. The stern length is adjustable. One or more stern air chambers are a separated air chamber. The adjustable stern air chambers would be totally inflated for a tall user. Then the adjustable stern air chamber(s), starting with the aft most adjustable air chamber, would be deflated in degrees, until deflated, then perform the same procedure on the next adjustable air chamber. Thus, accommodate persons of varying heights and weights. Possessing all the embodiments of craft 99, you would operate this craft in the same manner as craft 99.

The next embodiment is perhaps the most versatile and usable by all ages. It is a hand held underwater viewing device 99D. It measures approximately ten to twelve inches wide and approximately twelve to thirteen inches long. The front of the device is approximately eight inches high and slopes aft in a wedge shape to, approximately, two inches high on the stern. Easy to pack and to operate, simply give about five or six good breathes and it's inflated. Then easily fill the integral underwater viewing window with water from almost any water faucet. Grasp the handle on the bow and head for any body of water to wade with it or swim with it. These two uses allow this device to be used by anyone, any age. It's perfect for people who don't snorkel because they can't use conventional gear or don't swim well and for the handy-capped. These people need to feel secure and a life jacket can give that and in order to swim with this device you must wear a life jacket, to hold your head high above the water, and a pair of fins. Get in the water, lean forward and pull this device up under your chin and start snorkeling. The wedge shape of the device allows it to come up under your face, placing your head over the viewing window. Plus, extraneous water is obviously removed very quickly due to the extreme slant of the top lens. The hand held underwater viewing device also comes with inflatable bottom standoffs outboard each side of the bottom lens for protection and a lanyard attachment that can be held by hand or draped over your neck to keep your device from getting away. The uniqueness and versatility of this device is obvious to one skilled in the art.

The next embodiment is a child's craft for infants to two years of age, approximately. This embodiment is something totally new for children this age. The operation is like the other crafts, in that the craft can be inflated first, then the integral underwater viewing window, a part of the craft, can be filled with water, or do vise versa. Then the child is placed into the craft. The underwater viewing window is placed close enough to the child allowing them to lean over, just, slightly, grasp the two side handles to either side of the bow and viewing area, for security, and view below the water, with excitement, that will warm the hearts of the parents. For the security of the parent, there is a lanyard attachment so the parent can keep the child in close proximity, since the child is able the paddle the craft. A flag mount can be attached that the child will find amusing. The flag, for example, could be a dive flag, or something of their favorite cartoon.

The next child craft is for older non swimming children from, approximately, three to four years of age. This embodiment is an elongated craft with an elongated seating area. This requires, when the child is place into the craft, that the child lean forward more, in almost a prone position, to view into the underwater viewing window, and being in easy reach of the water. This allows the child to paddle the craft in a swimming fashion, preparing them for later swimming lessons. The craft has also bow handles to either side of the viewing window. It is the intent of these child crafts to familiarize the child with the water below the surface. Children have always seen the water from above the surface and fear it. Leaving even more fear, possibly, of what's below. A child can now know that what is below the water is fun, helping remove any further fears they may have, and helps to make them, later, strong swimmers.

Children, in some cases, maybe rambunctious and in all cases they grow. Wherein, adjustable seats come into play, for these child crafts. The adjustable seating, in the case of a rambunctious child trying to get out the craft, can be lowered to keep them in place. In the case of growth, the seating can be lowered as the child grows. The adjustments are made easy using four adjusting straps that can have graduated marks on them to keep the seat level. The seating within these child crafts can be of PVC or fabric, both can be adjustable in the same manner. With these seats, there can be an anti-compression solid ring. This ring, extends around the outside radius of the top portion of the seat, PVC or fabric, to which the seat is attached, that prevents the seating area from closing in around and pressing against the child, making for a more enjoyable and cooler underwater viewing experience. May it be noted also, that the fabric seating leg holes are padded and hemmed, which greatly reduces wet leg chafing.

Considering the production of multiple sizes, there would be, if you were large, a large craft. So if you took this large craft on vacation, a large viewing window must be filled with water. You would find it difficult, if not impossible, to accomplish, because no water faucet in a hotel extends out far enough to fill the integral viewing window, within the craft. In the event this was accomplished, the size of the craft plus the weight of a full integral underwater viewing window creates a cumbersome, heavy craft to carry from the hotel room to the beach. Many people could not manage this task physically. The embodiment that eliminates this problem is to have a craft of two parts. First the craft would be modified by removing the viewing area air chamber containing the integral underwater viewing window, craft 99F. This area of the craft would be void. The second part of the craft would be a separate modified hand held viewing area air chamber containing the integral underwater viewing window. The modified hand held underwater viewing device is along the line of craft 99D only larger and taller to equal the depth, width, and length of the void viewing air chamber of craft 99F. Thereby, when you arrive at the hotel room, the modified hand held unit can be inflated and easily filled with water from the bath tub faucet. Then, with the craft inflated, both components can, separately, be easily carried down to the beach where the modified hand held unit is inserted into craft's 99D void viewing area air chamber and your craft is ready for snorkeling. One now can board the craft and operated it in the same manner as craft 99 with an integral underwater viewing window and possessing the same embodiments. This invention is not only, affordable, comfortable and functional, but completely user friendly and travel ready.

The integral underwater viewing window is a unique feature, in that the lenses are sonic welded to the top and bottom expanse of the viewing area cavity within the craft and are one with the craft. This is possible because of the lens material being of, such as but not limited to, PET or PETG (DuPont), which can be sonic welded to PVC. This makes the lens water tight, in a simple and clean way, since the expanse of the viewing port cavity between the top and bottom lenses is filled with water. Creating a highly functional and operational underwater viewing window that delivers crystal clear problem free viewing below the water. To further maintain the operational integrity of the integral underwater viewing window there are two means of reinforcing the water tightness of the underwater viewing window. They are, such as but not limited to, PVC ring reinforcement and a sandwiching reinforcement. These reinforcements greatly reduce leak defects that would disallow proper use. One can purchase and operated these crafts with confidence.

When it comes to filling the underwater viewing window's viewing port cavity with water, evacuating all the air, placing the water fully against the top lens, what can be produced are bubbles within the cavity against the top lens. To remove, simply pour out a bit of the water and add a very small amount of soap to the remaining water within the cavity. When shaken, the soap breaks the surface tension on the top lens and the bubbles are gone. This is an obvious user friendly feature.

The prone use crafts of this invention can incorporate an embodiment, such as but not limited to, recessed sides, port and starboard. The recesses allow easier reach of the water and unencumbered arm movement when paddling. The placement of these recesses is an ergonomic issue in that the recesses cannot extend too far forward into the bow. The rounded bow of these prone use craft is for the user, lying prone, to reach around and essentially hug the bow end of the craft. Thereby the bow supports the user's arms comfortably. This is much like lying prone in bed hugging a pillow. So then the recesses cannot extend to far into the bow. Many of these crafts lengths will allow for the user's legs to extend, to a predetermine amount, into the water, lying prone, on the craft. The use of fins can be the manner of propulsion on these crafts. It should be noted, that with fins, a user can hug the bow of the craft and while moving through the water, can manually tilt the craft from side to side, increasing the field of view.

All the embodiments hereto, collectively make operation of this invention safe, comfortable, easy to use and age accommodating. It is the following embodiment that pulls it all together. All prone use crafts, of this invention, must remain straight in order for these crafts to be comfortable and properly operated.

It is the air chamber design that provides a proper platform on which a user can lie prone in comfortable support to view below the water. This air chamber arrangement consists of a separate outboard air chamber. There is a separate inboard air chamber that runs laterally to the out board air chambers. There are air cross overs, running lateral and connected to the outboard air chamber. One cross over is aft of the viewing area air chamber and forward of, and next to the inboard lateral air chamber and a air cross over next to and aft of the inboard lateral air chamber. The inboard air chamber is boxed in or encapsulated. This locking type arrangement holds the craft in check to prevent bending. This aspect of a rigid craft is imperative for snorkeling, in that one lies prone. There can be no bending or sagging of the craft in the middle. Bending merely, when lying prone, hyper-extends the user's back, as do inflatable pool lounges. Supine is alright but prone is not. This invention's inflatable crafts do not bend, thereby the user lies in total comfort while viewing the underwater world. Total comfort and operational function are one with this invention. This invention is second only to snorkeling with a mask and snorkel with the body weightlessly suspended in the water.

This embodiment is craft 99 that possesses all the embodiments of the other prone use crafts, except for one. There are no scuppers. Extraneous water removal is automatic. When a user boards this craft that is designed for the user's legs to extend beyond the stern and below the surface of the water, the entire craft slants aft ward, including the top lens of the viewing area. Thereby extraneous water will be removed without having to install a slanted top lens. This craft is operated in the same manner as the other prone use crafts and is less expensive to manufacture.

Accordingly the reader will see the crafts of this invention are obviously unique and unlike anything prior. The crafts are designed to remain straight, with no sagging in the middle when used lying prone, providing a user a comfortable platform from which to view below the water. A feature that is uncommon among inflatable crafts. Incorporated within these crafts is an integral underwater viewing window that is one with the crafts. These crafts being inflatable can be deflated and packed very small for travel, along with the integral underwater viewing window, for it to is, collapsible. This also is a new and unique feature. Completing the comfort level of these crafts is a pillow design that is constructed in a semi-circle around the viewing area in a cupped like shape, extending aft ward over the top viewing window lens. Allowing a user to lie prone upon the craft placing their forehead upon the pillow and totally relax. The pillow allows an unencumbered, unconfined view below the water, with abundant ventilation and peripheral vision is maintained. This pillow is for nothing but, single purpose, comfort. There are no holes to plug, as with prior art. Nothing else is like it. These prone use craft support comfortably the user's body but also support a user's arms, by reaching around the bow of the craft when operating and the bow provides support for the arms. No other inflatable craft offers such comfort. Even more, these crafts can be mass produced inexpensively and like the mask and snorkel, can be purchased by the masses and used for their personal use in travel by car or airplane. Furthermore, an inflatable snorkeling craft with integral underwater viewing window has additional advantages in that tow eyes would be provided on the bow and stern of these crafts allowing a parent to tow the child using a line. The stern tow eye could be used to tow a second child in tandem. This is a feature that could be use in the snorkeling business. Wherein elderly people, at a tropical resort, unable to use conventional gear could board their respective craft and be towed inline by jet sky over the reef. The same could apply for children, on smaller crafts, where a PVC straps could be installed on the crafts to keep the children in place.

To provide mid-ship handles mounted strategically on the topside of the outboard air chamber port and starboard beam. In the event a user exited the craft for some reason in deep water could board from the stern by reaching in, grasping the handles, and pull themselves aboard. There could be two or three handles staggered in distance from each other from the stern on up to mid-ship allowing a user to ratchet themselves on to the craft. No other prone use inflatable offers this embodiment.

To provide a bow handle on the prone use crafts allowing a user, using one hand, to pull the craft from the water to the beach.

To provide inflatable standoffs sonic welded to the bottom of the craft on each side of the bottom viewing window lens, of a predetermine length, width and height, that protects the bottom lens from scratches by keeping the lens elevated above any surface the craft maybe laid or dropped. This feature prolongs the life of the viewing window, for too many scratches would preclude vision below the water. These standoffs could even run the full length of the craft, wherein the entire bottom of the craft would be protected from punctures. The standoffs would also be separate air chambers and not inflated with the outboard air chamber. Thereby, if the standoffs were breached, the entire craft would remain in tack. This is also a unique feature.

To provide a means to quickly remove a clear liquid, such as water, from the cavity of viewing port window, for when this liquid is removed the top closable vent must be opened and the craft turned over. Water exiting the single closeable vent creates a vacuum, which slows drastically, the waters evacuation. However, the feature that corrects that is a second closable vent, of any size, located on the bottom lens of viewing window, that when opened will break the vacuum and the water exits quickly. In conjunction with the bottom closeable vent, that is also a time saver, are quick deflate air valves located on the bottom of the craft's outboard and inboard air chambers. When opened, air is quickly removed from the craft, allowing it to be packed small enough to fit into a suit case. These two features come into play when a user is on vacation and is running later for the airport. Valuable time is saved with these features, in getting that user to the airport on time and keeping the craft from being left behind. Consideration is given here, to vacationers. How many prior crafts ever give thought to people who travel. This type of embodiment opens wide the door to mass production because of mass sales.

To provide a flag pole mount and flag on these crafts. It well known by most people what a dive flag is and what is it's for. When a dive boat has divers down, a dive flag is flown on the boat to alert other boaters to stay clear. There will be times when a user with operate one of these crafts in or near boat traffic and if they are snorkeling off a beach at a resort, boat traffic will be present. If this user was to become too enthralled at what he is seeing and ventures out at little too far, a visible, recognizable symbol of warning is imperative! A dive flag and flag mount could therefore be provided on these crafts. This flag mount can be comprised of two tow eyes mounted, several inches apart on any portion of the bow, into which the flag is install. The outward radius of the craft between the tow eyes keeps pressure on the flag pole to hold it in place. This mount can be installed on the crafts at production or come separate as a kit with a flag, for sell separately. Instructions on how and where to install the mount would be included, along with adhesive to install the tow eyes. An alternative is to use small PVC patches, round or square, to which a small PVC strap, the proper diameter for the flag, is sonic welded to these patches. Two patches, installed in the same manner and location as with the toe eyes, that would be cheap enough too possibly install on every craft. This flag mount could be installed on the child crafts, with flags decorated with colors, cartoon characters, or anything kids would like.

To provide an underwater lighting system on the crafts for night snorkeling comprising four PVC straps, of adequate width and length, two installed on each side of the craft forward slightly of the viewing window in easy reach of the user. These PVC straps would be a few inches apart. Wherein, dives lights would be inserted into these straps in the same manner as the flag pole, into the tow eyes, and mounted low enough on the craft to allow the working end of the light to be below the surface of the water. The unique feature here is that PVC is pliable, wherein a user can grasp the butt end of the lights, protruding above the surface of the water, and move the lights directionally with either hand simultaneously. This is a simple, cost effective adjustable lighting system, on an inflatable craft. Another way to mount the dive lights, other than with PVC straps, is to use elongated tubes of PVC, of the proper diameter. adhered in place or sonic welded. This is a one of a kind feature for a lighting system to be on an inflatable craft.

To provide a craft with an adjustable stern length wherein separate air chambers are installed on this craft that run lateral to the outboard air chamber and located aft of the aft air cross over. When all these air chambers are inflated the craft can accommodate a tall, large person. A smaller person would require the aft most air chamber to be deflated, partially or completely. An even smaller person may have all the aft adjustable air chambers deflated. The unique feature of this craft lends itself quite well to the beachside rental market. Whereby, one craft can work for many different heights and weights, with no need to inventory and array of sizes for the clientele. This feature would also work for the retail market, in that there would be no need for multiple sizes to take up valuable shelf space.

To provide a hand held underwater viewing device comprised of an integral underwater viewing device. This device is small and requires only a very few breathes to inflate. The device is in a wedge shape approximately, but not limited to, eight to nine inches at the bow and slants sharply aft ward to approximately, but not limited to, two inches. This hand held device is for all ages, from approximately, but not limited to, six months to whatever. It can be waded with by the young, old, or handy-capped. Additionally, one can swim with it. This little hand held device will open the door to the underwater world to everyone that cannot use traditional snorkeling gear. Handy capped adults and child can now see what they have never seen before. The commercial value here is incalculable, in that the masses, unable to use a mask and snorkel, will purchase this device, because it is very inexpensive, and travel to clear water destinations to enjoy a new experience. Mothers with small children will take this device on vacation so that child can see the world below the surface or just to a lake to wade in shallow water and see the minnows. The snorkel industry will welcome this device because it will open the door to a whole new clientele and that number is tremendous. Plus the size of the device makes it perfect for snorkel boats, in that it takes up very little space on the boat, and can even be stacked. The swimming aspect of this device is also intriguing, a user who cannot use a mask and snorkel and does not swim well, can put on a life jacket and fins, and feel secure. Then pull the device up under their face and snorkel. A lanyard attachment is installed on the craft allowing a lanyard to be attached that can be hand held or draped over the neck. Some snorkel boats require the clientele use life jackets to snorkel in. In this instance, they are moving along, floating weightlessly, using fins and wearing a mask and snorkel, with their face below the water. Now with the hand held device, everything is the same. The user is floating weightlessly in the water, being propelled by fins and their view below the water is the same as with a mask, yet this user's face is not in the water, no mask or snorkel. This little underwater viewing device exemplifies the commercial value for the snorkeling industry or anyone, young or old, fit or handy capped, not associated with any industry. The hand held underwater viewing device can even be use alongside any floating object, such as but not limited to, a boat. This hand held underwater viewing device definitely stands alone.

To provide a craft for children for ages infant too approximately, but not limited to, two years of age, comprising an integral underwater viewing window. This craft could be a donut shaped main air chamber, with a separate air chamber protruding outward and narrows that incorporates the integral underwater viewing window. The seat containing the child can be a fixed PVC or fabric seat. The seating can also be adjustable allowing for child growth. The protrusion housing the viewing window is place close enough to the child whereby the child does not have to lean to far forward to view below the water. With the child low enough to the water, along with the inward slope of the protrusion containing the viewing window, the child can reach the water if so inclined and paddle or slap the water. This craft though being for very young children can, with the craft's design, help teach rudimentary swimming skills, conditioning them for later swimming lessons. Another child craft is for older non swimming children that has an elongated main air chamber and an elongated seating area. Again the seating can be fixed PVC or fabric or can be constructed to be adjustable to accommodate growing children. The leg holes in the fabric seating are padded and hemmed for baby's comfort. There can be also on every child craft an anti-compression, solid, ring which holds the top portion of the seating out from the child whereby the seating does not rise up around the child when place into the craft. This craft is designed so that the child must lean over into an almost prone position to view into the underwater viewing window. The craft is narrow at this end which allows the child to reach the water and paddle it. This will replicate more the swimming motion a child will experience, when they can actually swim. Children have always been familiar with the water from the surface and fear the water to some degree. Not knowing what is below the water can provoke even more fear. It is the intent of this invention open up the underwater world to young children so they will know, that what is below the water is fun, thus removing any further fears. Thereby, they will be strong swimmers in the future. Young children, from infants to four or five years of age, have never seen the underwater world, as have adults and older kids. Now a parent can take child and craft to warm, clear water destinations and take the child snorkeling. The parents will be exalted watching their child's excitement and fascination, seeing fishes and the underwater world for the first time.

To provide a prone use craft that is comprised of two parts. The craft is modified in that the view area air chamber around the underwater viewing window, still containing the viewing window, is removed. The viewing area of the craft is void. The viewing area air chamber and viewing window become a modified hand held underwater viewing device. Which resembles the small hand held device before mentioned, but larger. Also the modified hand held device is the same size approximately, height, width and depth, as the void viewing area of the craft. to take a prone use craft on vacation. One could not fill the viewing window with water that is integrally attached to the craft, for it will not fit adequately under any water faucets in a hotel room. Whereby, if this was accomplished, the craft with a water filled viewing window would be bulky and heavy. The present craft solves both the above problems, in that the separate, modified hand held device can easily be filled from the bath room water faucet. When filled, the craft is inflated and the two can be carried down to the beach, separately. Once at the beach, the modified hand held device is inserted into the craft's void viewing area for a perfect fit. Now the craft is ready for snorkeling being used in the same manner as all the other crafts and possessing all the same embodiments. This crafts design serves no real commercial value, however it does appeal to the private sector because it is absolutely user friendly. Older users would find this craft physically workable for vacation travel.

To provide a lens material that makes the integral underwater viewing window assembly possible. There are two materials presently known of that can be sonic welded to PVC. These materials are, such as but not limited to, PET and PETG a DuPont product. When the lenses of one of these materials are sonic welded to the top and bottom expanses of the viewing port cavity, vertically through the craft, the assembly becomes one with the craft. There is a viewing area air chamber that is a separate air chamber and houses the underwater viewing window. When this viewing area air chamber is deflated along with the craft, the viewing window can collapse flat with the craft. Thus allowing all to be folded up into a small package and packed away or packed into a suit. This is a unique feature.

The means to reinforce these lenses to reduce defects is very important, because if a sonic weld is not complete, leaks occur from the viewing port cavity, when filled with water. Two means of reinforcing the lenses in the viewing window are, such as but not limited to, PVC ring reinforcement and PVC ring sandwich type reinforcement. These reinforcements are as unique as the lens material, and exist because of the lens material. Means to avoid defects, in a business, can be the difference between failure and success.

To provide a prone use craft having all the embodiments of the other prone use crafts. The only exception is no scuppers or any other visible means of extraneous water removal. Extraneous water removal is a simple matter. When a user boards, the craft's stern will go down slightly and slanting the entire craft, along with the top lens of the viewing area, allowing any extraneous water to be removed. The production value is that no scuppers have to be produced. The scuppers require PVC being formed into tubes and then installed into the craft. The savings in one craft by eliminating the man hours and PVC savings is not much. Yet when mass production is considered, the savings would be substantial.

Although the description above contains many specifications, these should not be construed as limiting the scope of this invention but as merely providing illustrations of some of the presently preferred embodiments of this invention. For example, the underwater lighting system for the prone use crafts using dive lights on each side of the craft are not secured in the event they were to accidently go into the water. To solve this problem would be to, such as but not limited to, attach a line across the beam of the craft attached to the butt ends of the dive lights that would keep them attached to the craft. The deck and the pillow of the prone use crafts could be padded in any number of ways. There is also a nylon cover, specifically, for the prone use crafts. Nylon covers for inflatable is not new but this cover has a cut out on the bottom of the craft to reveal the bottom lens of the underwater viewing window to allow the view below the water. However, in use, when the craft is being propelled, the water moving passed the bottom of the craft will inter the above cut out between the craft and nylon cover and move to the aft end or the nylon cover and drag down the forward advance of the craft. This nylon cover will illuminate this by having a mesh or webbed material sewn across the stern of the nylon cover; thereby the water can flow through the nylon cover and exit without impeding the craft's forward motion. Furthermore, the leg holes within the PVC seats and fabric seats, can be made to be adjustable in diameter for different child leg sizes by means of; such as but not limited to, a draw string attachment that could be drawn in for smaller legs or expanded for larger legs. This type of leg hole adjustment can easily be sewn into the fabric seats. The PVC seats would have the draw string fabric material sewn to a PVC ring, thereby the PVC ring with the drawstring attachment, is sonic welded to the leg holes of a PVC seat. Now a PVC seat can adjust for leg diameters. The prone use crafts could also have a bimini or cover for those not wishing to be in the sun. This full length cover would have 4 or more poles of, such as but not limited to, fiberglass mounted onto the crafts through tow eyes mounted on the crafts side in the same manner as the flag pole is inserted into the tow eye mount, mentioned in the specifications. These mounts could be mounted on the lower outside radius of the craft, thus the poles of the cover would protrude outwardly, providing a larger covered expanse.

These PVC crafts of this invention can be of any color, shape, size, air chamber arrangement that does not compromise the comfort, ease of use and view below the water.

Thus the scope of this invention should be determined by the appended claims and their equivalents, rather than by the examples given.

REFERENCE NUMBERS IN DRAWINGS

99 Craft with recessed sides and stern
99A Craft with square stern and recessed sides
99B Craft for very young children
99C Craft for older non-swimming children
99D Hand Held underwater viewing device
99E Craft with no scuppers or water runoff channels
99F Craft for inserted modified hand held underwater viewing air chamber
100 Towing eye
100A Lanyard attachment
101 Bow handle
101A Mid ship handle
101B Child craft handle
101 C Top stern handle
102 Pillow
102A Pillow area of attachment to craft
102B Pillow I-beams
103 Top clear lens
103A Bottom clear lens
103B Slanted top clear lenses
103C Perimeter extensions of craft into viewing port cavity
104 Scuppers
105 Outboard air chambers
105A Inboard, middle lateral air chambers
105B Forward air cross over between and one with outboard air chambers
105C Stern air cross over between and one with the outboard air chambers
106 Viewing area air chamber
106A Viewing area air chamber void
107 Viewing port walled cavity
107A Viewing port cavity walls
108 Boarding guides
109 Stand offs
110 Quick deflate valve
111 Pouch of PVC
111A Pouch of webbing
112 Stern length adjusting air chamber inflated
112A Stern length adjusting air chamber deflated
113 Back brace
114 Donut shaped air chamber with centrally disposed seating cavity
114A elongate oval air chamber with oval aft disposed seating cavity
114B Seating cavity through craft
115 Adjustable PVC set
115A Adjustable fabric seat
116 Fixed PVC seat
116A Fixed fabric seat with PVC suspension
117 Top closeable vent for fluid ingress and regress
118 Small vacuum release vent
119 Large vacuum release vent
120 I-beam
120B Hole through I-beams
121 PVC reinforcing ring
121A Sandwich type lens reinforcement
122 Flag mount
122A Flag pole, PVC
123 Dive light direction adjustable mount, PVC
123A Dive light
124 Outward air pressure area
124A Expanded air chamber into void viewing area
125 Fabric strap
125A Fabric strap for adjustments
125B PVC strap
125C PVC
126 Craft user
127 outboard wall of air chamber
127A Inboard wall of air chamber
128 Connects to PVC seat
129 Connects to fabric seat
130 Looped around and sewn
130A Looped around and sonic welded
130B Sonic weld
131 Two part clasp
131A Male end of clasp
131B Female end of clasp
132 Transition fitting
133 Leg holes
134 Hemmed and padded leg holes
135 Seat anti-compression solid ring
135A Inter anti-compression ring
136 Recessed sides
137 Modified hand held underwater viewing device
138 Heavier gage PVC on bottom half of craft
139 Top sides of craft
139A Bottom side of craft
140 bow end
140A stern end

I claim:

1. An inflatable PVC craft for underwater observation comprising an elongated body, including a top side, a bottom side, a bow end, and a stem end, including an inboard separate air chamber, said inboard separate air chamber having a right side, a left side, a front side and a rear side, a first outboard separate air chamber attached to said right side of said inboard separate air chamber, a second outboard separate air chamber attached to said left side of said inboard separate air chamber, a forward air cross over (105B) connecting said right side of said first outboard separate air chamber to said left side of said first outboard separate air chamber proximal said front side of said inboard separate air chamber, a rear air cross over (105C) connecting said right side of said first outboard separate air chamber to said left side of said first outboard separate air chamber proximal said rear side of said inboard separate air chamber, at least one air deflation valve located on said bottom side of said body, a circular viewing port including a walled cylindrical cavity located vertically through said top side and said bottom side proximal said bow end of said craft, said walled cylindrical cavity including a top perimeter and a bottom perimeter, and a first circular clear lens including a first perimeter is sonic welded to said top perimeter and said second circular clear lens including a second perimeter is sonic welded to said bottom perimeter, waterproofing said circular viewing port, said first circular clear lens and said second circular clear lens are comprised of a material selected from the group consisting of PET and PETG, a first closeable vent located on and through said top circular clear lens and a second closeable vent located on and through said bottom circular clear lens, said first closeable vent said on said circular viewing port may be opened to permit said walled cylindrical cavity of said circular viewing port to be completely filled with water, a first linear inflatable stand-off composed of PVC attached by sonic welding to said bottom side of said craft proximal to a right side of said second circular clear lens, a second linear inflatable stand-off composed of PVC attached by sonic welding to said bottom side of said craft proximal to a left side of said second circular clear lens, said first linear inflatable stand-off and said second linear inflatable stand-off forms a protected area about said second circular clear lens, preventing damage to said second circular clear lens, an inflatable, height adjustable, PVC pillow attached partially around a forward radius of said first circular clear lens, said PVC pillow extending over about 30% of said first circular clear lens, whereby said PVC pillow places the eyes of a user at the center of said first circular clear lens which is an optimal viewing position, providing the user with a clear view for underwater observation.

2. An inflatable craft for underwater observation as claimed in claim 1 wherein a first PVC ring is sonic welded below said first clear lens, proximal said first perimeter further securing said first clear lens to said top side of said body, thereby preventing leaks in said walled cylindrical cavity.

3. An inflatable craft for underwater observation as claimed in claim 2 wherein a second PVC ring is sonic welded below said second clear lens, proximal said second perimeter further securing said second clear lens to said bottom side of said body, thereby preventing leaks in said walled cylindrical cavity.

4. An inflatable craft for underwater observation as claimed in claim 3 wherein a third PVC ring is sonic welded above said first clear lens, proximal said first perimeter whereby said first clear lens is sandwiched between said first PVC ring and said third PVC ring, reinforcing said first clear lens.

5. An inflatable craft for underwater observation as claimed in claim 4 wherein a fourth PVC ring is sonic welded above said second clear lens, proximal said second perimeter whereby said second clear lens is sandwiched between said second PVC ring and said fourth PVC ring, reinforcing said second clear lens.

6. An inflatable PVC craft for underwater observation as claimed in claim 1 wherein said second closeable vent located on and through said second circular lens, which when opened breaks the vacuum formed when the water is discharged from said top closeable vent, allowing rapid discharge of the water.

* * * * *